US011637377B2

(12) United States Patent
Taraschi et al.

(10) Patent No.: US 11,637,377 B2
(45) Date of Patent: Apr. 25, 2023

(54) DIELECTRIC ELECTROMAGNETIC STRUCTURE AND METHOD OF MAKING THE SAME

(71) Applicant: ROGERS CORPORATION, Chandler, AZ (US)

(72) Inventors: Gianni Taraschi, Arlington, MA (US); Kristi Pance, Auburndale, MA (US); Stephen O'Connor, West Roxbury, MA (US); Christopher Brown, Natick, MA (US); Trevor Polidore, Scottsdale, MA (US); Allen F. Horn, III, Pomfret Center, CT (US); Dirk Baars, Phoenix, AZ (US); Roshin Rose George, Burlington, MA (US); Jared Duperre, South Portland, ME (US); Shailesh Pandey, Woburn, MA (US); Karl E. Sprentall, Medford, MA (US); Shawn P. Williams, Andover, MA (US); William Blasius, Charlton, MA (US)

(73) Assignee: ROGERS CORPORATION, Chandler, AZ (US)

( * ) Notice: Subject to any disclaimer, the term of this patent is extended or adjusted under 35 U.S.C. 154(b) by 194 days.

(21) Appl. No.: 17/299,513

(22) PCT Filed: Nov. 22, 2019

(86) PCT No.: PCT/US2019/062761
§ 371 (c)(1),
(2) Date: Jun. 3, 2021

(87) PCT Pub. No.: WO2020/117489
PCT Pub. Date: Jun. 11, 2020

(65) Prior Publication Data
US 2022/0029297 A1 Jan. 27, 2022

Related U.S. Application Data

(60) Provisional application No. 62/775,069, filed on Dec. 4, 2018.

(51) Int. Cl.
*H01Q 9/04* (2006.01)
*H01Q 21/00* (2006.01)
(Continued)

(52) U.S. Cl.
CPC ..... *H01Q 9/0485* (2013.01); *H01P 1/2084* (2013.01); *H01P 7/10* (2013.01); *H01Q 21/0087* (2013.01); *H01Q 21/061* (2013.01)

(58) Field of Classification Search
CPC .... H01Q 9/0485; H01Q 21/061; H01Q 1/422; H01Q 21/0087; H01P 7/10; H01P 1/2084
See application file for complete search history.

(56) References Cited

U.S. PATENT DOCUMENTS 2,624,002 A 10/1952 Bouix
3,212,454 A 10/1965 Ringenbach
(Continued)

FOREIGN PATENT DOCUMENTS

CN 102130376 7/2011
CN 102130377 A 7/2011
(Continued)

OTHER PUBLICATIONS

Akbari, et al., "Comparison between Circularly-Polarized Hybrid DR/Conical Horn and Hybrid DR /spherical Lens Antennas in Millimeter Wave" 2016 IEEE 5th Asia-Pacific Conference on Antennas and Propagation (pp. 261-262).
(Continued)

*Primary Examiner* — Vibol Tan
(74) *Attorney, Agent, or Firm* — Cantor Colburn LLP

(57) ABSTRACT

A method of making a dielectric, Dk, electromagnetic, EM, structure, includes: providing a first mold portion compris-
(Continued)

ing substantially identical ones of a first plurality of recesses arranged in an array; filling the first plurality of recesses with a curable first Dk composition having a first average dielectric constant greater than that of air after full cure; placing a substrate on top of and across multiple ones of the first plurality of recesses filled with the first Dk composition, and at least partially curing the curable first Dk composition; and, removing the substrate with the at least partially cured first Dk composition from the first mold portion, resulting in an assembly having the substrate and a plurality of Dk forms including the at least partially cured first Dk composition, each of the plurality of Dk forms having a three dimensional, 3D, shape defined by corresponding ones of the first plurality of recesses.

35 Claims, 39 Drawing Sheets

(51) Int. Cl.

| | |
|---|---|
| ***H01Q 21/06*** | (2006.01) |
| ***H01P 7/10*** | (2006.01) |
| ***H01P 1/208*** | (2006.01) |

(56) References Cited

U.S. PATENT DOCUMENTS

| | | | |
|---|---|---|---|
| 3,255,453 | A | 6/1966 | Horst |
| 3,321,765 | A | 5/1967 | Peters et al. |
| 3,321,821 | A | 5/1967 | Horst |
| 4,274,097 | A | 6/1981 | Krall et al. |
| 4,288,795 | A | 9/1981 | Shelton |
| 4,366,484 | A | 12/1982 | Weiss et al. |
| 4,458,249 | A | 7/1984 | Valentino et al. |
| 4,575,330 | A | 3/1986 | Hull |
| 4,743,915 | A | 5/1988 | Rammos et al. |
| 4,929,402 | A | 5/1990 | Hull |
| 4,983,910 | A | 1/1991 | Majidi-Ahy et al. |
| 5,061,943 | A | 10/1991 | Rammos |
| 5,104,592 | A | 4/1992 | Hull et al. |
| 5,125,111 | A | 6/1992 | Trinh |
| 5,184,307 | A | 2/1993 | Hull et al. |
| 5,192,559 | A | 3/1993 | Hull et al. |
| 5,227,749 | A | 7/1993 | Raguenet et al. |
| 5,234,636 | A | 8/1993 | Hull et al. |
| 5,236,637 | A | 8/1993 | Hull |
| 5,273,691 | A | 12/1993 | Hull et al. |
| 5,453,754 | A | 9/1995 | Fray |
| 5,476,749 | A | 12/1995 | Steinmann et al. |
| 5,589,842 | A | 12/1996 | Wang et al. |
| 5,667,796 | A | 9/1997 | Otten |
| 5,677,796 | A | 10/1997 | Zimmerman et al. |
| 5,825,271 | A | 10/1998 | Stitzer |
| 5,854,608 | A | 12/1998 | Leisten |
| 5,867,120 | A | 2/1999 | Ishikawa et al. |
| 5,940,036 | A | 8/1999 | Oliver et al. |
| 5,943,005 | A | 8/1999 | Tanizaki et al. |
| 5,952,972 | A | 9/1999 | Ittipiboon et al. |
| 6,008,755 | A | 12/1999 | Ishikawa et al. |
| 6,031,433 | A | 2/2000 | Tanizaki et al. |
| 6,052,087 | A | 4/2000 | Ishikawa et al. |
| 6,061,026 | A | 5/2000 | Ochi et al. |
| 6,061,031 | A | 5/2000 | Cosenza et al. |
| 6,075,485 | A | 6/2000 | Lilly et al. |
| 6,075,492 | A | 6/2000 | Schmidt et al. |
| 6,076,324 | A | 6/2000 | Daily et al. |
| 6,133,887 | A | 10/2000 | Tanizaki et al. |
| 6,147,647 | A | 11/2000 | Tassoudji et al. |
| 6,181,297 | B1 | 1/2001 | Leisten |
| 6,188,360 | B1 | 2/2001 | Kato et al. |
| 6,198,450 | B1 | 3/2001 | Adachi et al. |
| 6,268,833 | B1 | 7/2001 | Tanizaki et al. |
| 6,292,141 | B1 | 9/2001 | Lim |
| 6,314,276 | B1 | 11/2001 | Hilgers et al. |
| 6,317,095 | B1 | 11/2001 | Teshirogi et al. |
| 6,323,808 | B1 | 11/2001 | Heinrichs et al. |
| 6,323,824 | B1 | 11/2001 | Heinrichs et al. |
| 6,344,833 | B1 | 2/2002 | Lin et al. |
| 6,373,441 | B1 | 4/2002 | Porath et al. |
| 6,437,747 | B1 | 8/2002 | Stoiljkovic et al. |
| 6,476,774 | B1 | 11/2002 | Davidson et al. |
| 6,528,145 | B1 | 3/2003 | Berger et al. |
| 6,552,687 | B1 | 4/2003 | Rawnick et al. |
| 6,556,169 | B1 | 4/2003 | Fukuura et al. |
| 6,621,381 | B1 | 9/2003 | Kundu et al. |
| 6,743,744 | B1 | 6/2004 | Kim et al. |
| 6,794,324 | B1 | 9/2004 | Kim et al. |
| 6,816,118 | B2 | 11/2004 | Kingsley et al. |
| 6,816,128 | B1 | 11/2004 | Jennings |
| 6,855,478 | B2 | 2/2005 | DeVoe et al. |
| 7,161,535 | B2 | 1/2007 | Palmer et al. |
| 7,179,844 | B2 | 2/2007 | Aki |
| 7,183,975 | B2 | 2/2007 | Thomas et al. |
| 7,196,663 | B2 | 3/2007 | Bozer et al. |
| 7,253,789 | B2 | 8/2007 | Kingsley et al. |
| 7,279,030 | B2 | 10/2007 | Kurowski |
| 7,292,204 | B1 | 11/2007 | Chang et al. |
| 7,310,031 | B2 | 12/2007 | Pance et al. |
| 7,355,560 | B2 | 4/2008 | Nagai |
| 7,379,030 | B1 | 5/2008 | Lier |
| 7,382,322 | B1 | 6/2008 | Yang et al. |
| 7,405,698 | B2 | 7/2008 | de Rochemont |
| 7,443,363 | B2 | 10/2008 | Ying |
| 7,498,969 | B1 | 3/2009 | Paulsen et al. |
| 7,534,844 | B2 | 5/2009 | Lee et al. |
| 7,545,327 | B2 | 6/2009 | Iellici et al. |
| 7,550,246 | B2 | 6/2009 | Fukuzumi et al. |
| 7,570,219 | B1 | 8/2009 | Paulsen et al. |
| 7,595,765 | B1 | 9/2009 | Hirsch et al. |
| 7,636,063 | B2 | 12/2009 | Channabasappa |
| 7,649,029 | B2 | 1/2010 | Kolb et al. |
| 7,663,553 | B2 | 2/2010 | Chang et al. |
| 7,688,263 | B1 | 3/2010 | Oxley |
| 7,710,325 | B2 | 5/2010 | Cheng |
| 7,767,728 | B2 | 8/2010 | Lu et al. |
| 7,796,080 | B1 | 9/2010 | Lynch et al. |
| 7,824,839 | B2 | 11/2010 | Ober et al. |
| 7,835,600 | B1 | 11/2010 | Yap et al. |
| 7,876,283 | B2 | 1/2011 | Bouche et al. |
| 7,935,476 | B2 | 5/2011 | Teng |
| 7,961,148 | B2 | 6/2011 | Goldberger |
| 8,018,397 | B2 | 9/2011 | Jow et al. |
| 8,098,187 | B1 | 1/2012 | Lynch et al. |
| 8,098,197 | B1 | 1/2012 | Herting et al. |
| 8,119,214 | B2 | 2/2012 | Schwantes et al. |
| 8,232,043 | B2 | 7/2012 | Williamson et al. |
| 8,497,804 | B2 | 7/2013 | Haubrich et al. |
| 8,498,539 | B1 | 7/2013 | Ilchenko et al. |
| 8,736,502 | B1 | 5/2014 | Langfield et al. |
| 8,773,319 | B1 | 7/2014 | Anderson et al. |
| 8,902,115 | B1 | 12/2014 | Loui et al. |
| 9,112,273 | B2 | 8/2015 | Christie et al. |
| 9,184,697 | B2 | 11/2015 | Sekiguchi et al. |
| 9,205,601 | B2 | 12/2015 | Desimone et al. |
| 9,225,070 | B1 | 12/2015 | Zeweri et al. |
| 9,455,488 | B2 | 9/2016 | Chirila |
| 9,583,837 | B2 | 2/2017 | Xue et al. |
| 9,608,330 | B2 | 3/2017 | Singleton et al. |
| 9,825,373 | B1 | 11/2017 | Smith |
| 9,917,044 | B2 | 3/2018 | Zhou et al. |
| 9,930,668 | B2 | 3/2018 | Barzegar et al. |
| 9,944,031 | B2 * | 4/2018 | Thompson ..... B29D 11/0073 |
| 10,355,361 | B2 * | 7/2019 | Pance ..... H01Q 9/0485 |
| 10,476,164 | B2 | 11/2019 | Pance et al. |
| 10,522,917 | B2 | 12/2019 | Pance et al. |
| 10,587,039 | B2 | 3/2020 | Pance et al. |
| 10,601,137 | B2 | 3/2020 | Pance et al. |
| 10,665,947 | B2 * | 5/2020 | Pance ..... H01Q 9/0492 |
| 10,700,438 | B2 | 6/2020 | Gerding |
| 11,108,159 | B2 | 8/2021 | Pance et al. |
| 11,574,849 | B2 * | 2/2023 | Gmundner ..... H01L 21/561 |
| 2001/0013842 | A1 | 8/2001 | Ishikawa et al. |

(56) References Cited

U.S. PATENT DOCUMENTS

2001/0043158 A1 11/2001 Adachi et al.
2002/0000947 A1 1/2002 Al-Rawi et al.
2002/0057138 A1 5/2002 Takagi et al.
2002/0067317 A1 6/2002 Sakurada
2002/0149108 A1 10/2002 Ahn et al.
2002/0180646 A1 12/2002 Kivekas et al.
2002/0196190 A1 12/2002 Lim
2003/0016176 A1 1/2003 Kingsley et al.
2003/0034922 A1 2/2003 Isaacs et al.
2003/0043075 A1 3/2003 Bit-Babik et al.
2003/0043086 A1 3/2003 Schaffner et al.
2003/0122729 A1 7/2003 Diaz et al.
2003/0151548 A1 8/2003 Kingsley et al.
2003/0181312 A1 9/2003 Mailadil et al.
2004/0029709 A1 2/2004 Oba et al.
2004/0029985 A1 2/2004 Aki et al.
2004/0036148 A1 2/2004 Block et al.
2004/0051602 A1 3/2004 Pance et al.
2004/0080455 A1 4/2004 Lee
2004/0113843 A1 6/2004 Le Bolzer et al.
2004/0119646 A1 6/2004 Ohno et al.
2004/0127248 A1 7/2004 Lin et al.
2004/0130489 A1 7/2004 Le Bolzer et al.
2004/0155817 A1 8/2004 Kingsley et al.
2004/0233107 A1 11/2004 Popov et al.
2004/0257176 A1 12/2004 Pance et al.
2004/0263422 A1 12/2004 Lynch
2005/0017903 A1 1/2005 Ittipiboon et al.
2005/0024271 A1 2/2005 Ying et al.
2005/0057402 A1 3/2005 Ohno et al.
2005/0099348 A1 5/2005 Pendry
2005/0122273 A1 6/2005 Legay et al.
2005/0154567 A1 7/2005 Jackman et al.
2005/0162316 A1 7/2005 Thomas et al.
2005/0162733 A1 7/2005 Cho et al.
2005/0179598 A1 8/2005 Legay et al.
2005/0200531 A1 9/2005 Huang et al.
2005/0219130 A1 10/2005 Koch et al.
2005/0225499 A1 10/2005 Kingsley et al.
2005/0242996 A1 11/2005 Palmer et al.
2005/0248421 A1 11/2005 Joodaki
2005/0264449 A1 12/2005 Strickland
2005/0264451 A1 12/2005 Aikawa et al.
2005/0264452 A1 12/2005 Fujishima et al.
2006/0022875 A1 2/2006 Pidwerbetsky et al.
2006/0119518 A1 6/2006 Ohmi et al.
2006/0145705 A1 7/2006 Raja
2006/0194690 A1 8/2006 Osuzu
2006/0220958 A1 10/2006 Saegrov
2006/0232474 A1 10/2006 Fox
2006/0293651 A1 12/2006 Cronin
2007/0067058 A1 3/2007 Miyamoto et al.
2007/0152884 A1 7/2007 Bouche et al.
2007/0164420 A1 7/2007 Chen et al.
2007/0252778 A1 11/2007 Ide et al.
2008/0036675 A1 2/2008 Fujieda
2008/0042903 A1 2/2008 Cheng
2008/0048915 A1 2/2008 Chang et al.
2008/0079182 A1 4/2008 Thompson et al.
2008/0094309 A1 4/2008 Pance et al.
2008/0122703 A1 5/2008 Ying
2008/0129616 A1 6/2008 Li et al.
2008/0129617 A1 6/2008 Li et al.
2008/0193749 A1 8/2008 Thompson et al.
2008/0202720 A1 8/2008 Wagstaff
2008/0260323 A1 10/2008 Jalali et al.
2008/0272963 A1 11/2008 Chang et al.
2008/0278378 A1 11/2008 Chang et al.
2009/0040131 A1 2/2009 Mosallaei
2009/0073332 A1 3/2009 Irie
2009/0102739 A1 4/2009 Chang et al.
2009/0128262 A1 5/2009 Lee et al.
2009/0128434 A1 5/2009 Chang et al.
2009/0140944 A1 6/2009 Chang et al.
2009/0153403 A1 6/2009 Chang et al.
2009/0179810 A1 7/2009 Kato et al.
2009/0184875 A1 7/2009 Chang et al.
2009/0206957 A1 8/2009 Hiroshima et al.
2009/0262022 A1 10/2009 Ying
2009/0270244 A1 10/2009 Chen et al.
2009/0305652 A1 12/2009 Boffa et al.
2010/0002312 A1 1/2010 Duparre et al.
2010/0051340 A1 3/2010 Yang et al.
2010/0103052 A1 4/2010 Ying
2010/0156754 A1 6/2010 Kondou
2010/0220024 A1 9/2010 Snow et al.
2010/0231452 A1 9/2010 Babakhani et al.
2011/0012807 A1 1/2011 Sorvala
2011/0050367 A1 3/2011 Yen et al.
2011/0121258 A1 5/2011 Hanein et al.
2011/0122036 A1 5/2011 Leung et al.
2011/0133991 A1 6/2011 Lee et al.
2011/0204531 A1 8/2011 Hara et al.
2011/0248890 A1 10/2011 Lee et al.
2012/0045619 A1 2/2012 Ando et al.
2012/0092219 A1 4/2012 Kim
2012/0212386 A1 8/2012 Massie et al.
2012/0242553 A1 9/2012 Leung et al.
2012/0245016 A1 9/2012 Curry et al.
2012/0256796 A1 10/2012 Leiba
2012/0274523 A1 11/2012 Ayatollahi
2012/0276311 A1 11/2012 Chirila
2012/0280380 A1 11/2012 Kamgaing
2012/0287008 A1 11/2012 Kim
2012/0306713 A1 12/2012 Raj et al.
2012/0329635 A1 12/2012 Hill
2013/0076570 A1 3/2013 Lee et al.
2013/0088396 A1 4/2013 Han
2013/0113674 A1 5/2013 Ryu
2013/0120193 A1 5/2013 Hoppe et al.
2013/0127669 A1 5/2013 Han et al.
2013/0234898 A1 9/2013 Leung et al.
2013/0278610 A1 10/2013 Stephanou et al.
2014/0043189 A1 2/2014 Lee et al.
2014/0091103 A1 4/2014 Neitzel
2014/0139370 A1 5/2014 Hamner et al.
2014/0327591 A1 11/2014 Kokkinos
2014/0327597 A1 11/2014 Rashidian et al.
2015/0035714 A1 2/2015 Zhou
2015/0070230 A1 3/2015 Bradley et al.
2015/0077198 A1 3/2015 Yatabe
2015/0138036 A1 4/2015 Harper
2015/0183167 A1 7/2015 Molinari et al.
2015/0207233 A1 7/2015 Kim et al.
2015/0207234 A1 7/2015 Ganchrow et al.
2015/0236428 A1 8/2015 Caratelli et al.
2015/0244082 A1 8/2015 Caratelli et al.
2015/0266244 A1 9/2015 Page
2015/0303546 A1 10/2015 Rashidian et al.
2015/0314526 A1 11/2015 Cohen
2015/0346334 A1 12/2015 Nagaishi et al.
2015/0380824 A1 12/2015 Tayfeh Aligodarz et al.
2016/0036132 A1 2/2016 Rumpf et al.
2016/0107290 A1 4/2016 Bajaj et al.
2016/0111769 A1 4/2016 Pance et al.
2016/0218437 A1 7/2016 Guntupalli et al.
2016/0219976 A1 8/2016 Guyan
2016/0263823 A1 9/2016 Espiau
2016/0294066 A1 10/2016 Djerafi et al.
2016/0294068 A1 10/2016 Djerafi et al.
2016/0313306 A1 10/2016 Ingber et al.
2016/0314431 A1 10/2016 Quezada
2016/0322708 A1 11/2016 Tayfeh Aligodarz et al.
2016/0351996 A1 12/2016 Ou
2016/0372955 A1 12/2016 Fackelmeier et al.
2017/0018851 A1 1/2017 Henry et al.
2017/0040700 A1 2/2017 Leung et al.
2017/0062944 A1 3/2017 Zimmerman et al.
2017/0110804 A1 4/2017 Henry et al.
2017/0125901 A1 5/2017 Sharawi et al.
2017/0125908 A1 5/2017 Pance et al.
2017/0125909 A1 5/2017 Pance et al.
2017/0125910 A1 5/2017 Pance et al.
2017/0179569 A1 6/2017 Kim et al.

(56) References Cited

U.S. PATENT DOCUMENTS

| | | | |
|---|---|---|---|
| 2017/0188874 | A1 | 7/2017 | Suhami |
| 2017/0201026 | A1 | 7/2017 | Werner et al. |
| 2017/0225395 | A1 | 8/2017 | Boydston et al. |
| 2017/0256847 | A1 | 9/2017 | Vollmer et al. |
| 2017/0271772 | A1 | 9/2017 | Miraftab et al. |
| 2017/0272149 | A1 | 9/2017 | Michaels |
| 2017/0324171 | A1 | 11/2017 | Shehan |
| 2017/0360534 | A1 | 12/2017 | Sun |
| 2018/0007746 | A1 | 1/2018 | Smith |
| 2018/0054234 | A1 | 2/2018 | Stuckman et al. |
| 2018/0069594 | A1 | 3/2018 | Henry et al. |
| 2018/0090815 | A1 | 3/2018 | Shirinfar et al. |
| 2018/0115072 | A1 | 4/2018 | Pance et al. |
| 2018/0166789 | A1 | 6/2018 | Galla et al. |
| 2018/0183150 | A1 | 6/2018 | Sienkiewicz et al. |
| 2018/0241129 | A1 | 8/2018 | Pance et al. |
| 2018/0282550 | A1 | 10/2018 | Burgess et al. |
| 2018/0309202 | A1 | 10/2018 | Pance et al. |
| 2018/0323514 | A1 | 11/2018 | Pance et al. |
| 2019/0020105 | A1 | 1/2019 | Pance et al. |
| 2019/0115668 | A1 | 4/2019 | Coward et al. |
| 2019/0128624 | A1 | 5/2019 | Cohen et al. |
| 2019/0214732 | A1 | 7/2019 | Leung et al. |
| 2019/0221926 | A1 | 7/2019 | Pance et al. |
| 2019/0221939 | A1 | 7/2019 | George et al. |
| 2019/0221940 | A1 | 7/2019 | Pance et al. |
| 2019/0288360 | A1 | 9/2019 | Hendry |
| 2019/0319357 | A1 | 10/2019 | Pance et al. |
| 2019/0319358 | A1 | 10/2019 | Pance et al. |
| 2019/0379123 | A1 | 12/2019 | Leung et al. |
| 2019/0393607 | A1 | 12/2019 | Pance et al. |
| 2020/0083602 | A1 | 3/2020 | Sethumadhavan et al. |
| 2020/0083609 | A1 | 3/2020 | Pance et al. |
| 2020/0083610 | A1 | 3/2020 | Pance et al. |
| 2020/0099136 | A1 | 3/2020 | Pance et al. |
| 2020/0122387 | A1 | 4/2020 | Polidore et al. |
| 2020/0194881 | A1 | 6/2020 | Pance et al. |
| 2020/0227827 | A1 | 7/2020 | Vollmer et al. |
| 2021/0328356 | A1 | 10/2021 | Polidore et al. |

FOREIGN PATENT DOCUMENTS

| | | | |
|---|---|---|---|
| CN | 104037505 | A | 9/2014 |
| CN | 105390809 | A | 3/2016 |
| CN | 105490005 | A | 4/2016 |
| CN | 106299672 | A | 1/2017 |
| CN | 107240782 | A | 10/2017 |
| CN | 110212310 | A | 9/2019 |
| CN | 110380230 | A | 10/2019 |
| CN | 216288983 | U | 4/2022 |
| DE | 102015005468 | A1 | 11/2016 |
| EP | 0468413 | A2 | 1/1992 |
| EP | 0587247 | A1 | 3/1994 |
| EP | 0801436 | A2 | 10/1997 |
| EP | 1772748 | A1 | 4/2007 |
| EP | 1783516 | A1 | 5/2007 |
| EP | 2905632 | A1 | 8/2015 |
| GB | 2050231 | A | 1/1981 |
| GB | 2575946 | A | 1/2020 |
| JP | H0665334 | A | 3/1994 |
| JP | H07154114 | A | 6/1995 |
| JP | 08191211 | A | 7/1996 |
| JP | 2004112131 | A | 4/2004 |
| JP | 2013211841 | A | 10/2010 |
| RU | 2660385 | | 7/2018 |
| WO | 9513565 | A1 | 5/1995 |
| WO | 0076028 | A1 | 12/2000 |
| WO | 2012129968 | A1 | 10/2012 |
| WO | 2014100462 | A1 | 6/2014 |
| WO | 2014126837 | A2 | 8/2014 |
| WO | 2015102938 | A1 | 7/2015 |
| WO | 2016153711 | A1 | 9/2016 |
| WO | 2017040883 | A1 | 3/2017 |
| WO | 2017075177 | A1 | 5/2017 |
| WO | 2017075184 | A1 | 5/2017 |
| WO | 2017090401 | A1 | 6/2017 |
| WO | 2018010443 | A1 | 1/2018 |
| WO | 2017075186 | A1 | 5/2018 |
| WO | 2018226657 | A1 | 12/2018 |

OTHER PUBLICATIONS

"New 3D Printed Electromagnetic Lense from OmniPreSense"; URL: http://www.microwavejournal.com/articles/31133-new-3d-printed-electromagnetic-lens-from-omnipresense; Date of Access: Oct. 16, 2018; 8 pages.

"Photoacid Generator Selection Guide for the electronics industry and energy curable coatings" (BASF 2010).

Boriskin et al. "Integrated Lens Antennas" In: "Aperture Antennas for Millimeter and Sub-Millimeter Wave Applications", Sep. 8, 2017, International Publishing, pp. 3-36.

Elboushi A. et al., "High Gain Hybrid DRA/Horn antenna for MMW Applications", Concordia Universitiy; 2014 IEEE; 2 pages.

Hesselbarth et al., "Millimeter-wave front-end integration concept using beam-switched lens antenna", 2016 10th European Conference on Antennas and Propagation, European Assoc. of Antennas and Propagation, Apr. 10, 2016; pp. 1-5.

Keysight Technologies; "Split Post Dielectric Resonators for Dielectric Measurements of Substrates"; Keysight Technologies, Dec. 2, 2017; 5989-5384EN, pp. 1-11.

Krupka et al.; "Split post dielectric resonator technique for precise measurements of laminar dielectric specimens—Measurement uncertainties"; IEEE Xplore Conference Paper Feb. 2000, pp. 305-308.

Krupka J., Gregory A.P., Rochard O.C., Clarke R.N., Riddle B., Baker-Jarvis J., Uncertainty of Complex Permittivity Measurement by Split-Post Dielectric Resonator Techniques, Journal of the European Ceramic Society, No. 10, pp. 2673-2676, 2001.

Krupka, J., Geyer, R.G., Baker-Jarvis, J., Ceremuga, J., Measurements of the complex permittivity of microwave circuit board substrates using split dielectric resonator and reentrant cavity tech-¬niques, Seventh International Conference on Dielectric Materials, Measurements and Applications, (Conf. Publ. No. 430), pp. 21-24, Sep. 1996.

Lei, Juan et al., "Experimental demonstration of conformal phased array antenna via transformation optics," Scientific Reports, vol. 8, No. 1, Feb. 28, 2018, 14 pages.

Liang, M. et al.; "A 3-D Luneburg lens antenna fabricated by polymer jetting rapid prototyping," IEEE Transactions on Antennas and Propagation, 62(4), Apr. 2014, 1799-1807.

Tang, W. et al., "Discrete Coordinate Transformation for Designing All-Dielectric Flat Antennas", IEEE Transactions on Antennas and Propagation, vol. 58, No. 12, Dec. 2010 pp. 3795-3804.

Thornton et al., "Introduction" In: "Modern Lens Antennas for Communications Engineering", Jan. 1, 2013 John Wiley & Sons, Inc. pp. 1-48.

Zainud-Deen SH Et al: High Directive Dielectric resonator antenna over curved ground plane using metamaterials, National Radio Science Conference IEEE, Apr. 26, 2011 pp. 1-9.

Atabak Rashidian et al; "Photoresist-Based Polymer Resonator Antennas: Lithography Fabrication, Strip-Fed Excitation, and Multimode Operation", IEEE Antennas and Propagation Magazine, IEEE Service Center; vol. 53, No. 4, Aug. 1, 2011; 16-27 pages.

Buerkle, A. et al; "Fabrication of a DRA Array Using Ceramic Stereolithography"; IEEE Antennas and Wireless Popagation Letters; IEEE; vol. 5,, No. 1, Jan. 2007; pp. 479-481.

Guo, Yomg-Xin, et al.,; "Wide-Band Stacked Double Annular-Ring Dielectric Resonator Antenna at the End-Fire Mode Operation"; IEEE Transacions on Antennas and Propagation; vol. 53; No. 10; Oct. 2005; 3394-3397 pages.

Kakade, A.B., et al; "Analysis of the Rectangular Waveguide Slot Coupled Multilayer hemispherical Dielectric Resonator Antenna"; IET Microwaves, Antennas & Propagation, The Institution of Engineering and Technology; vol. 6; No. 3; Jul. 11, 2011; 338-347 pages.

Kakade, Anandrao, et al.; Mode Excitation in the Coaxial Probe Coupled Three-Layer Hemispherical Dielectric Resonator Antenna; IEEE Transactions on Antennas and Propagation; vol. 59; No. 12; Dec. 2011; 7 pages.

(56) References Cited

OTHER PUBLICATIONS

Kishk, A. Ahmed, et al.,; "Analysis of Dielectric-Resonator with Emphasis on Hemispherical Structures"; IEEE Antennas & Propagation Magazine; vol. 36; No. 2; Apr. 1994; 20-31 pages.
Notification of Transmittal of the International Search Report for International Application No. PCT/US2019/062761 Report dated Apr. 20, 2020; 10 pages.
Petosa, Aldo, et al.; "Dielectric Resonator Antennas: A Historical Review and the Current State of the Art"; IEEE Antennas and Propagation Magazine; vol. 52, No. 5, Oct. 2010; 91-116 pages.
Raghvendra Kumar Chaudhary et al; Variation of Permittivity in Radial Direction in Concentric Half-Split Cylindrical Dielectric Resonator Antenna for Wideband Application: Permittivity Variation in R-Dir. in CDRA; International Journal of RF and Microwave Computer-Aided Engineering; vol. 25; No. 4; May 1, 2015; pp. 321-329.
Ruan, Yu-Feng, et al; "Antenna Effects Consideration for Space-Time Coding UWB-Impulse Radio System in IEEE 802.15 Multipath Channel"; Wireless Communications, Networking and Mobile Computing; 2006; 1-4 pages.
Wong, Kin-Lu, et al.,; "Analysis of a Hemispherical Dielectric Resonator Antenna with an Airgap"; IEEE Microwave and Guided Wave Letters; vol. 3; No. 9; Oct. 3, 1993; 355-357 pages.
Written Opinion of the International Searching Authority for International Application No. PCT/US2019/062761; Report dated Apr. 20, 2020; 34 pages.
Zainud-Deen, S H et al; "Dielectric Resonator Antenna Phased Array for Fixed RFID Reader in Near Field Region" IEEE; Mar. 6, 2012; pp. 102-107.
Zhang Shiyu et al.; "3D-Printed Graded Index Lenses for RF Applications"; ISAP 2016 International Symposium on Antennas and Propagation, Okinawa, Japan.; pp. 1-27.

* cited by examiner

DIELECTRIC ELECTROMAGNETIC STRUCTURE AND METHOD OF MAKING THE SAME

CROSS REFERENCE TO RELATED APPLICATIONS

This application claims the benefit of U.S. Provisional Application Ser. No. 62/775,069, filed Dec. 4, 2018, which is incorporated herein by reference in its entirety.

BACKGROUND OF THE INVENTION

The present disclosure relates generally to dielectric, Dk, electromagnetic, EM, structures and methods of making the same, and particularly to cost efficient methods of making high performance Dk EM structures.

An example Dk EM structure and example method of making the same is disclosed in WO 2017/075177 A1, assigned to Applicant.

While existing Dk EM structures and methods of making the same may be suitable for their intended purpose, the art relating to the fabrication of Dk EM structures would be advanced by the application of cost efficient methods of making Dk EM structures.

BRIEF DESCRIPTION OF THE INVENTION

An embodiment includes a method of making a dielectric, Dk, electromagnetic, EM, structure, comprising: providing a first mold portion comprising substantially identical ones of a first plurality of recesses arranged in an array; filling the first plurality of recesses with a curable first Dk composition having a first average dielectric constant greater than that of air after full cure; placing a substrate on top of and across multiple ones of the first plurality of recesses filled with the first Dk composition, and at least partially curing the curable first Dk composition; and, removing the substrate with the at least partially cured first Dk composition from the first mold portion, resulting in an assembly comprising the substrate and a plurality of Dk forms comprising the at least partially cured first Dk composition, each of the plurality of Dk forms having a three dimensional, 3D, shape defined by corresponding ones of the first plurality of recesses.

Another embodiment includes a method of making a dielectric, Dk, electromagnetic, EM, structure having one or more of a first dielectric portion, 1DP, the method comprising: providing a first mold portion comprising substantially identical ones of a first plurality of recesses arranged in an array and configured to form a plurality of the 1DP, the first mold portion further comprising a plurality of relatively thin connecting channels that interconnect adjacent ones of the plurality of recesses; filling the first plurality of recesses and the relatively thin connecting channels with a curable Dk composition having an average dielectric constant greater than that of air after full cure; placing a second mold portion on top of the first mold portion with the curable Dk composition disposed therebetween; pressing the second mold portion toward the first mold portion and at least partially curing the curable Dk composition; separating the second mold portion relative to the first mold portion; and removing the at least partially cured Dk composition from the first mold portion, resulting in at least one Dk form comprising the at least partially cured Dk composition, each of the at least one Dk form having a three dimensional, 3D, shape defined by the first plurality of recesses and the interconnecting plurality of relatively thin connecting channels, the 3D shape defined by the first plurality of recesses providing a plurality of the 1DP in the EM structure.

Another embodiment includes a method of making a dielectric, Dk, electromagnetic, EM, structure, comprising: providing a sheet of Dk material; forming in the sheet substantially identical ones of a plurality of recesses arranged in an array, with the non-recessed portions of the sheet forming a connecting structure between individual ones of the plurality of recesses; filling the plurality of recesses with a curable Dk composition having a first average dielectric constant greater than that of air after full cure, wherein the sheet of Dk material has a second average dielectric constant that is different from the first average dielectric constant; and at least partially curing the curable Dk composition.

Another embodiment includes a dielectric, Dk, electromagnetic, EM, structure, comprising: at least one Dk component comprising a Dk material other than air having a first average dielectric constant; and a water impervious layer, a water barrier layer, or a water repellent layer, conformally disposed over at least a portion of the exposed surfaces of the at least one Dk component.

The above features and advantages and other features and advantages of the invention are readily apparent from the following detailed description of the invention when taken in connection with the accompanying drawings.

BRIEF DESCRIPTION OF THE DRAWINGS

Referring to the exemplary non-limiting drawings wherein like elements are numbered alike, or wherein similar elements are numbered similarly but with a differing leading numeral, in the accompanying Figures.

DETAILED DESCRIPTION OF THE INVENTION

Figure 1A:
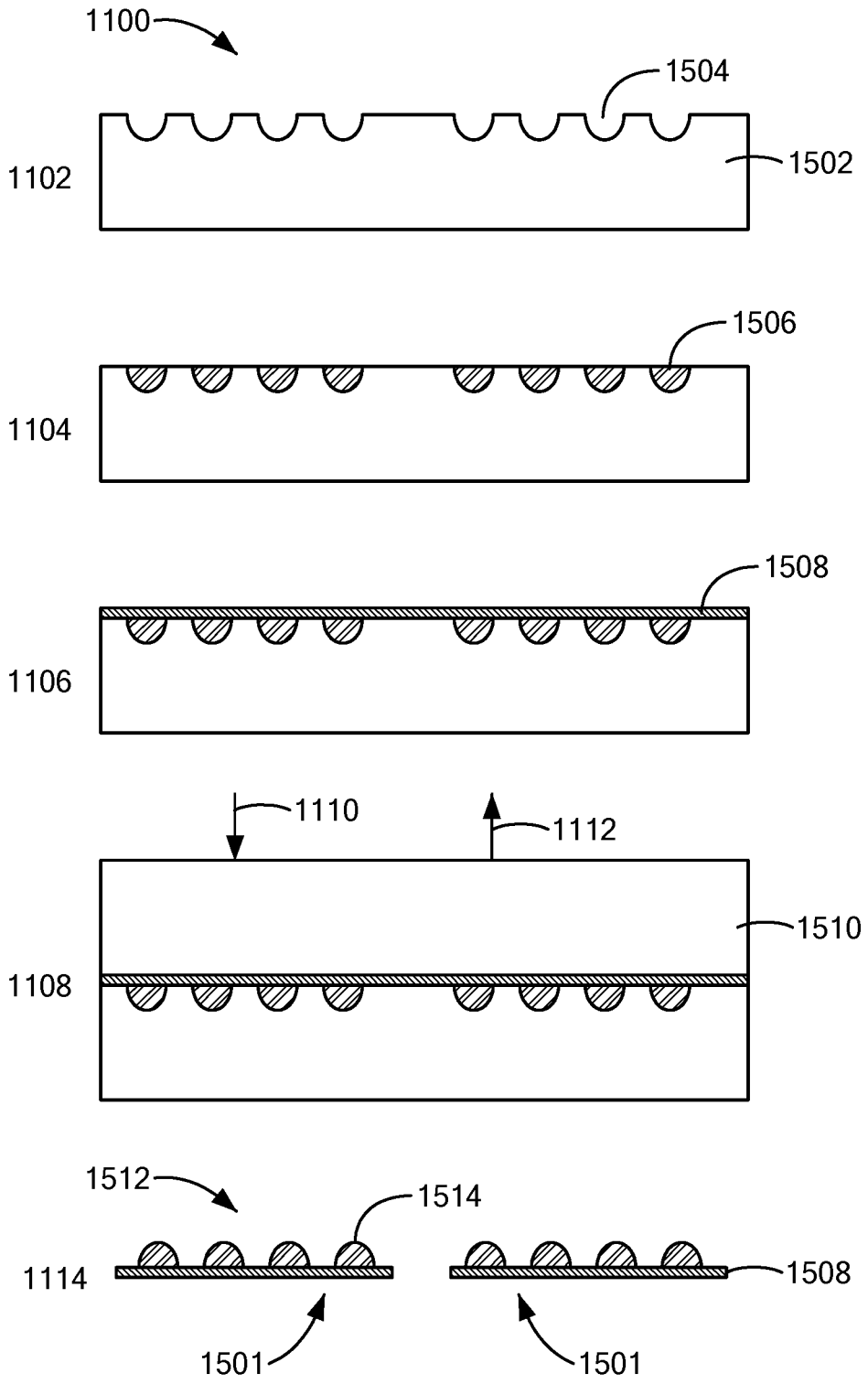
FIGS. 1A, 1B, and 1C depict in cross section side view a block diagram representation of alternative methods of making a Dk EM structure, in accordance with an embodiment.

Although the following detailed description contains many specifics for the purposes of illustration, anyone of ordinary skill in the art will appreciate that many variations and alterations to the following details are within the scope of the appended claims. Accordingly, the following example embodiments are set forth without any loss of generality to, and without imposing limitations upon, the claimed invention disclosed herein.

Example embodiments, as shown and described by the various figures and accompanying text, provide alternative Dk EM structures and methods of making the same, which include but are not limited to; molding, injection molding, compression molding, molding via a roll-to-roll mold drum, imprinting, stamping, embossing, stenciling, thermo-forming, photolithography, grayscale photolithography, or template filling. Such methods may be applied to fabricate single-layer or multi-layer Dk EM structures, where the Dk EM structures may be a single Dk EM structure, a plurality of Dk EM structures, a panel or array of Dk EM structures, or multiple panels or arrays of Dk EM structures. Embodiments of the Dk EM structures disclosed herein may be useful for applications involving, for example; an antenna; a dielectric resonator antenna, DRA; an array of antennas or DRAs; a dielectric lens; and/or a dielectric waveguide. While embodiments illustrated and described herein depict Dk EM structures having a particular cross-section profile (x-y, x-z, or y-z, cross-section profiles), it will be appreciated that such profiles may be modified without departing from a scope of the invention. As such, any profile that falls within the ambit of the disclosure herein, and is suitable for a purpose disclosed herein, is contemplated and considered to be complementary to the embodiments disclosed herein. While embodiments illustrated and described herein depict Dk EM array structures having or implied to have a specific array size, it will be appreciated that such sizes may be modified without departing from a scope of the invention. As such, any array size that falls within the ambit of the disclosure herein, and is suitable for a purpose disclosed herein, is contemplated and considered to be complementary to the embodiments disclosed herein.

While the following example embodiments are individually presented, it will be appreciated from a complete reading of all of the embodiments described herein below that similarities may exist among the individual embodiments that would enable some cross over of features and/or processes. As such, combinations of any of such individual features and/or processes may be employed in accordance with an embodiment, whether or not such combination is explicitly illustrated, while remaining consistent with the disclosure herein.

The several figures associated with one or more of the following example embodiments depict an orthogonal set of x-y-z axes that provide a frame of reference for the structural relationship of corresponding features with respect to each other, where an x-y plane coincides with a top-down plan view, and an x-z or y-z planes coincide with a side elevation view, of the corresponding embodiments.

While several of the figures provided herein depict side elevation views only of a Dk EM structure having a plurality of 1DPs and 2DPs, it will be appreciated from a reading of the entire disclosure provided herein that top-down plan views or rotated isometric views of other figures provided herein may be used as representative illustrations of an array configuration associated with the corresponding elevation views where the associated 1DPs and 2DPs of the corresponding elevation views are arranged in an array (see arrays depicted in FIGS. 1C, 4D, 6A, 8, and 9E, for example).

First Example Embodiment: Method 1100, Dk EM Structure 1500

Figure 1B:
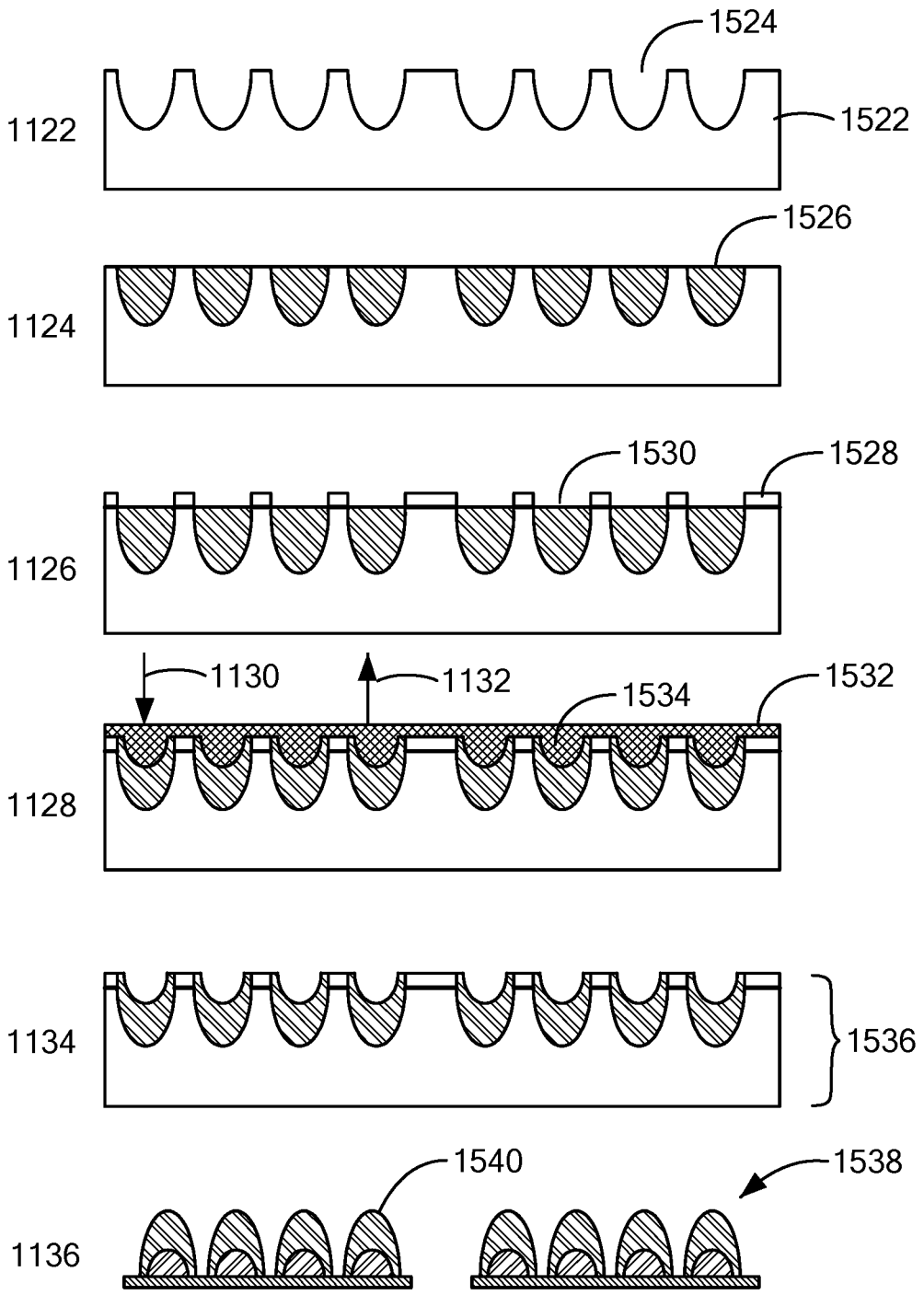
Figure 1C:
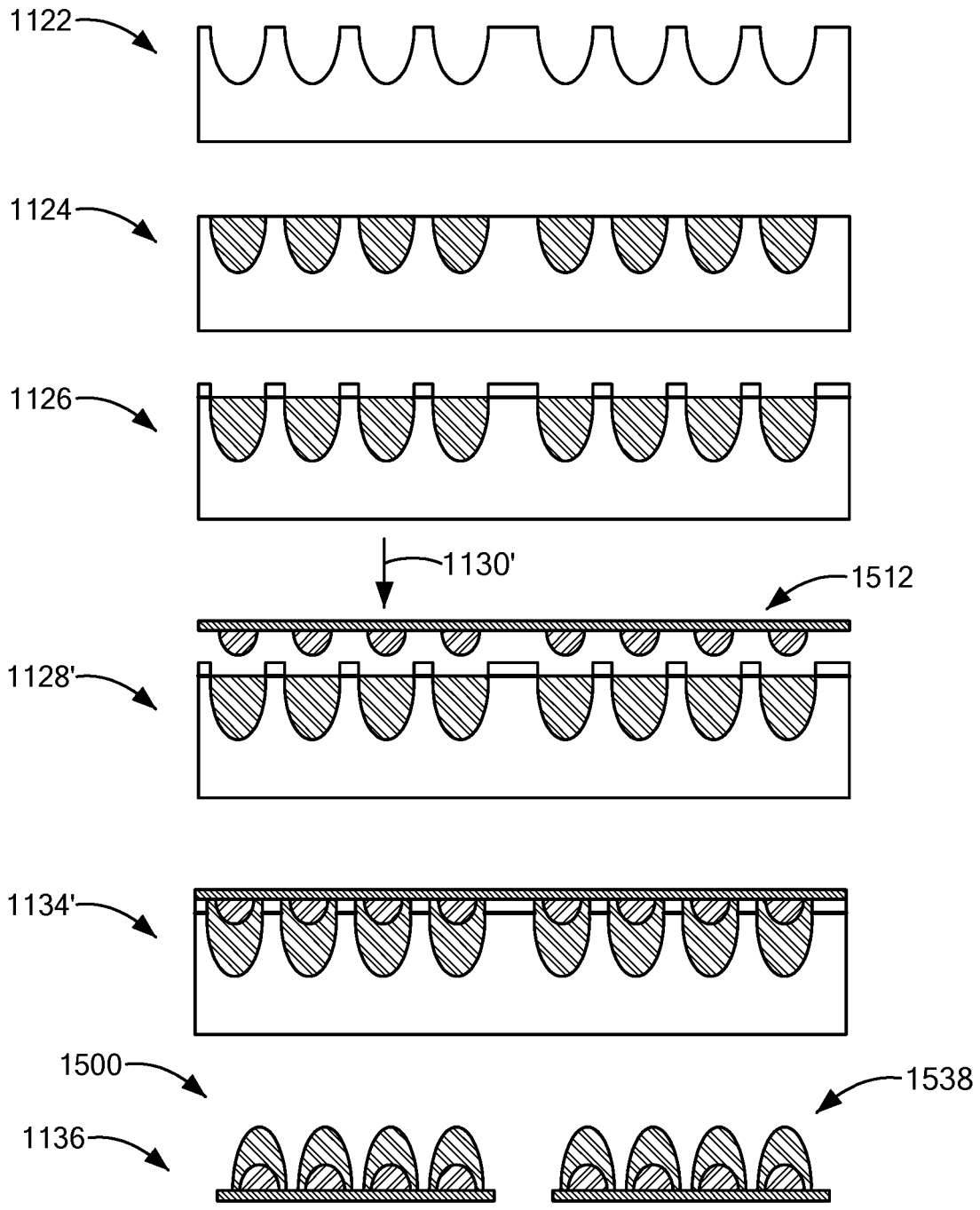
Figure 1D:
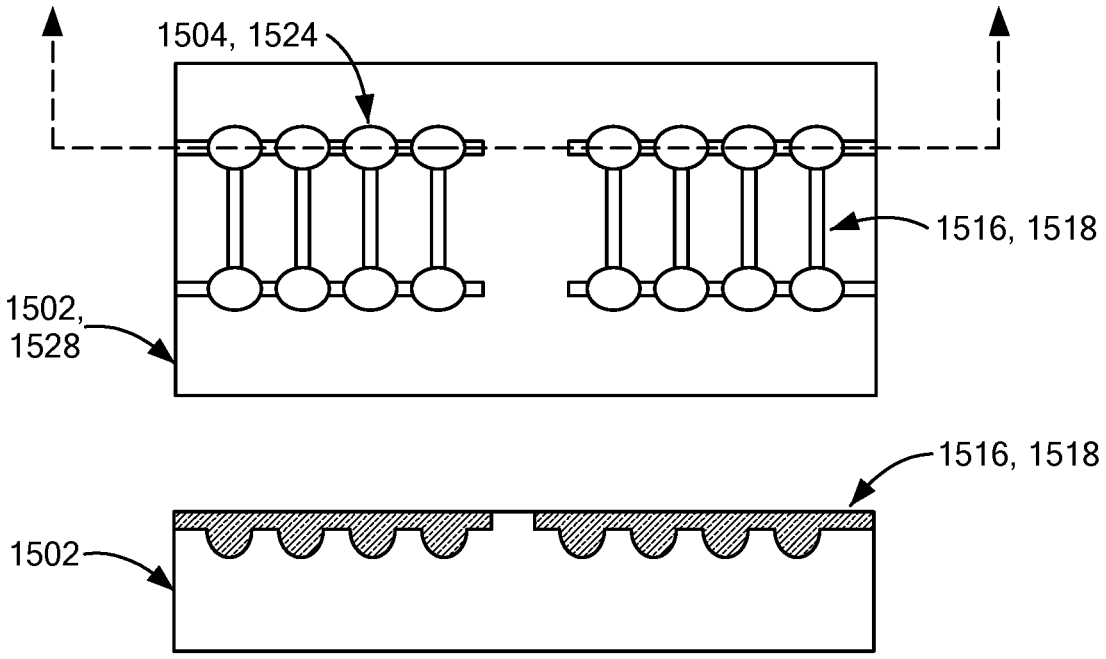
FIG. 1D depicts a cross section side view and a corresponding plan view of an alternative process step as that depicted in FIG. 1A, in accordance with an embodiment.

The following description of an example method 1100 for making a Dk EM structure 1500 is made with particular reference to FIGS. 1A, 1B, 1C and 1D, collectively, where FIG. 1A depicts method steps 1102, 1104, 1106, 1108, 1110, 1112, and 1114, and a corresponding resulting Dk EM structure 1500, FIG. 1B depicts method steps 1122, 1124, 1126, 1128, 1130, 1132, 1134, and 1136, and a corresponding resulting Dk EM structure 1500, FIG. 1C depicts method steps 1122, 1124, 1126, 1128', 1130', 1134', and 1136, and a corresponding resulting Dk EM structure 1500 alternate to that of FIG. 1B, and FIG. 1D depicts a cross section elevation view and corresponding plan view of an intermediate method step depicting relatively thin connecting channels 1516 and corresponding structures 1518.

In an embodiment and with particular reference to FIG. 1A, the example method 1100 of making the dielectric, Dk, electromagnetic, EM, structure 1500, includes the following steps: a step of providing 1102 a first mold portion 1502 having substantially identical ones of a first plurality of recesses 1504 arranged in an array; a step of filling 1104 the first plurality of recesses 1504 with a curable first Dk composition 1506 having a first average dielectric constant greater than that of air after full cure; a step of placing 1106 a substrate 1508 on top of and across multiple ones of the first plurality of recesses 1504 filled with the first Dk composition 1506, and at least partially curing the curable first Dk composition; an optional step of placing 1108 a second mold portion 1510 on top of the substrate 1508; another optional step of pressing 1110 the second mold portion 1510 toward the first mold portion 1502 and further at least partially curing the curable first Dk composition 1506; another optional step of separating 1112 the second mold portion 1510 relative to the first mold portion 1502; and a step of removing 1114 the substrate 1508 with the at least partially cured first Dk composition 1506 from the first mold portion 1502, resulting in an assembly 1512 having the substrate 1508 and a plurality of Dk forms 1514 having the at least partially cured first Dk composition 1506, each of the plurality of Dk forms 1514 having a three dimensional, 3D, shape defined by corresponding ones of the first plurality of recesses 1504.

As used herein, the term substantially is intended to account for manufacturing tolerances. As such, substantially identical structures are identical if the manufacturing tolerances for producing the corresponding structures are zero.

In an embodiment, the substrate 1508 may include one or more of the following: a Dk layer; a metal layer; a combination of a Dk layer and a metal layer; a metal layer having a plurality of slots, each one of the plurality of slots disposed in a one-to-one correspondence with a filled recess of the plurality of filled recesses; a printed circuit board; a flexible circuit board; or, a substrate integrated waveguide, SIW; or, an EM signal feed network.

In an embodiment and with particular reference to FIG. 1B, the method 1100 further includes the following steps: prior to the step of providing 1102 the first mold portion 1502, including a step of providing 1122 a first pre-mold portion 1522 having substantially identical ones of a second plurality of recesses 1524 arranged in the array of the first mold portion 1502, each one of the second plurality of recesses 1524 being larger than a corresponding one of the first plurality of recesses 1504; a step of filling 1124 the second plurality of recesses 1524 with a curable second Dk composition 1526 having a second average dielectric constant that is less than the first average dielectric constant and greater than that of air after full cure; a step of placing 1126 a second pre-mold portion 1528 on top of the first pre-mold portion 1522, the second pre-mold portion 1528 having a plurality of openings 1530 arranged in the array of the first mold portion 1502 and in a one-to-one correspondence with each one of the second plurality of recesses 1524; a step of placing 1128 a third pre-mold portion 1532 on top of the second pre-mold portion 1528, the third pre-mold portion 1532 having a plurality of substantially identical ones of projections 1534 arranged in the array of the first mold portion 1502, the substantially identical ones of the projections 1534 being inserted into corresponding ones of the openings 1530 of the second pre-mold portion 1528, and into corresponding ones of the second plurality of recesses 1524, thereby displacing the second Dk material 1526 in each one of the second plurality of recesses 1524 by a volume equal to the volume of a given projection 1534; a step of pressing 1130 the third pre-mold portion 1532 toward the second pre-mold portion 1528 and at least partially curing the curable second Dk composition 1526; and a step of separating 1132 the third pre-mold portion 1532 relative to the second pre-mold portion 1528 to yield 1134 a mold form 1536 having the at least partially cured second Dk composition 1526 therein that serves to provide the first mold portion 1502, and establishes the step of providing 1102 a first mold portion 1502, 1536 having substantially identical ones of a first plurality of recesses 1504 arranged in an array; wherein the aforementioned step of removing 1114 includes the step of removing 1136 the substrate 1508 with the at least partially cured first Dk composition 1506 and the at least partially cured second Dk composition 1526 from the first mold portion 1502, 1536, resulting in the assembly 1538 comprising the substrate 1508 and the plurality of Dk forms 1540 that includes the array of the at least partially cured first Dk composition 1506 and the corresponding array of the at least partially cured second Dk composition 1526, each of the plurality of Dk forms 1540 having a 3D shape defined by corresponding ones of the first plurality of recesses 1504 and the second plurality of recesses 1524.

In an embodiment and with particular reference to FIG. 1C in combination with FIG. 1B, it will be appreciated that the steps associated with reference numbers 1128, 1130, 1132, and 1134, of FIG. 1B may be replaced with the steps associated with reference numerals 1128', 1130', and 1134', of FIG. 1C, with all other steps and corresponding structure remaining essentially the same. As depicted in FIG. 1C, the step of placing 1128 from FIG. 1B may be replaced with a step of placing 1128' the above noted assembly 1512, having the substrate 1508 and plurality of Dk forms 1514 with the at least partially cured first Dk composition 1506 formed thereon, on top of the second pre-mold portion 1528 (see FIG. 1), the assembly 1512 having the plurality of Dk forms 1514 that are inserted into corresponding ones of the openings 1530 of the second pre-mold portion 1528, and into corresponding ones of the second plurality of recesses 1524, thereby displacing the second Dk material 1526 in each one of the second plurality of recesses 1524 by a volume equal to the volume of a given Dk form 1514. Also, the step of pressing 1130 from FIG. 1B may be replaced with the step of pressing 1130' the assembly 1512 toward the second pre-mold portion 1528 and at least partially curing the curable second Dk composition 1526. Furthermore, the step of separating 1132 from FIG. 1B may be omitted, and the step of yielding 1134 from FIG. 1B may be replaced with the step of yielding 1134' a mold form 1536 having the assembly 1512 and the at least partially cured second Dk composition 1526 therein. And furthermore, the aforementioned step of removing 1114 includes the step of removing 1136 the substrate 1508 with the at least partially cured first Dk composition 1506 and the at least partially cured second Dk composition 1526 from the first mold portion 1502, 1536, resulting in the assembly 1538 comprising the substrate 1508 and the plurality of Dk forms 1540 that includes the array of the at least partially cured first Dk composition 1506 and the corresponding array of the at least partially cured second Dk composition 1526, each of the plurality of Dk forms 1540 having a 3D shape defined by corresponding ones of the first plurality of recesses 1504 and the second plurality of recesses 1524.

In an embodiment, the plurality of Dk forms 1514 provide a plurality of dielectric resonator antennas, DRAs, disposed on the substrate 1508, wherein each DRA is a single-layer DRA having a volume or layer of Dk material provided by the first Dk composition 1506.

In an embodiment, the plurality of Dk forms 1540 provide a plurality of dielectric resonator antennas, DRAs, disposed on the substrate 1508, wherein each DRA is a two-layer DRA having a first inner volume or layer of Dk material provided by the first Dk composition 1506, and a second outer volume or layer of Dk material provided by the second Dk composition 1526.

In an embodiment, the plurality of Dk forms 1540 provide a plurality of dielectric resonator antennas, DRAs, 1506 disposed on the substrate 1508, and a plurality of dielectric lenses or dielectric waveguides 1526 disposed in one-to-one correspondence with the plurality of DRAs, wherein each DRA is a single-volume or single-layer DRA having a volume or layer of Dk material provided by the first Dk composition 1506, and each corresponding lens or waveguide is a single-volume or single-layer structure having a volume or layer of Dk material provided by the second Dk composition 1526.

In an embodiment and with particular reference to FIG. 1C in combination with FIG. 1A, the first mold portion 1502 includes a plurality of relatively thin connecting channels 1516 that interconnect adjacent ones of the first plurality of recesses 1504, which are filled during the step of filling 1104 the first plurality of recesses with the curable first Dk composition 1506 having the first average dielectric constant, thereby resulting in the assembly 1512 that includes the substrate 1508 and the plurality of Dk forms 1514, along with a plurality of relatively thin connecting structures 1518 interconnecting adjacent ones of the plurality of Dk forms 1514, the relatively thin connecting structures 1518 being composed of the at least partially cured first Dk composition 1506, the relatively thin connecting structures 1518 and the filled first plurality of recesses having the first Dk composition 1506 forming a single monolithic.

In an embodiment and with particular reference to FIG. 1C in combination with FIG. 1B, the second pre-mold portion 1528 includes a plurality of relatively thin connecting channels 1516 that interconnect adjacent ones of the second plurality of recesses 1524, which are filled during the aforementioned process of displacing the second Dk material 1526 in each one of the second plurality of recesses 1524 by a volume equal to the volume of a given projection 1534, thereby resulting in the assembly 1538 having the substrate 1508 and the plurality of Dk forms 1540, along with a plurality of relatively thin connecting structures 1518 interconnecting adjacent ones of the plurality of Dk forms 1540, the relatively thin connecting structures 1518 being composed of the at least partially cured second Dk composition 1526, the relatively thin connecting structures 1518 and the filled second plurality of recesses having the second Dk composition 1526 forming a single monolithic.

In an embodiment, the step of filling the first plurality of recesses 1104, filling the second plurality of recesses 1124, or filling of both the first and the second plurality of recesses further includes: pouring and squeegeeing a flowable form of the respective curable Dk composition into the corresponding recesses.

In an embodiment, the step of filling the first plurality of recesses 1104, filling the second plurality of recesses 1124, or filling of both the first and the second plurality of recesses further includes: imprinting a flowable dielectric film of the respective curable Dk composition into the corresponding recesses.

In an embodiment, the step of pressing and at least partially curing 1110 the curable first Dk composition 1506, pressing and at least partially curing 1130 the curable second Dk composition 1526, or pressing and at least partially curing of both the curable first Dk composition and the curable second Dk composition, includes: curing the respective curable Dk composition at a temperature equal to or greater than about 170 degree Celsius for a time duration equal to or greater than about 1 hour.

In an embodiment of the method 1100, the first average dielectric constant is equal to or greater than 5, alternatively equal to or greater than 9, further alternatively equal to or greater than 18, and equal to or less than 100.

In an embodiment of the method 1100, the curable first Dk composition 1506 includes a curable resin, preferably wherein the curable resin includes a Dk material.

In an embodiment of the method 1100, the curable first Dk composition 1506 further includes an inorganic particulate material, preferably wherein the inorganic particulate material includes titanium dioxide.

Figure 16A:
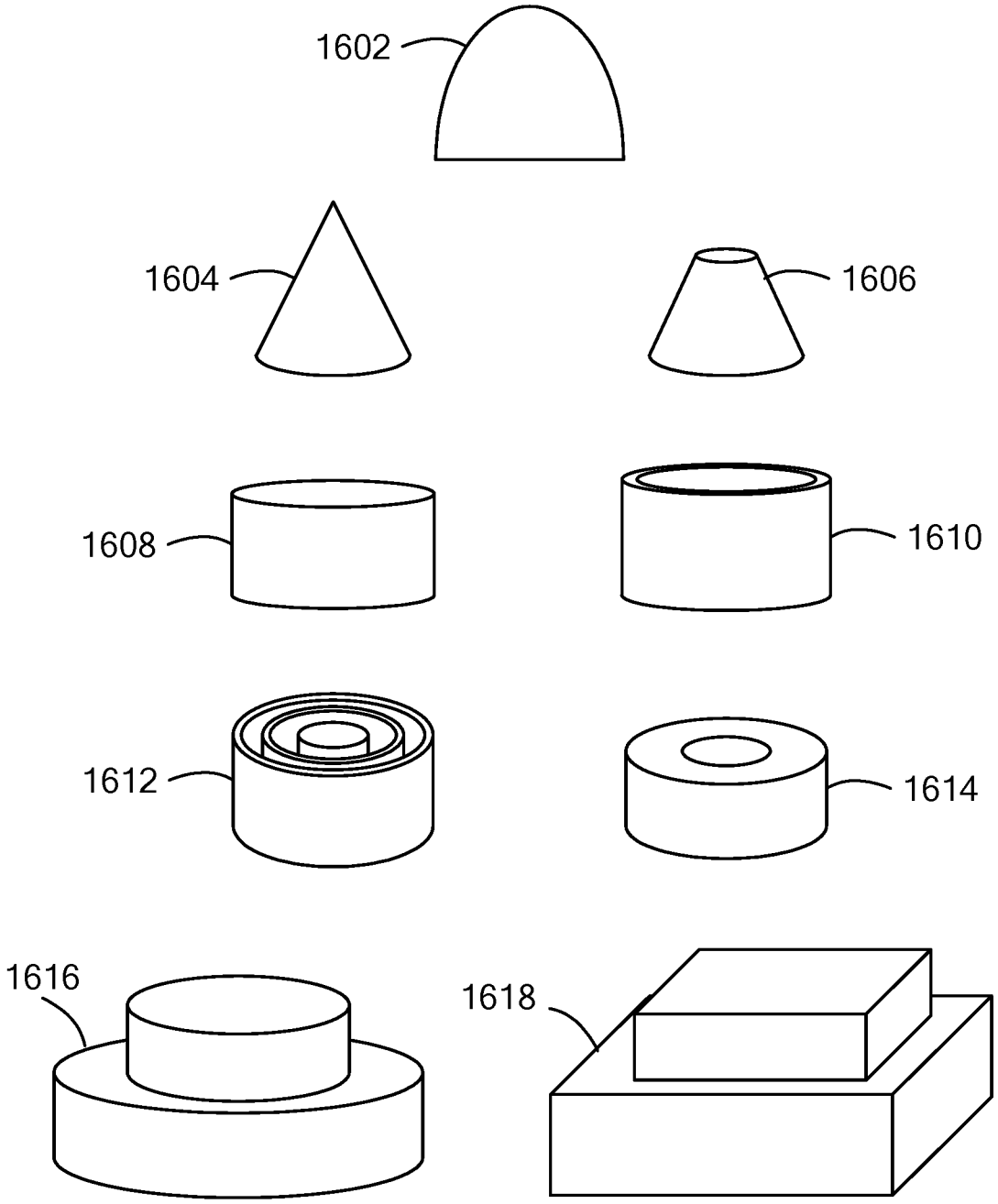
FIGS. 16A and 16B depict alternative three-dimensional, 3D, and two-dimensional, 2D, shapes, respectively, for use in accordance with an embodiment.
Figure 16B:
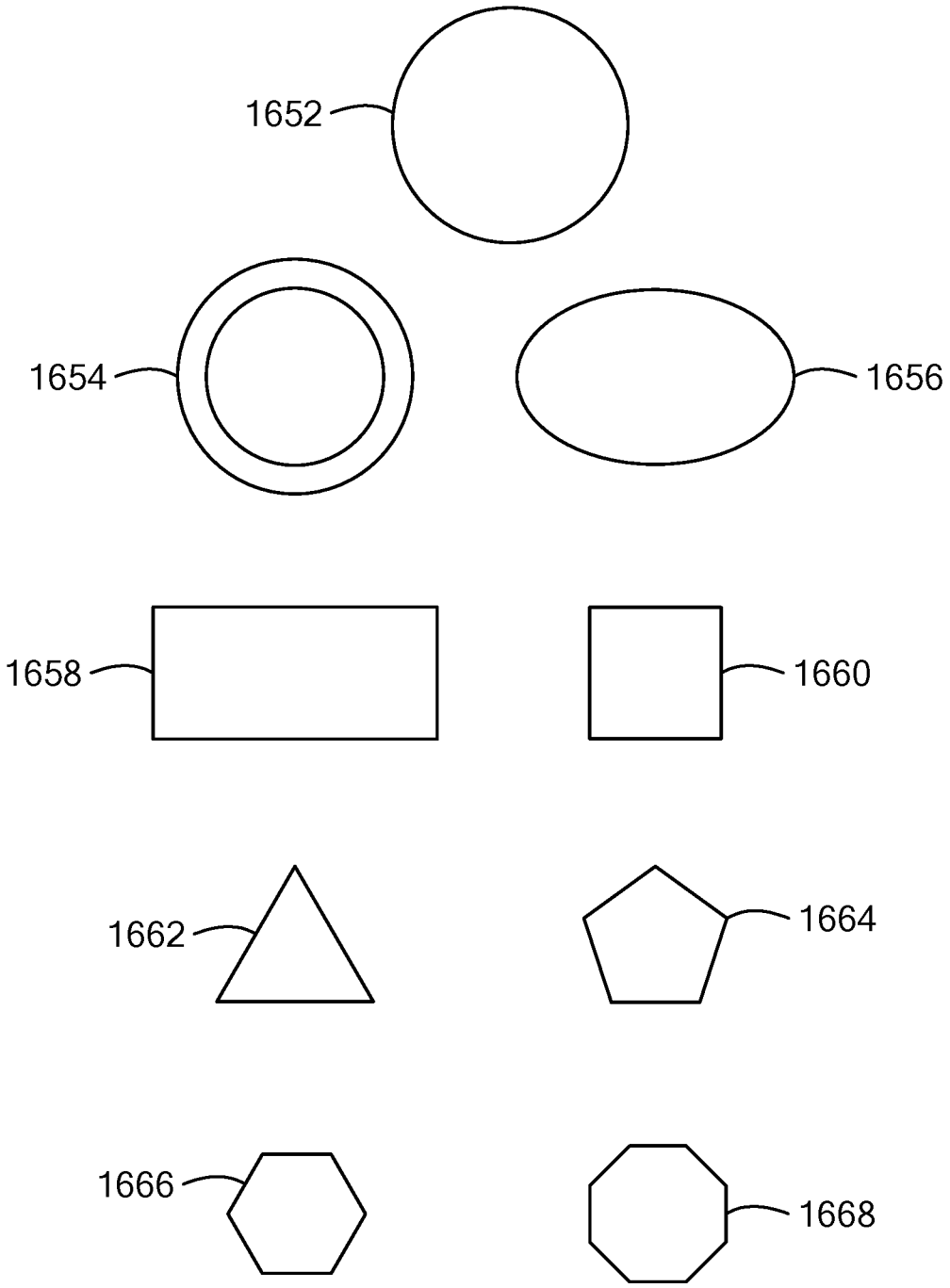

In an embodiment of the method 1100, the 3D shape of a given Dk form 1514, 1540 has an outer cross-section shape, as observed in an x-y plane cross-section, that is circular (see FIG. 16B, for example, and for other example shapes contemplated herein).

In any embodiment disclosed herein the substrate may be a wafer such as a silicon wafer for example, or any other electronic substrate suitable for a purpose disclosed herein.

Second Example Embodiment: Method 2100, Dk EM Structure 2500

Figure 2A:
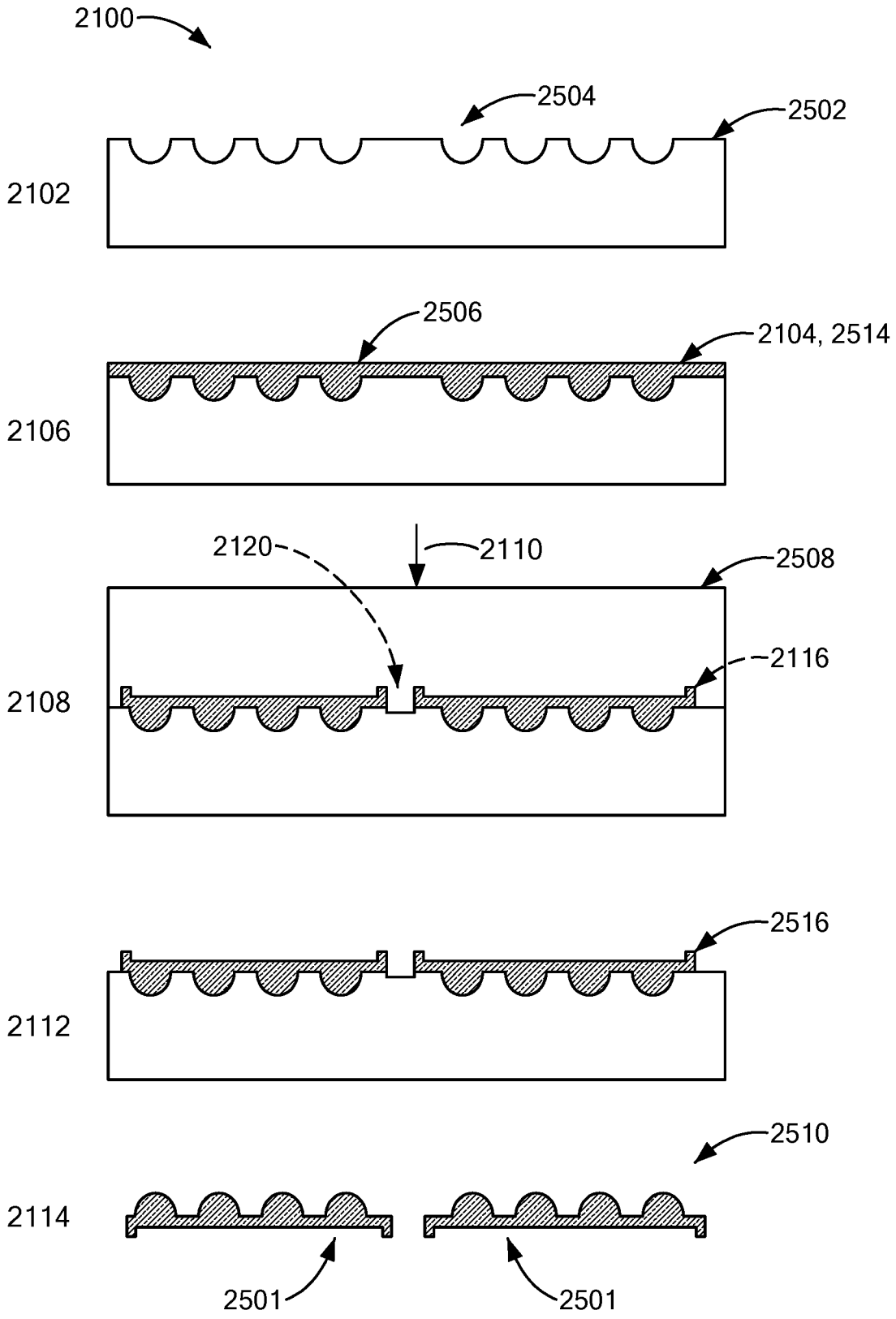
FIGS. 2A, 2B, and 2C depict in cross section side view a block diagram representation of other alternative methods of making a Dk EM structure, in accordance with an embodiment.
Figure 2B:
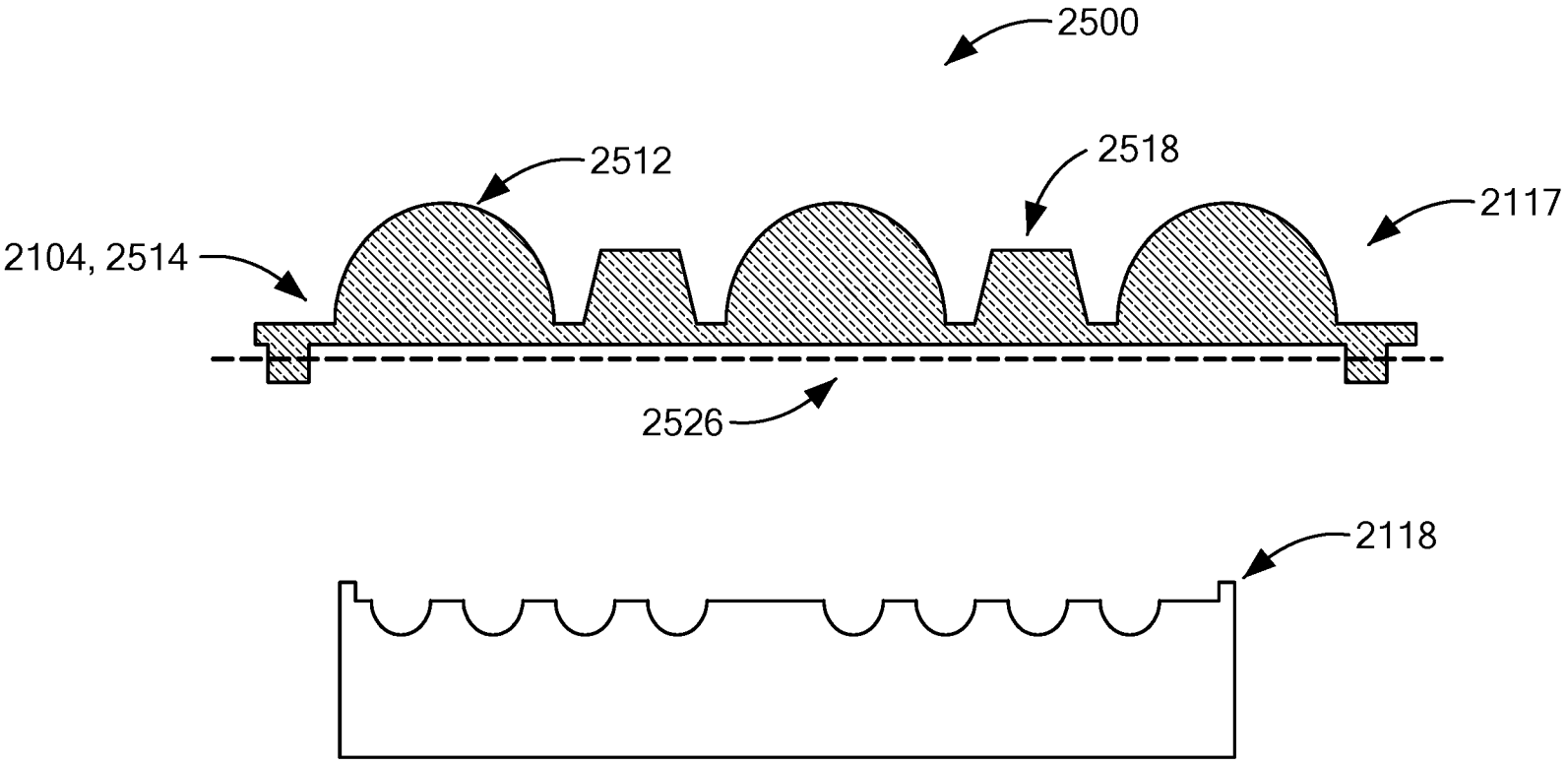
Figure 2C:
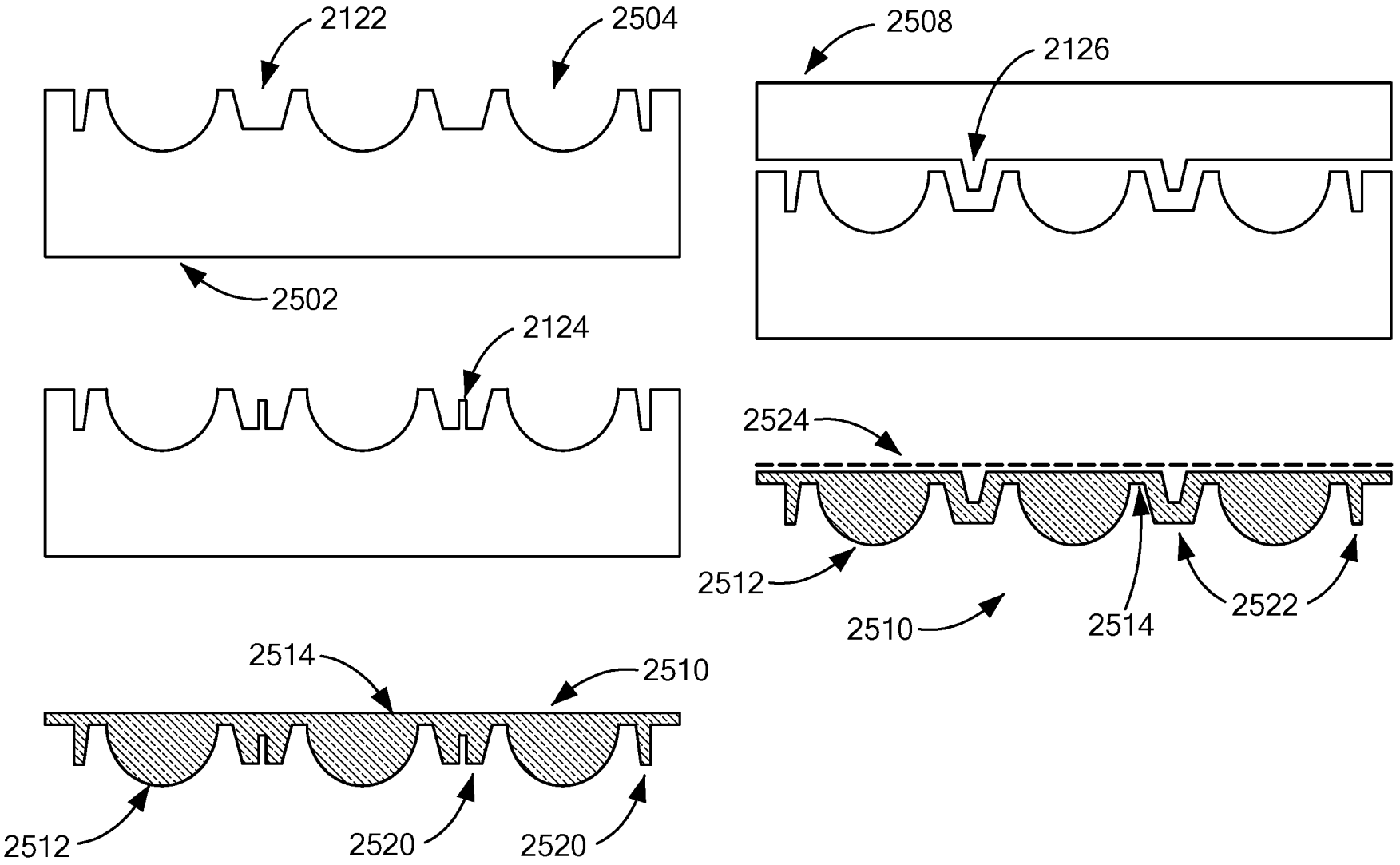

The following description of an example method 2100 for making a Dk EM structure 2500 is made with particular reference to FIGS. 2A, 2B, and 2C, collectively, where FIG. 2A depicts method steps 2102, 2106, 2108, 2110, 2112, and 2114, and a resulting array 2501 of the Dk EM structure 2500, FIG. 2B depicts method step 2117, and a resulting Dk EM structure 2500.

In an embodiment and with particular reference to FIG. 2A, the example method 2100 of making the Dk EM structure 2500, having one or more of a first dielectric portion, 1DP, 2512 includes the following steps: a step of providing 2102 a first mold portion 2502 having substantially identical ones of a first plurality of recesses 2504 arranged in an array and configured to form a plurality of the 1DP 2512, the first mold portion 2502 further having a plurality of relatively thin connecting channels 2104 that interconnect adjacent ones of the plurality of recesses 2504; a step of filling 2106 the first plurality of recesses 2504 and the relatively thin connecting channels 2104 with a curable Dk composition 2506 having an average dielectric constant greater than that of air after full cure; a step of placing 2108 a second mold portion 2508 on top of the first mold portion 2502 with the curable Dk composition 2506 disposed therebetween; a step of pressing 2110 the second mold portion 2508 toward the first mold portion 2502 and at least partially curing the curable Dk composition 2506; a step of separating 2112 the second mold portion 2508 relative to the first mold portion 2502; and, a step of removing 2114 the at least partially cured Dk composition 2506 from the first mold portion 2502, resulting in at least one Dk form 2510 having the at least partially cured Dk composition 2506, each of the at least one Dk form 2510 having a three dimensional, 3D, shape defined by the first plurality of recesses 2504 and the interconnecting plurality of relatively thin connecting channels 2104, the 3D shape defined by the first plurality of recesses 2504 providing the EM structure 2500 having a plurality of the 1DP 2512 interconnected via a relatively thin connecting structure 2514 formed via filled channels of the interconnecting plurality of relatively thin connecting channels 2104.

In an embodiment and with particular reference still to FIG. 2A, the second mold portion 2508 includes at least one recess 2116 disposed for providing an alignment feature 2516 to the at least one Dk form 2510, wherein the step of pressing 2110 the second mold portion 2508 toward the first mold portion 2502 further includes: displacing a portion of the curable Dk composition 2506 into the at least one recess 2116.

In an embodiment and with particular reference to FIG. 2B in combination with FIG. 2A, the first mold portion 2502 further includes at least one first projection 2118 disposed for providing an alignment feature (not specifically shown, but would be understood by one skilled in the art to be an opening in the connecting structure 2514 formed by the projection 2118) to the at least one Dk form 2510, wherein the step of pressing 2110 the second mold portion 2508 toward the first mold portion 2502 further includes: displacing a portion of the curable Dk composition 2506 around the at least one first projection 2118.

In an embodiment and with particular reference to FIG. 2A, at least one of the first mold portion 2502 and the second mold portion 2508 includes a segmenting projection 2120 around a subset of the plurality of recess 2504 for providing segmented sets of panels in a form of the array 2501, wherein the step of pressing 2110 the second mold portion 2508 toward the first mold portion 2502 further includes: displacing a portion of the curable Dk composition 2506 away from a face to face contact between the first mold portion 2502 and the second mold portion 2508 proximate the segmenting projection 2120.

In an embodiment and with particular reference to FIG. 2C in combination with FIGS. 2A and 2B, the first mold portion 2502 further comprises a second plurality of recesses 2122, each one of the second plurality of recesses 2122 being disposed in a one-to-one correspondence with one of the first plurality of recesses 2504 and substantially surrounding the corresponding one of the first plurality of recesses 2504, as observed in a top-down plan view of the first mold portion 2502, for providing at least one Dk isolator 2518 (see FIG. 2B) for a given 1DP 2512 in the at least one Dk form 2510. In an embodiment, the Dk isolator 2518 forms a continuous ring of the Dk composition 2506 around a corresponding one of the 1DP 2512. In an embodiment, the Dk form 2510 is a monolithic of the Dk composition 2506 that includes an integrally formed arrangement of a plurality of the 1DP 2512, the relatively thin connecting structure 2514, and the at least one Dk isolator 2518.

In an embodiment and with particular reference still to FIG. 2C in combination with FIGS. 2A and 2B, the first mold portion 2502 further includes a plurality of second projections 2124 disposed in a one-to-one correspondence with one of the second plurality of recesses 2122, each second projection 2124 being centrally disposed within the corresponding one of the second plurality of recesses 2122 and substantially surrounding the corresponding one of the first plurality of recesses 2504 for providing a corresponding enhanced Dk isolator 2520 for a given 1DP 2512 in the at least one Dk form 2510. In an embodiment, the enhanced Dk isolator 2520 forms a continuous ring of the Dk composition 2506 around a corresponding one of the 1DP 2512. In an embodiment, the Dk form 2510 is a monolithic of the Dk composition 2506 that includes an integrally formed arrangement of a plurality of the 1DP 2512, the relatively thin connecting structure 2514, and the corresponding enhanced Dk isolator 2520.

In an embodiment and with particular reference still to FIG. 2C in combination with FIGS. 2A and 2B, the second mold portion 2508 further includes a plurality of third projections 2126 disposed in a one-to-one correspondence with one of the second plurality of recesses 2122 of the first mold portion 2502, each third projection 2126 being centrally disposed within the corresponding one of the second plurality of recesses 2122 of the first mold portion 2502 and substantially surrounding the corresponding one of the first plurality of recesses 2504 of the first mold portion 2502 for providing an enhanced Dk isolator 2522 for a given 1DP 2512 in the at least one Dk form 2510. In an embodiment, the enhanced Dk isolator 2522 forms a continuous ring of the Dk composition 2506 around a corresponding one of the 1DP 2512. In an embodiment, the Dk form 2510 is a monolithic of the Dk composition 2506 that includes an integrally formed arrangement of a plurality of the 1DP 2512, the relatively thin connecting structure 2514, and the corresponding enhanced Dk isolator 2522.

In an embodiment, the step 2110 that includes at least partially curing the curable first Dk composition 2506 includes: heating the curable Dk composition 2506 at a temperature equal to or greater than about 170 degree Celsius for a time duration of equal to or greater than about 1 hour.

In an embodiment, the method 2100 further includes subsequent to the step of removing 2114 the at least partially cured Dk composition 2506 from the first mold portion 2502: fully curing the at least one Dk form 2510, and applying an adhesive 2524 to the back of the at least one Dk form 2510.

In an embodiment, the average dielectric constant of the curable Dk composition 2506 is equal to or greater than 5, alternatively equal to or greater than 9, further alternatively equal to or greater than 18, and equal to or less than 100.

In an embodiment of the method 2100, the curable first Dk composition 2506 includes a curable resin, preferably wherein the curable resin includes a Dk material.

In an embodiment, the curable first Dk composition 2506 further includes an inorganic particulate material, preferably wherein the inorganic particulate material includes titanium dioxide.

In an embodiment of the method 2100, each 1DP of the plurality of the 1DP 2512 has an outer cross-section shape, as observed in an x-y plane cross-section, that is circular (see FIG. 16B, for example, and for other example shapes contemplated herein).

In an embodiment and with particular reference to FIG. 2B in combination with FIG. 2A, the method 2100 further includes: providing a substrate 2526 and placing 2117 the at least one Dk form 2510 onto the substrate 2526.

In an embodiment, the substrate 2526 may include one or more of the following: a Dk layer; a metal layer; a combination of a Dk layer and a metal layer; a metal layer having a plurality of slots, each one of the plurality of slots disposed in a one-to-one correspondence with a filled recess of the plurality of filled recesses; a printed circuit board; a flexible circuit board; or, a substrate integrated waveguide, SIW; or, an EM signal feed network.

In an embodiment, the process of placing the at least one Dk form 2510 onto the substrate 2526 further includes: aligning the alignment feature 2516 with a corresponding reception feature (depicted general by an opening in the dashed line of the illustrated substrate 2526) on the substrate 2526 and adhering via adhesive 2524 the at least one Dk form 2510 to the substrate 2526.

Third Example Embodiment: Method 3100, Dk EM Structure 3500

Figure 3A:
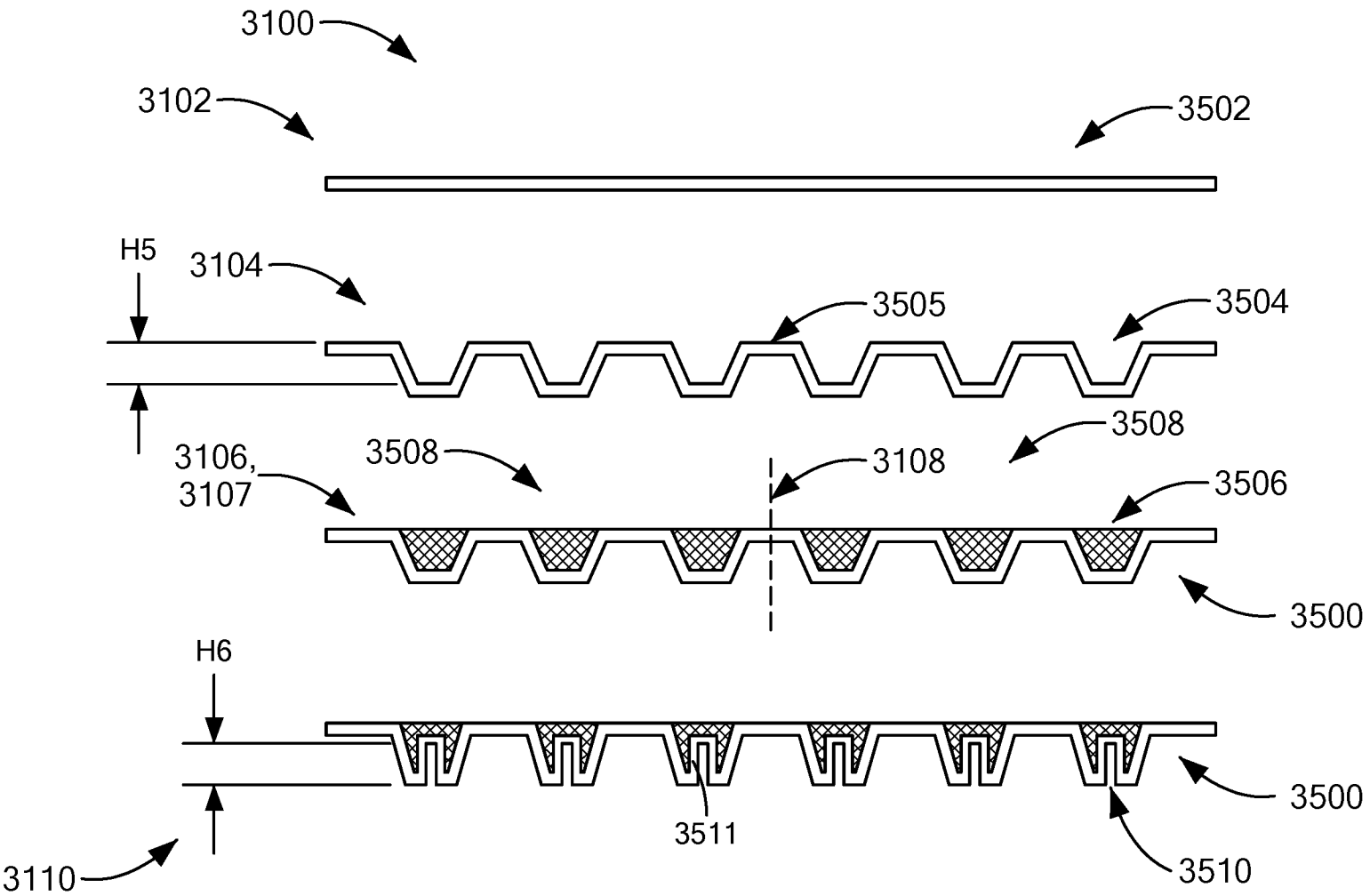
FIG. 3A depicts in cross section side view a block diagram representation of another alternative method of making a Dk EM structure, in accordance with an embodiment.
Figure 3B:
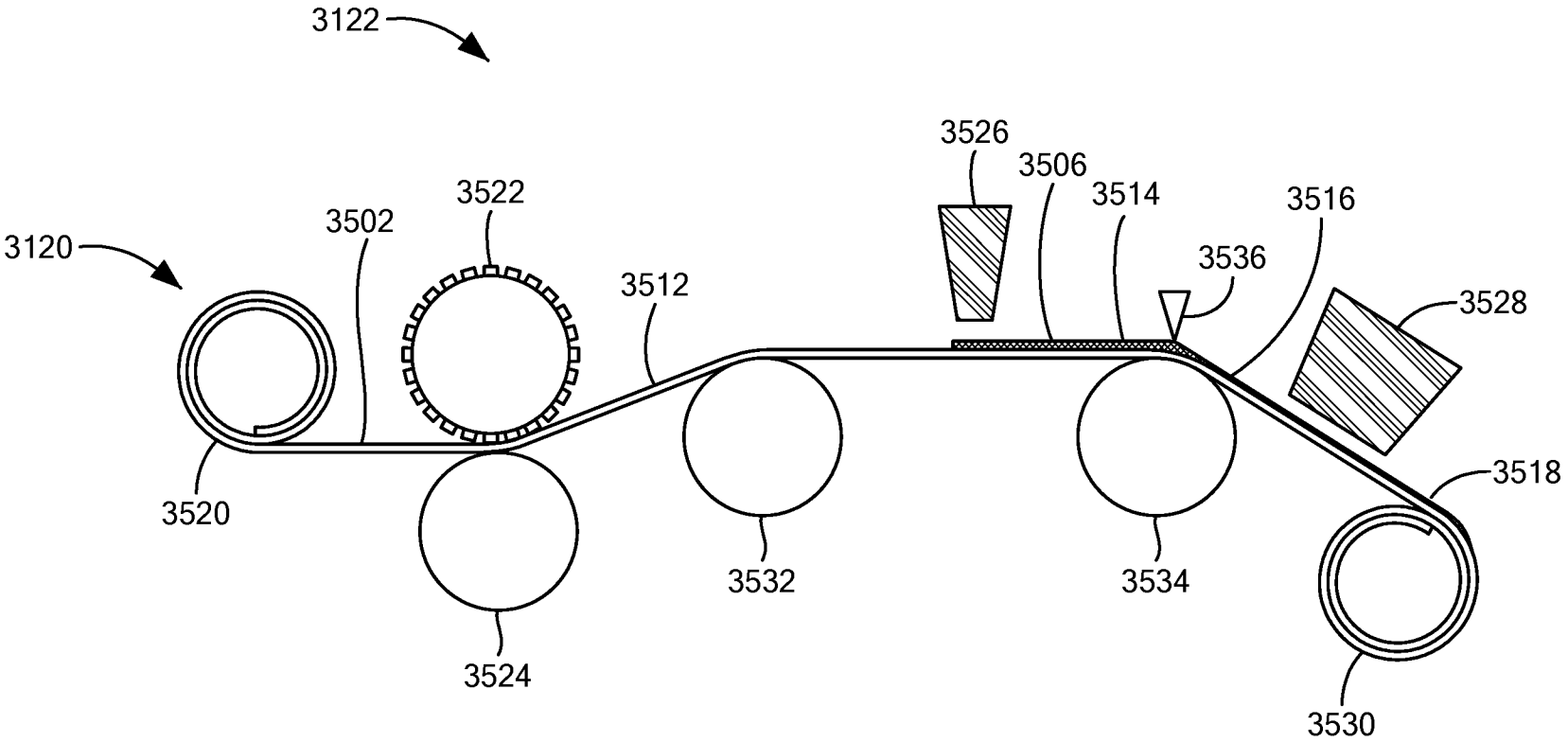
FIG. 3B depicts in cross section side view a schematic diagram representation of a manufacturing method of making the Dk EM structure of FIG. 3A, in accordance with an embodiment.

The following description of an example method 3100 for making a Dk EM structure 3500 is made with particular reference to FIGS. 3A and 3B, collectively, where FIG. 3A depicts method steps 3102, 3104, 3106, 3107, 3108, and 3110, and a resulting Dk EM structure 3500 in a cross section elevation view through a center of corresponding ones of a plurality of recesses 3504, and FIG. 3B depicts a fabrication process including the method steps 3120 and 3122.

In an embodiment and with particular reference to FIG. 3A, the example method 3100 of making the Dk EM structure 3500, includes the following steps: a step of providing 3102 a sheet of Dk material 3502; a step of forming 3104 in the sheet of Dk material 3502 substantially identical ones of a plurality of recesses 3504 arranged in an array, with the non-recessed portions of the sheet of Dk material 3502 forming a connecting structure 3505 disposed between individual ones of the plurality of recesses 3504, in an embodiment each recess of the plurality of recesses 3504 is a pocket recess with surrounding walls; a step of filling 3106 the plurality of recesses 3504 with a curable Dk composition 3506 having a first average dielectric constant greater than that of air after full cure, wherein the sheet of Dk material 3502 has a second average dielectric constant that is different from the first average dielectric constant; and, a step of at least partially curing 3107 the curable Dk composition 3506.

In an embodiment of the method 3100, the second average dielectric constant is less than the first average dielectric constant.

In an embodiment and with particular reference still to FIG. 3A, the method 3100 further includes: subsequent to the step of at least partially curing the curable Dk composition 3107, a step of cutting 3108 the sheet of Dk material 3502 into individual tiles 3508, each tile 3508 having an array of a subset of the plurality of recesses 3504 having therein the at least partially cured Dk composition 3506, with a portion of the connecting structure 3505 disposed therebetween.

In an embodiment, the step of forming 3104 includes: stamping or imprinting the plurality of recesses 3504 in a top-down manner.

In an embodiment, the step of forming 3104 includes: embossing the plurality of recesses 3504 in a bottom-up manner.

In an embodiment, the step of filling 3106 includes: pouring and squeegeeing a flowable form of the curable Dk composition 3506 into the plurality of recesses 3504.

In an embodiment, the step of forming 3104 further includes, from a first side of the sheet of Dk material 3502, forming in the sheet 3502 the substantially identical ones of the plurality of recesses 3504, each of the plurality of recesses 3504 having a depth, H5, and further including: from a second opposing side of the sheet 3502, a step of forming 3110 a plurality of depressions 3510 in a one-to-one correspondence with the plurality of recesses 3504, each of the plurality of depressions 3510 having a depth, H6, wherein H6 is equal to or less than H5.

In an embodiment, each of the plurality of recesses 3504 is a pocket recess, and each of the plurality of depressions 3510 forms a blind pocket with a surrounding side wall 3511 in each corresponding one of the plurality of recesses 3504, such that the Dk composition 3506 within each pocket recess 3504 surrounds a corresponding centrally disposed depression 3510.

In an embodiment, each of the plurality of depressions 3510 is centrally disposed with respect to a corresponding one of the plurality of recesses 3504.

In an embodiment, the step of at least partially curing 3107 the curable Dk composition 3506 includes: curing the Dk composition 3506 at a temperature equal to or greater than about 170 degree Celsius for a time duration equal to or greater than about 1 hour.

In an embodiment, the step of providing 3102 includes providing the sheet of Dk material 3502 in a flat form; and the step of filling 3106 includes filling the plurality of recesses 3504 of the flat form sheet one or more than one recess 3504 at a time.

In an embodiment and with particular reference to FIG. 3B in combination with FIG. 3A, the step of providing 3102 includes providing 3120 the sheet of Dk material 3502 on a roll 3520 and unrolling 3122 the sheet of Dk material 3502 for the subsequent step of forming 3104.

In an embodiment and with particular reference also to FIG. 3B in combination with FIG. 3A, the method 3100 further includes the following steps: a step of providing a pattern roller 3522 and an opposing compression roller 3524 downstream of the roll 3520 of Dk material 3502; a step of providing a dispenser unit 3526 of the Dk composition 3506 downstream of the pattern roll 3522; a step of providing a curing unit 3528 downstream of the dispenser unit 3526; and, a step of providing a finish roller 3530 downstream of the curing unit 3528.

In an embodiment and with particular reference still to FIG. 3B in combination with FIG. 3A, the method 3100 further includes the following steps: a step of providing a first tensioning roller 3532 downstream of the pattern roller 3522 and upstream of the dispenser unit 3526; and, a step of providing a second tensioning roller 3534 downstream of the first tensioning roller 3532 and upstream of the curing unit 3528.

In an embodiment and with particular reference still to FIG. 3B in combination with FIG. 3A, the method 3100 further includes the following steps: a step of providing a squeegee unit 3536 disposed to cooperate with and opposing the second tensioning roller 3534.

In an embodiment and with particular reference still to FIG. 3B in combination with FIG. 3A, the method 3100 further includes the following steps: a step of unrolling 3122 the sheet of Dk material 3502 from the roll 3520 of Dk material; a step of passing the unrolled sheet of Dk material 3502 between the pattern roller 3522 and the opposing compression roller 3524, whereat the step of forming 3104 (see FIG. 3A) in the sheet substantially identical ones of the plurality of recesses 3504 arranged in the array occurs, resulting in a patterned sheet 3512; a step of passing the patterned sheet 3512 proximate the dispenser unit 3526, whereat the step of filling 3106 (see FIG. 3A) of the plurality of recesses 3504 with the curable Dk composition 3506 occurs, resulting a filled patterned sheet 3514; a step of passing the filled patterned sheet 3514 proximate the curing unit 3528, whereat the step of at least partially curing 3107 the curable Dk composition 3506 occurs, resulting in an at least partially cured sheet 3518; and, a step of passing the at least partially cured sheet 3518 to the finish roller 3530 for subsequent processing.

In an embodiment and with particular reference still to FIG. 3B in combination with FIG. 3A, the method 3100 further includes the following steps: prior to the step of passing the patterned sheet 3512 proximate the dispenser unit 3526, a step of engaging the patterned sheet 3512 with the first tensioning roller 3532, which in an embodiment is position adjustable for controlling in-process tensioning of the patterned sheet 3512; and, prior to the step of passing the filled patterned sheet 3514 proximate the curing unit 3528, a step of engaging the filled patterned sheet 3514 with the second tensioning roller 3534, which in an embodiment is position adjustable for controlling in-process tensioning of the filled patterned sheet 3514.

In an embodiment and with particular reference still to FIG. 3B in combination with FIG. 3A, the method 3100 further includes the following steps: prior to the step of passing the filled patterned sheet 3514 proximate the curing unit 3528, a step of engaging the filled patterned sheet 3514 with the squeegee unit 3536 and the opposing second tensioning roller 3534, resulting in a filled and squeegeed patterned sheet 3516.

In an embodiment of method 3100, the first average dielectric constant of the curable Dk composition 3506 is equal to or greater than 5, alternatively equal to or greater than 9, further alternatively equal to or greater than 18, and equal to or less than 100.

In an embodiment of method 3100, the curable first Dk composition 3506 includes a curable resin, preferably wherein the curable resin includes a Dk material.

In an embodiment of method 3100, the curable first Dk composition 3506 further includes an inorganic particulate material, preferably wherein the inorganic particulate material includes titanium dioxide.

In an embodiment of method 3100, each recess 3504 of the plurality of recesses has an inner cross-section shape, as observed in an x-y plane cross-section, that is circular. (see FIG. 16B, for example, and for other example shapes contemplated herein).

Fourth Example Embodiment: Dk EM Structure 4500

Figure 4A:
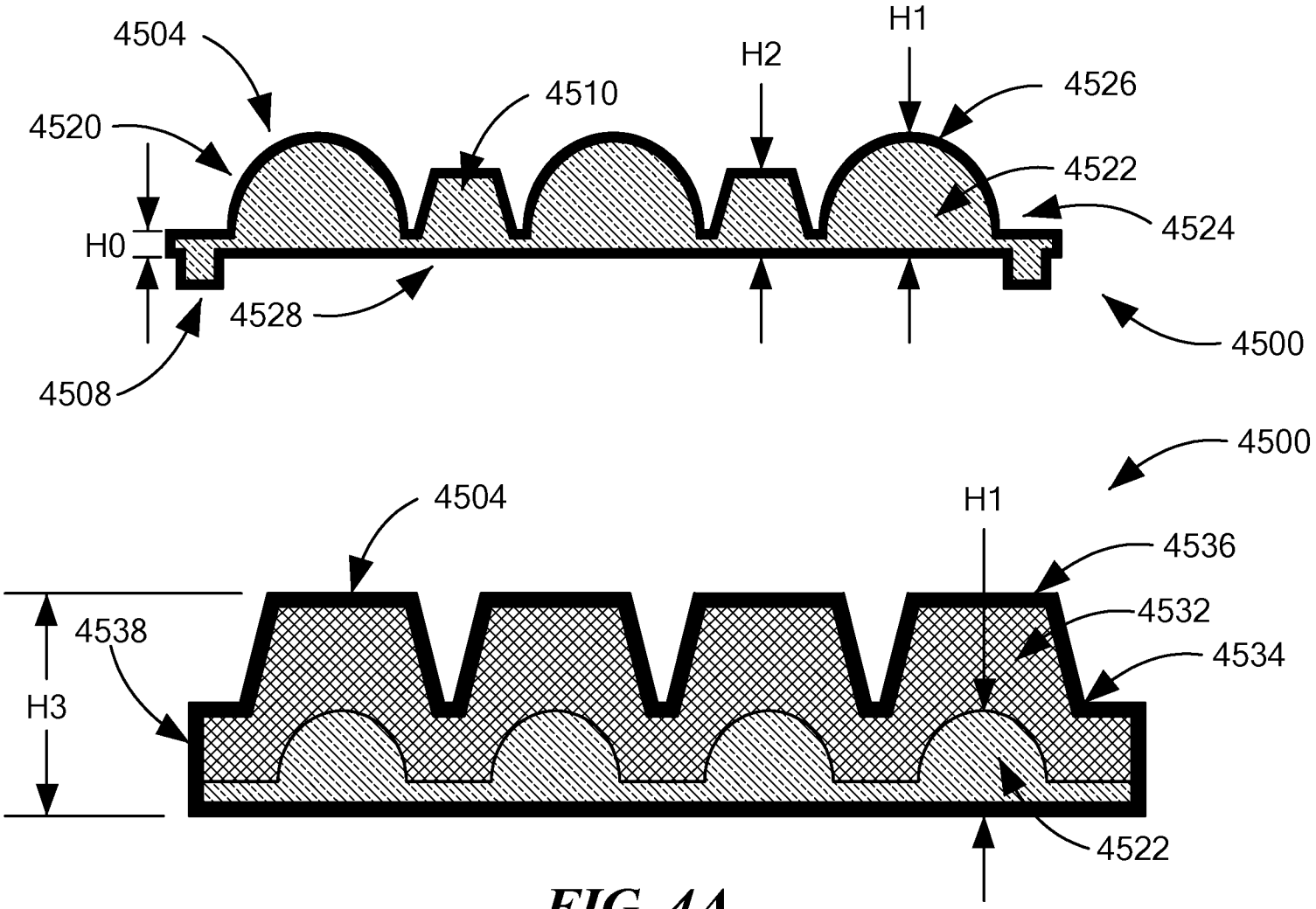
FIGS. 4A, 4B, and 4C depict in cross section side view Dk EM structures similar but alternative to those of FIGS. 1A-1D, 2A-2C, and 3A-3B, in accordance with an embodiment.
Figure 4B:
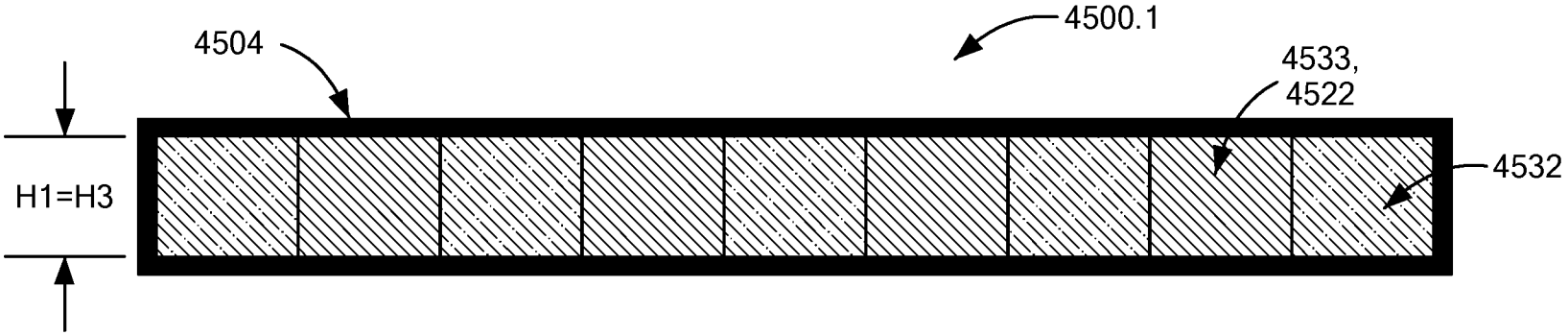
Figure 4C:
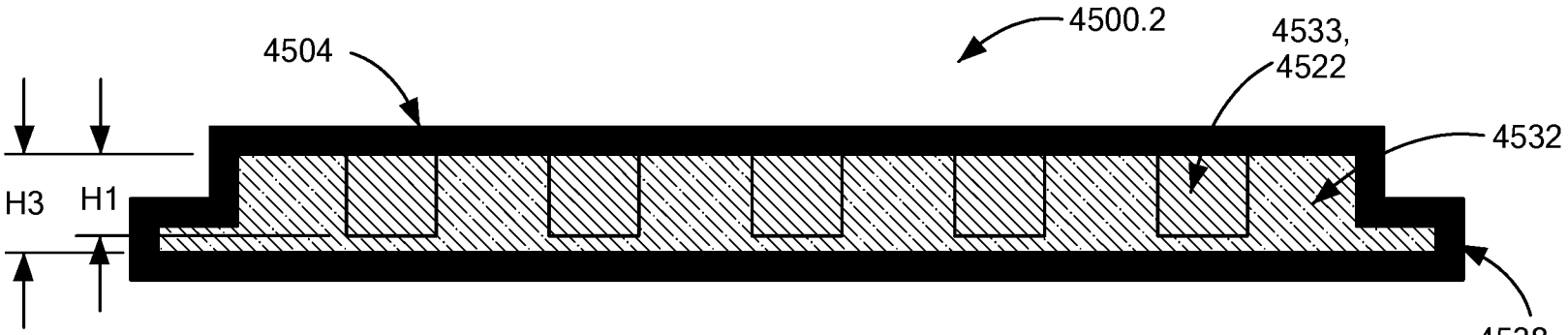
Figure 4D:
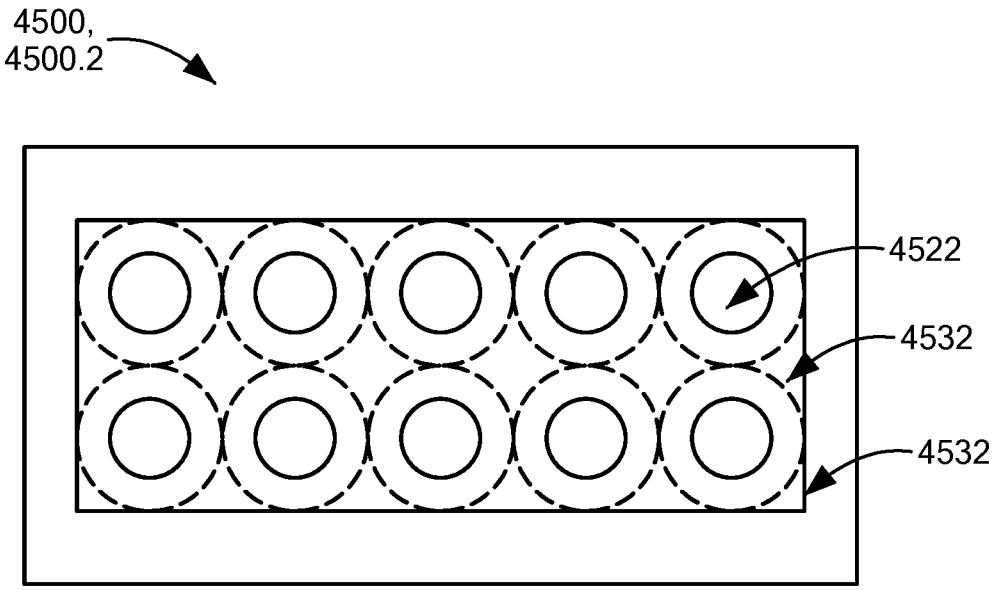
FIG. 4D depicts a top-down plan view of the Dk EM structure of FIG. 4C, in accordance with an embodiment.

The following description of an example Dk EM structure 4500 is made with particular reference to FIGS. 4A, 4B, 4C and 4D, collectively, where FIG. 4A depicts cross section elevation views of alternative forms of a Dk EM structure 4500, FIGS. 4B and 4C depict cross section elevation views of Dk EM structures 4500.1 and 4500.2 alternative to that of Dk EM structure 4500, and FIG. 4D depicts a top-down plan view of an example Dk EM structure 4500, 4500.1, 4500.2.

In an embodiment and with particular reference to FIG. 4A, the example Dk Em structure 4500 includes: at least one Dk component 4520 having a Dk material other than air having a first average dielectric constant; and a water impervious layer 4504 conformally disposed over at least a portion of the exposed surfaces of the at least one Dk component 4520. In an embodiment, the water impervious layer 4504 is conformally disposed over at least the exposed upper surfaces of the at least one Dk component 4520, and may further be conformally disposed over the exposed outermost side surfaces of the at least one Dk component 4520 (see FIG. 4A). In an embodiment, the water impervious layer 4504 is conformally disposed over all exposed surfaces of the at least one Dk component 4520. In an embodiment, the water impervious layer 4504 is equal to or less than 30 microns, alternatively equal to or less than 10 microns, further alternatively equal to or less than 3 microns, yet further alternatively equal to or less than 1 micron. In an embodiment, the water impervious layer 4504 is survivable of soldering temperatures equal to or greater than 280 degree Celsius. In an embodiment, the water impervious layer 4504 is replaced with a water repellent layer (also herein referred to by reference numeral 4504). In an embodiment, the water impervious or repellant layer includes: nitrides, silicon nitride, acrylates, an acrylate layer with optional additives such as silicon monoxide (SiO), magnesium oxide (MgO), or the like, poly-ethylene, or hydrophobic polymer based materials.

As used herein, the phrase "having a Dk material other than air" necessarily includes a Dk material that is not air, but may also include air, which includes a foam. As used herein, the phrase "comprising air" necessarily includes air, but also does not preclude a Dk material that is not air, which includes a foam. Also, the term "air" may more generally be referred to and viewed as being a gas having a dielectric constant that is suitable for a purpose disclosed herein.

Figure 8:
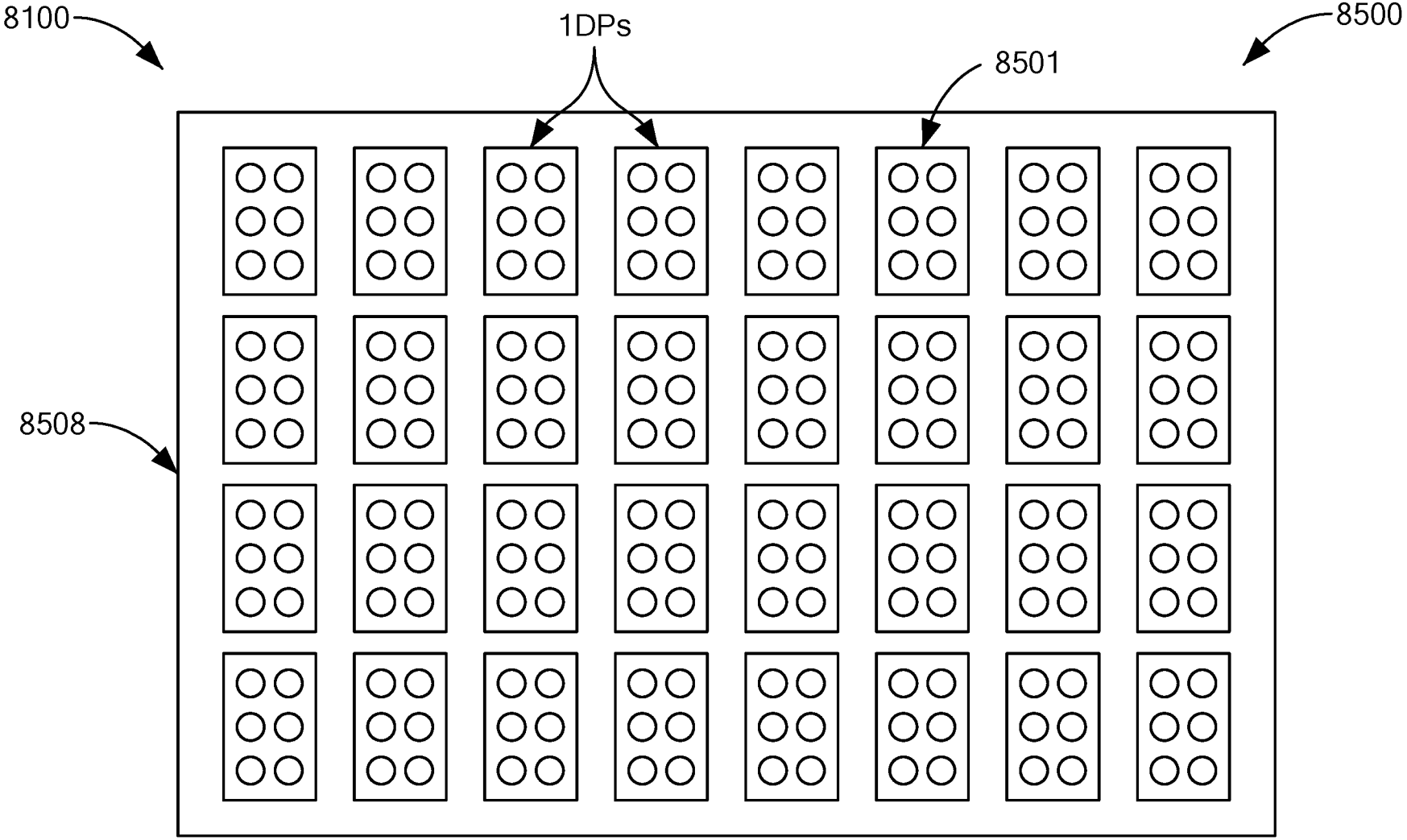
FIG. 8 depicts in top-down plan view an example of panel-level processing for forming multiple Dk EM structures, in accordance with an embodiment.

In an embodiment and with particular reference still to FIG. 4A, the at least one Dk component 4520 includes a plurality of the Dk components 4520 arranged in an x-by-y arrangement forming an array of the Dk components 4520 (plurality of Dk components 4520 depicted in FIG. 4A arranged in an array, not specifically depicted in FIG. 4A, but understood by one skilled in the art with reference to at least FIG. 8).

In an embodiment and with particular reference still to FIG. 4A, each of the plurality of Dk components 4520 is physically connected to at least one other of the plurality of Dk components 4520 via a relatively thin connecting structure 4528, each connecting structure 4528 being relatively thin as compared to an overall outside dimension of one of the plurality of Dk components 4520, each connecting structure 4528 having a cross sectional overall height, H0, that is less than an overall height, H1, of a respective connected Dk component 4520 and being formed from the Dk material of the Dk component 4520, each relatively thin connecting structure 4528 and the plurality of Dk components 4520 forming a single monolithic (also generally referred to by reference numeral 4520). In an embodiment, the relatively thin connecting structure 4528 includes at least one alignment feature 4508 integrally formed with the monolithic 4520. In an embodiment, the at least one alignment feature 4508 may be any of the following: a projection, a recess, a hole, or any combination of the foregoing alignment features.

In an embodiment and with particular reference still to FIG. 4A, the array of Dk components 4520 includes a plurality of Dk isolators 4510 arranged in a one-to-one correspondence with each one of the plurality of Dk components 4520, each Dk isolator 4510 being disposed substantially surrounding a corresponding one of the plurality of Dk components 4520. In an embodiment, each Dk isolator 4510 forms a contiguous ring around a corresponding one of the Dk components 4520. In an embodiment, each of the plurality of Dk isolators 4510 has a height, H2, equal to or less than a height, H1, of the plurality of Dk components 4520. In an embodiment, each of the Dk isolators 4510 comprises a hollow interior portion (see enhanced Dk isolators 2520, 2522 in FIG. 2C). In an embodiment, the hollow interior is open at the top (see enhanced Dk isolator 2520, FIG. 2C), or is open at the bottom (se Dk isolator 2522, FIG. 2C). In an embodiment, the plurality of Dk isolators 4510 are integrally formed with the plurality of Dk components 4520, via the relatively thin connecting structure 4528, forming a monolithic.

In an embodiment and with particular reference still to FIG. 4A, each one of the at least one Dk component 4520 includes a first dielectric portion 4522, 1DP, and further includes; a plurality of second dielectric portions 4532, 2DPs, each 2DP 4532 of the plurality of 2DPs having a Dk material other than air having a second average dielectric constant; wherein each 1DP 4522 has a proximal end 4524 and a distal end 4526; wherein each 2DP 4532 has a proximal end 4534 and a distal end 4536, the proximal end 4534 of a given 2DP 4532 being disposed proximate the distal end 4526 of a corresponding 1DP 4522, the distal end 4536 of the given 2DP 4532 being disposed a defined distance away from the distal end 4526 of the corresponding 1DP 4522; and wherein the second average dielectric constant is less than the first average dielectric constant. In an embodiment and as observed in a side cross section elevation view (see FIG. 4A), each 1DP 4522 has an overall height, H1, and each 2DP 4532 has an overall height, H3, where H3 is greater than H1, and where the distal end 4536 of a given 2DP 4532

In an embodiment, each 2DP 4532 is integrally formed with an adjacent one of the 2DP 4532 via a relatively thin connecting structure 4538 forming a monolithic of 2DPs 4532 with the relatively thin connecting structure 4538.

In an embodiment, of the Dk EM structure 4500 the first average dielectric constant is equal to or greater than 5, alternatively equal to or greater than 9, further alternatively equal to or greater than 18, and equal to or less than 100.

In an embodiment of the Dk EM structure 4500, and with reference particularly to Dk EM structure 4500 of FIG. 4A in combination with Dk EM structure 4500.1 of FIG. 4B, each of the at least one Dk component 4520 includes a first dielectric portion 4522, 1DP, having a height, H1, and further includes: a second dielectric portion, 2DP, 4532 having a height, H3, having a Dk material other than air having a second average dielectric constant; wherein the Dk material of the 2DP 4532 includes a plurality of recesses 4533, each recess 4533 of the plurality of recesses being filled with a Dk material of a corresponding one of the 1DP 4522; wherein each of the 2DP 4532 substantially surrounds a corresponding one of the 1DP 4522; and wherein the second average dielectric constant is less than the first average dielectric constant. In an embodiment, each of the 2DP 4532 forms a contiguous ring of relatively lower Dk material than that of the 1DP 4522 around a corresponding one of 1DP 4522, as observed in a plan view of the Dk EM structure 4500. In an embodiment of the Dk EM structure 4500, 4500.1 of FIG. 4B, H1 is equal to H3.

In an alternative embodiment of the Dk EM structure 4500, and with reference particularly to Dk EM structure 4500 of FIG. 4A in combination with Dk EM structure 4500.2 of FIG. 4C, the 2DP 4532 includes a relatively thin connecting structure 4538 that is subordinate to each of the 1DP 4522, wherein the 2DP 4532 and the relatively thin connecting structure 4538 forms a monolithic, and wherein H1 is less than H3.

In an embodiment of the Dk EM structure 4500.1 and 4500.2, the impervious layer 4504 is conformally disposed over all exposed surfaces of the array.

In an embodiment of the Dk EM structure 4500, 4500.1, and 4500.2, the first average dielectric constant is equal to or greater than 5, alternatively equal to or greater than 9, further alternatively equal to or greater than 18, and equal to or less than 100.

In an embodiment of the Dk EM structure 4500, 4500.1, and 4500.2, the Dk material having the first average dielectric constant comprises an at least partially cured resin that includes a Dk particulate material. In an embodiment of the Dk structure 4500, 4500.1, and 4500.2, the Dk particulate material further includes an inorganic particulate material, preferably wherein the inorganic particulate material includes titanium dioxide.

In an embodiment of the Dk structure 4500, 4500.1, and 4500.2, each Dk component 4520 of the at least one Dk component has an outer cross-section shape, as observed in an x-y plane cross-section, that is circular. (see FIG. 16B, for example, and for other example shapes contemplated herein). In an embodiment of the Dk structure 4500, 4500.1, and 4500.2, each Dk component 4520 of the at least one Dk component is a dielectric resonator antenna, DRA. In an embodiment of the Dk structure 4500, 4500.1, and 4500.2, each 2DP 4532 of the plurality of 2DPs is a dielectric lens or waveguide.

FIG. 4C depicts a side cross section elevation view of the Dk EM structure 4500, 4500.2, and FIG. 4D depicts a top-down plan view of the Dk EM structure 4500, 4500.2 having a plurality of 1DPs 4522 arranged in an array surrounded by a plurality of 2DPs 4532 (which may be rectangular as depicted by a solid line, or circular as depicted by a dashed line, or any other shape suitable for a purpose disclosed herein),

Fifth Example Embodiment: Method 5100, Dk EM Structure 5500

Figure 5A:
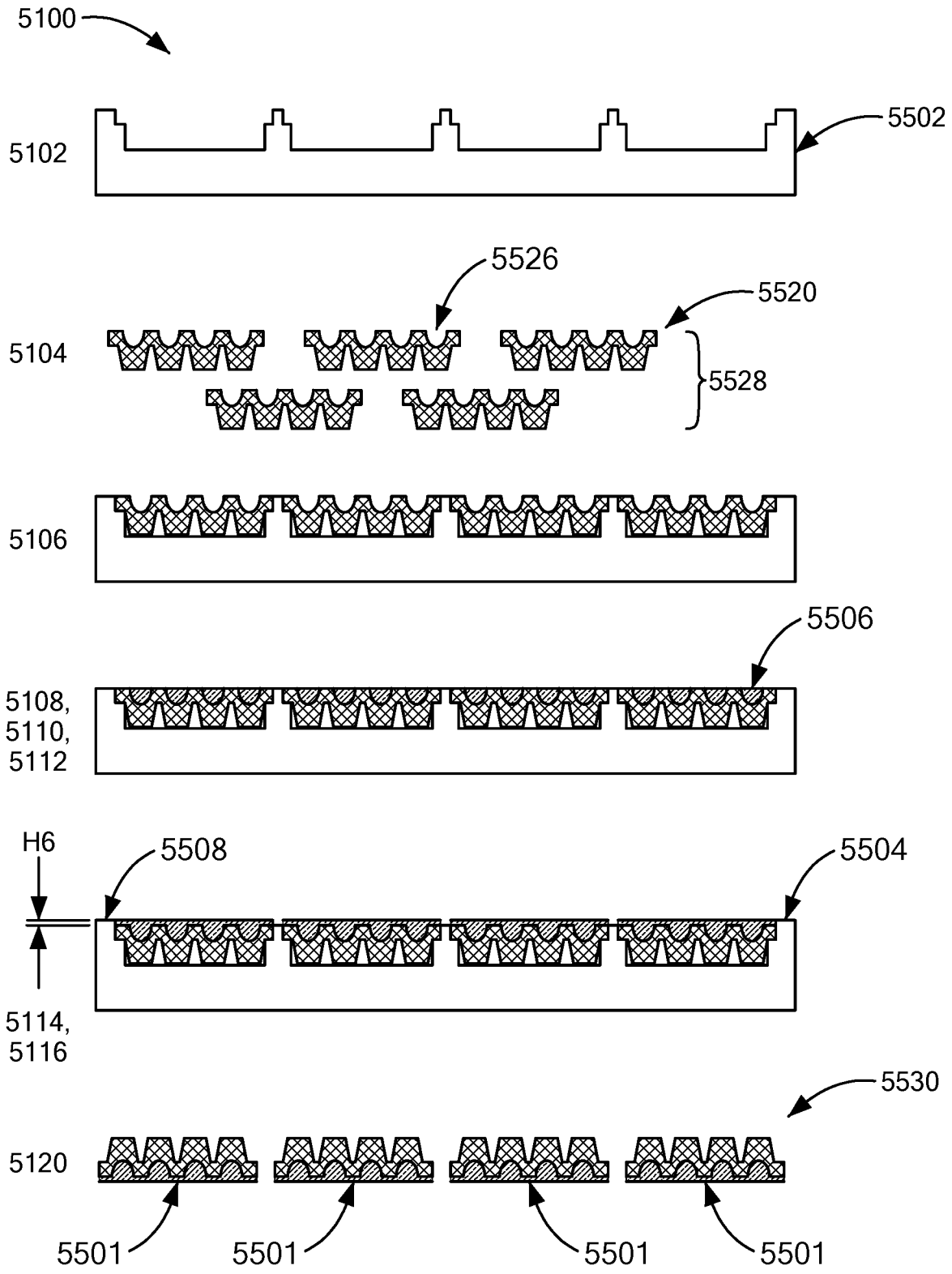
FIG. 5A depicts in cross section side view a block diagram representation of another alternative method of making a Dk EM structure, in accordance with an embodiment.
Figure 5B:
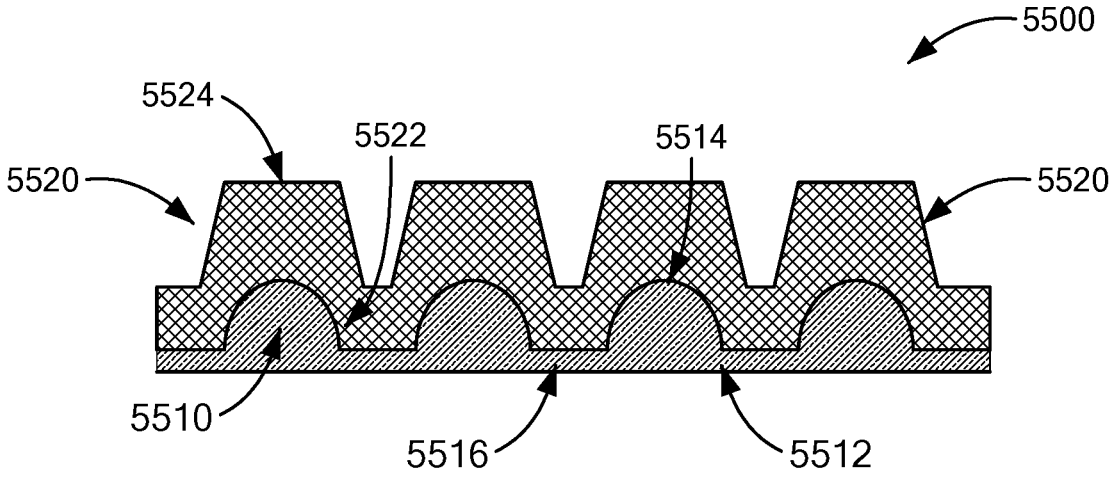
FIG. 5B depicts in cross section side view a Dk EM structure made according to the method depicted in FIG. 5A, in accordance with an embodiment.

The following description of an example method 5100 of making a Dk EM structure 5500 is made with particular reference to FIGS. 5A and 5B, collectively, where FIG. 5A depicts method steps 5102, 5104, 5106, 5108, 5110, 5112, 5114, 5116, 5120, and a resulting array 5501 of the Dk EM structure 5500, and FIG. 5B depicts a resulting example Dk EM structure 5500.

In an embodiment and with particular reference to FIGS. 5A and 5B collectively, the example method 5100 of making the Dk EM structure 5500 having a plurality of a first dielectric portion 5510, 1DP, and a plurality of a second dielectric portion 5520, 2DP, disposed in a one-to-one correspondence with a given one of the plurality of the 1DP 5510, each 1DP 5510 of the plurality of 1DPs having a proximal end 5512 and a distal end 5514, the distal end 5514 of a given 1DP 5510 having a cross-section, as observed in an x-y plane cross section view, that is smaller than a cross-section of the proximal end 5512 of the given 1DP 5510 as observed in an x-y plane cross-section, includes the follow steps: a step of providing 5102 a support form 5502; a step of providing 5104 a plurality of integrally formed ones of the 2DP 5520 arranged in at least one array, the plurality of 2DPs 5520 being a Dk material that is at least partially cured, each 2DP 5520 of the plurality of 2DPs comprising a proximal end 5522 and a distal end 5524, each proximal end 5522 of a given 2DP 5520 comprising a centrally disposed depression 5526 having a blind end, and placing 5106 the plurality of the 2DPs 5520 onto the support form 5502, wherein each depression 5526 of the plurality of 2DPs 5520 is configured to form a corresponding one of the plurality of the 1DPs 5510 when filled; a step of filling 5108 a flowable form of a curable Dk composition 5506 into the depressions 5526 of the plurality of 2DPs 5520, the Dk composition 5506 having a first average dielectric constant when fully cured that is greater than a second average dielectric constant of the plurality of 2DPs 5520 when fully cured; a step of squeegeeing 5110 across an upper side of the support form 5502 and the proximal end 5522 of the plurality of 2DPs 5520 to remove any excess of the curable Dk composition 5506, leaving the Dk composition 5506 at least flush with the proximal end 5522 of each 2DP 5520 of the plurality of 2DPs; a step of at least partially curing 5112 the curable Dk composition 5506 to form at least one array 5501 of the plurality of 1DPs 5510; a step of removing 5120 from the support form 5502 a resulting assembly 5530 comprising the at least one array 5501 of the 2DPs 5520 with the at least one array 5501 of the 1DPs 5510 formed therein.

In an embodiment of the method 5100, the support form 5502 includes a raised wall 5504 around a given one of the at least one array 5501 of the plurality of 2DPs 5520, and wherein the step of filling 5108 and squeegeeing 5110 further includes: a step of filling 5114 the flowable form of the curable Dk composition 5506 into the depressions 5526 of the plurality of 2DPs 5520 and up to an upper edge 5508 of the raised wall 5504 of the support form 5502, such that the depressions 5526 of the plurality of 2DPs 5520 are filled and the proximal ends 5522 of the associated plurality of 2DPs 5520 are covered with the Dk composition 5506 to a particular thickness, H6; and, a step of squeegeeing 5116 across the raised wall 5504 of the support form 5502 to remove any excess Dk composition 5506, leaving the Dk composition 5506 flush to the upper edge 5508 of the raised wall 5504, where the Dk composition 5506 of the H6 thickness provides a connecting structure 5516 (see FIG. 5B) that is integrally formed with the plurality of 1DPs 5510 to form a monolothic. In an embodiment of the method of 5100, H6 is about 0.002 inches.

In an embodiment of the method 5100, the at least one array of the plurality of integrally formed 2DPs 5520 is one of a plurality of arrays of the integrally formed 2DPs 5528 that are placed onto the support form 5502, wherein the plurality of 2DPs 5520 include a thermoplastic polymer, the plurality of 1DPs 5510 include a thermoset Dk material 5506, and the step of at least partially curing 5112 includes curing the curable Dk composition 5506 at a temperature equal to or greater than about 170 degree Celsius for a time duration equal to or greater than about 1 hour. In an embodiment of the method 5100, the thermoplastic polymer is a high temperature polymer, and the Dk material 5506 includes an inorganic particulate material, preferably wherein the inorganic particulate material includes titanium dioxide.

In an embodiment of the method of 5100, each of the plurality of the 1DPs 5510 and each of the plurality of the 2DPs 5520 have an outer cross-section shape, as observed in an x-y plane cross-section, that is circular. (see FIG. 16B, for example, and for other example shapes contemplated herein).

Sixth Example Embodiment: Mold 6100, Dk EM Structure 6500

Figure 6A:
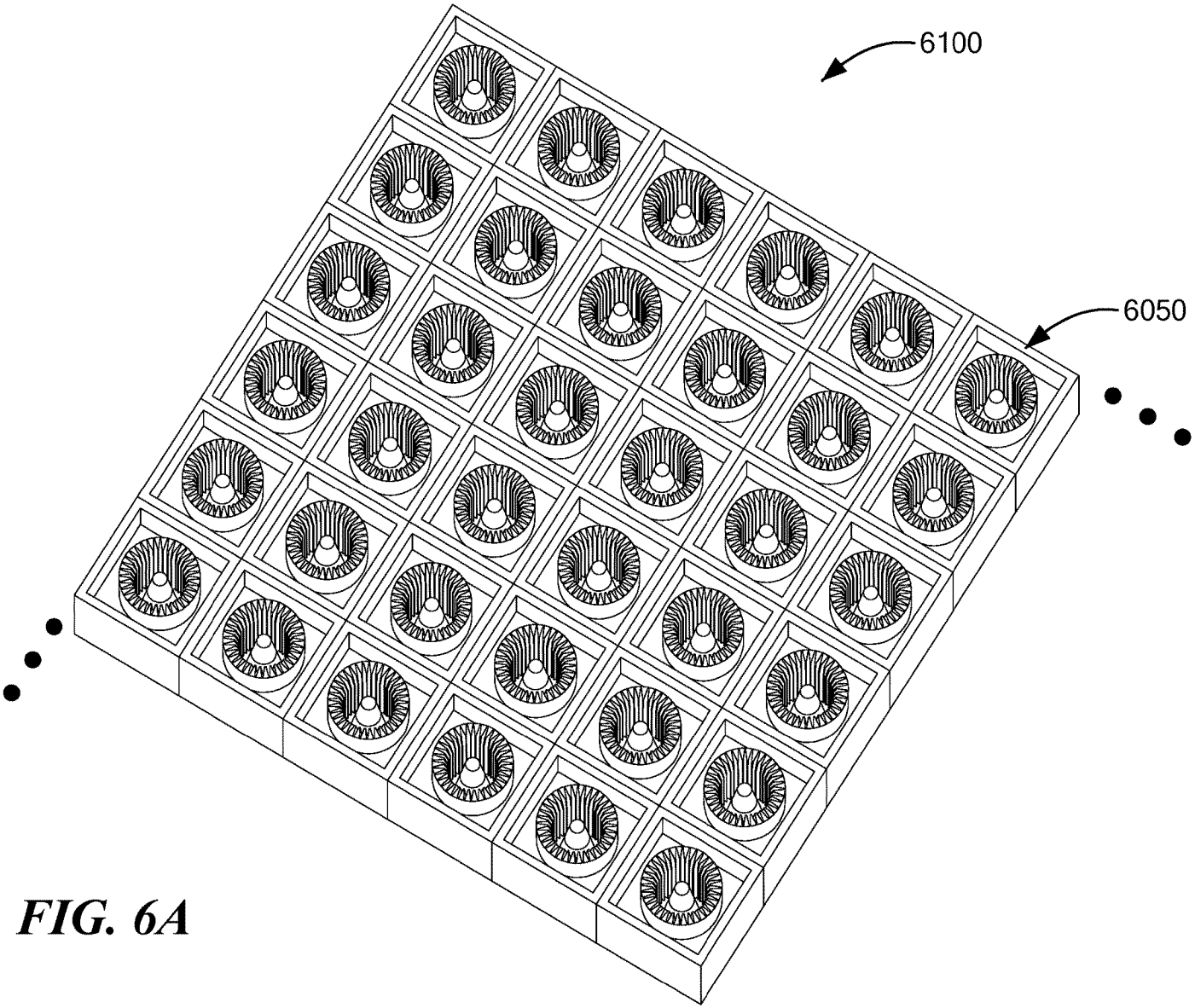
FIG. 6A depicts in rotated isometric view an example mold for making a Dk EM structure alternative that that of FIGS. 1A-1D, 2A-2C, 3A-3B, 4A-4C, and 5A-5B, in accordance with an embodiment.
Figure 6B:
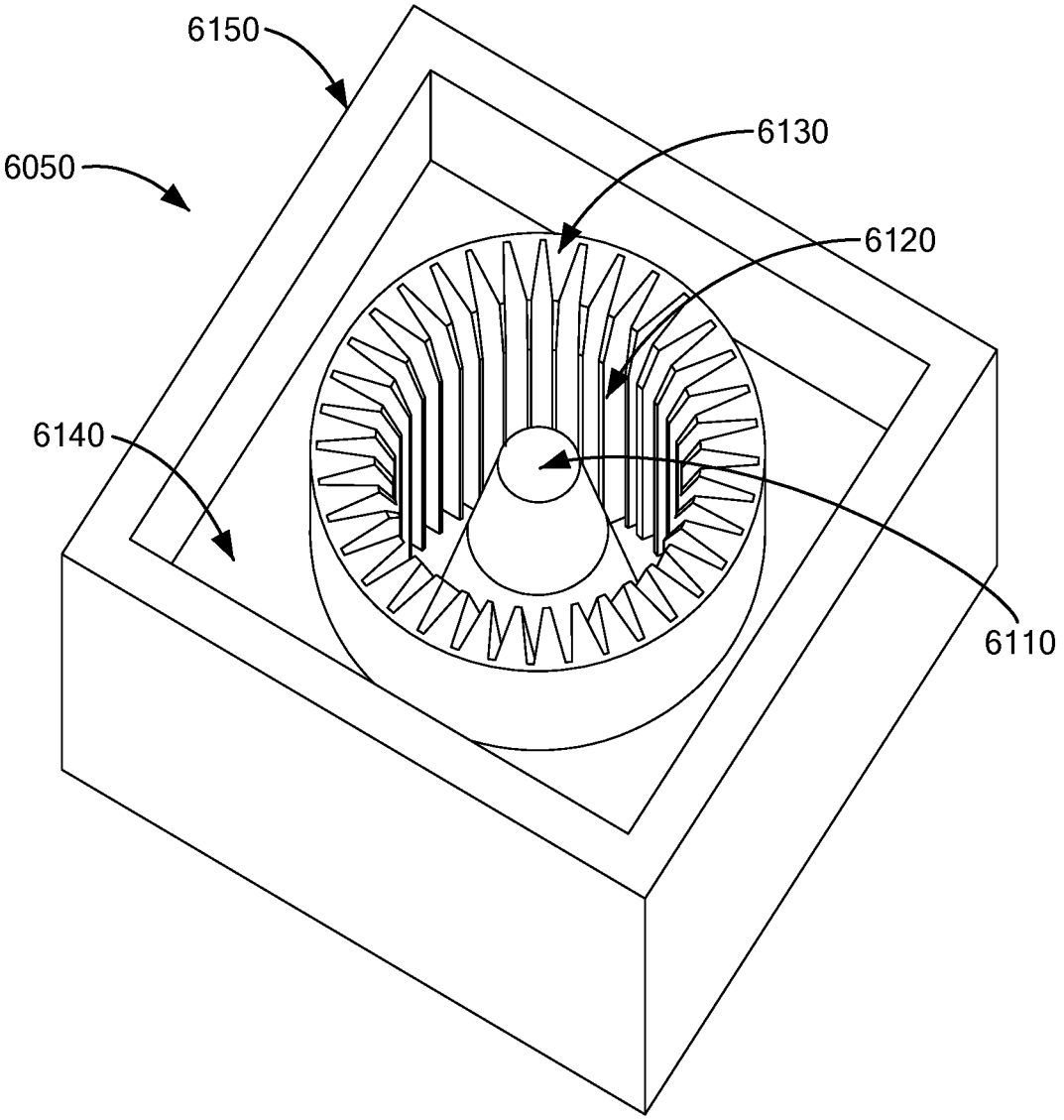
FIG. 6B depicts in rotated isometric view a unit cell of the mold of FIG. 6A, in accordance with an embodiment.
Figure 6C:
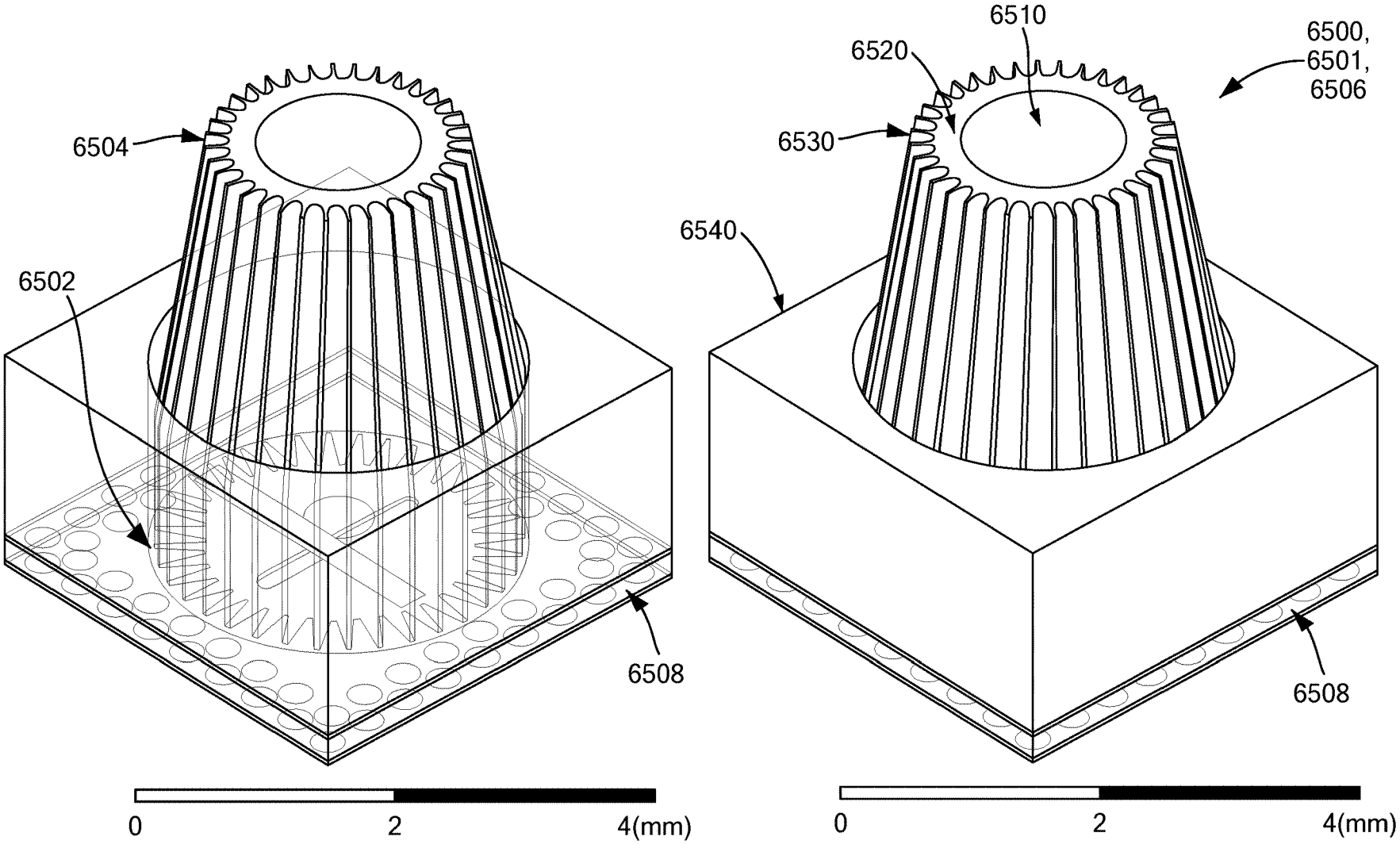
FIG. 6C depicts a transparent rotated isometric view, a corresponding solid rotated isometric view, and a corresponding plan view, of a Dk EM structure made from the mold of FIGS. 6A and 6B, in accordance with an embodiment.
Figure 6C:
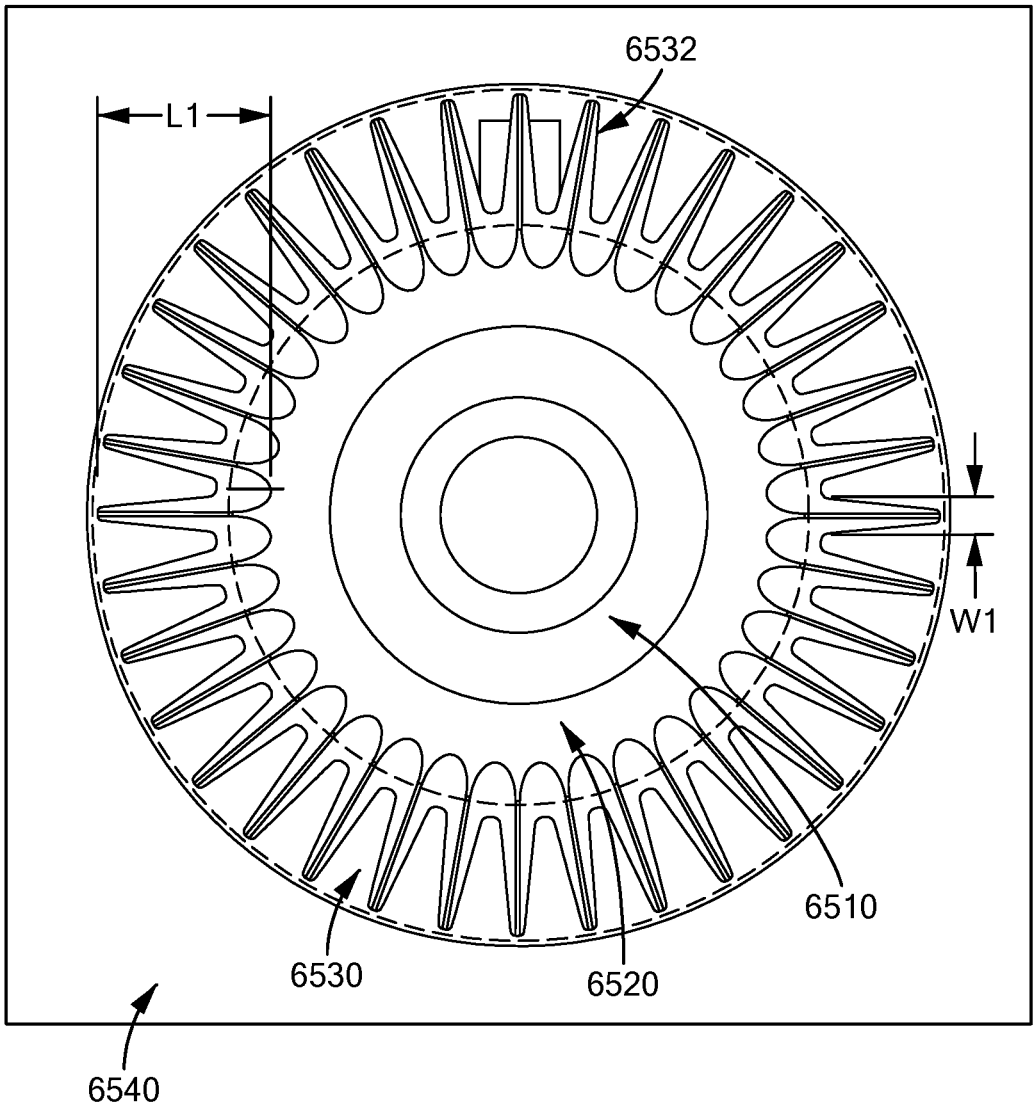

The following description of an example mold 6100 for making a Dk EM structure 6500 is made with particular reference to FIGS. 6A, 6B and 6C, collectively, where FIG. 6A depicts an example mold 6100, FIG. 6B depicts a unit cell 6050 of the mold 6100, and FIG. 6C depicts an example Dk EM structure 6500 producible from the mold 6100.

In an embodiment and with particular reference to FIGS. 6A, 6B, and 6C collectively, the example mold 6100 for making the Dk EM structure 6500 that includes a first region 6510 having a first average dielectric constant, a second region 6520 disposed radially, relative to the z-axis, outboard of the first region and having a second average dielectric constant, a third region 6530 disposed radially, relative to the z-axis, outboard of the second region and having a third average dielectric constant, and a fourth region 6540 disposed radially, relative to the z-axis, outboard of the third region and having the second average dielectric constant, includes: a plurality of unit cells 6050 that are integrally formed with or joined with each other to provide a contiguous mold 6100, each unit cell 6050 having: a first portion 6110 disposed and configured to form the first region 6510 of the EM structure 6500; a second portion 6120 disposed and configured to form the second region 6520 of the EM structure 6500; a third portion 6130 disposed and configured to form the third region 6530 of the EM structure 6500; a fourth portion 6140 disposed and configured to form the fourth region 6540 of the EM structure 6500; and, a fifth portion 6150 disposed and configured to form and define an outer boundary of each unit cell 6050; wherein the first portion 6110, the second portion 6120, the third portion 6130, the fourth portion 6140, and the fifth portion 6150, are all integrally formed with each other from a single material to provide a monolithic unit cell 6050; wherein the first 6110 and fifth 6150 portions include the single material of the monolithic unit cell 6050, the second 6120 and fourth 6140 portions are absent the single material of the monolithic unit cell 6050, and the third portion 6130 has a combination of an absence of and a presence of the single material of the monolithic unit cell 6050; and wherein the second 6120 and fourth 6140 portions, and only a fraction of the third portion 6130, are configured to receive a flowable form of a curable Dk composition 6506.

In an embodiment of the mold 6100 and with particular reference to FIG. 6C in combination with FIGS. 6A and 6B, a single Dk EM structure 6500 made from the unit cell 6050 of the mold 6100 includes: a three dimensional, 3D, body 6501 made from an at least partially cured form of the Dk composition 6506 having a proximal end 6502 and a distal end 6504; the 3D body 6501 having the first region 6510 disposed substantially at a center of the 3D body 6501 (relative to a corresponding z-axis), the first region 6510 extending axially to the distal end 6504 of the 3D body 6501 with a composition that includes air; the 3D body 6501 further having the second region 6520 made from the at least partially cured form of the Dk composition 6506 where the second average dielectric constant is greater than the first average dielectric constant, the second region 6520 extending axially from the proximal end 6502 to the distal end 6504 of the 3D body 6501; the 3D body 6501 further having the third region 6530 made partially from the at least partially cured form of the Dk composition 6506, and partially from another dielectric medium such as air for example, where the third average dielectric constant is less than the second average dielectric constant, the third region 6530 extending axially from the proximal end 6502 to the distal end 6504 of the 3D body 6501; wherein the third region 6530 includes projections 6532 made from the at least partially cured form of the Dk composition 6506 that extend radially, relative to the z-axis, outward from and are integral and monolithic with the second region 6520; wherein each one of the projections 6532 has a cross-section overall length, L1, and a cross-section overall width, W1, as observed in an x-y plane cross-section, where L1 and W1 are each less than X, where X is an operating wavelength of the Dk EM structure 6500 when the Dk EM structure 6500 is electromagnetically excited; and, wherein all exposed surfaces of at least the second region 6520 of the 3D body 6501 draft inward, via drafted side walls of the mold 6100, from the proximal end 6502 to the distal end 6504 of the 3D body 6501. In an embodiment of the mold 6100, the single Dk EM structure 6500 made from the unit cell 6050 of the mold 6100 further includes: the first region 6510 and the second region 6520 of the 3D body 6501 each having an outer cross-section shape, as observed in an x-y plane cross-section, that is circular, and an inner cross-section shape, as observed in an x-y plane cross-section, that is circular. (see FIG. 16B, for example, and for other example shapes contemplated herein). In an embodiment, the Dk EM structure 6500 is disposed on a substrate 6508 that may be in the form of any substrate disclosed herein for a purpose disclosed herein. While FIG. 6C depicts a scale from 0-4 mm in relation to the size of the Dk EM structure 6500, it will be appreciated that this scale is for illustration purposes only and is not a limitation of the physical size of the Dk EM structure 6500, which may be any size suitable for a purpose disclosed herein.

From the foregoing, it will be appreciated that an embodiment of the Dk EM structure 6500 may be molded or otherwise formed via the mold/form 6100 in a single step onto a signal feed board, which is contemplated to greatly reduce processing time and cost with respect to existing fabrication methods of existing Dk EM structures useful for a purpose disclosed herein.

Seventh Example Embodiment: Method 7100, Dk EM Structure 7500

Figure 7A:
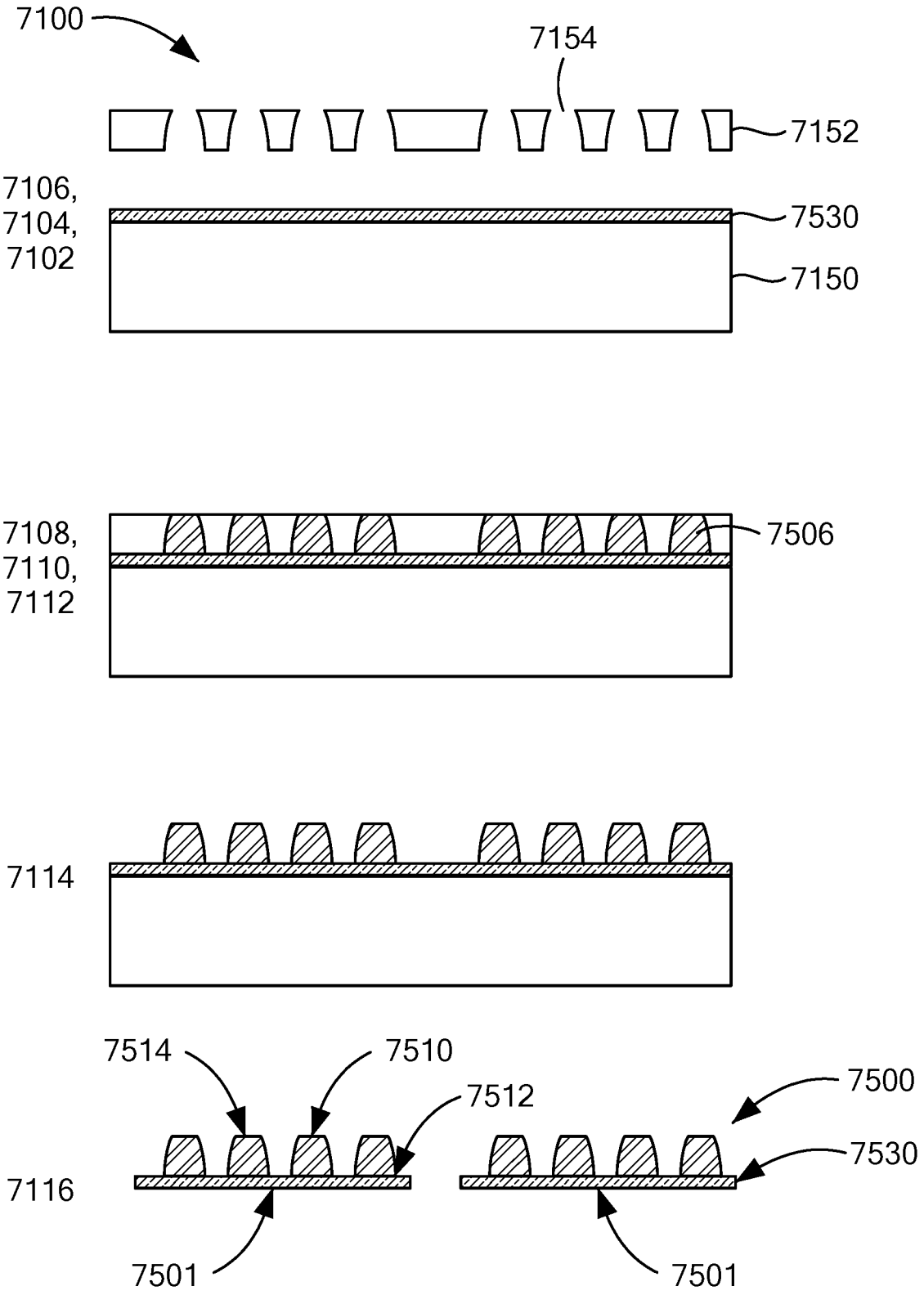
FIGS. 7A, 7B, 7C, 7D, and 7E, depict in cross section side view block diagram representations of alternative methods of making alternative Dk EM structures, in accordance with an embodiment.
Figure 7B:
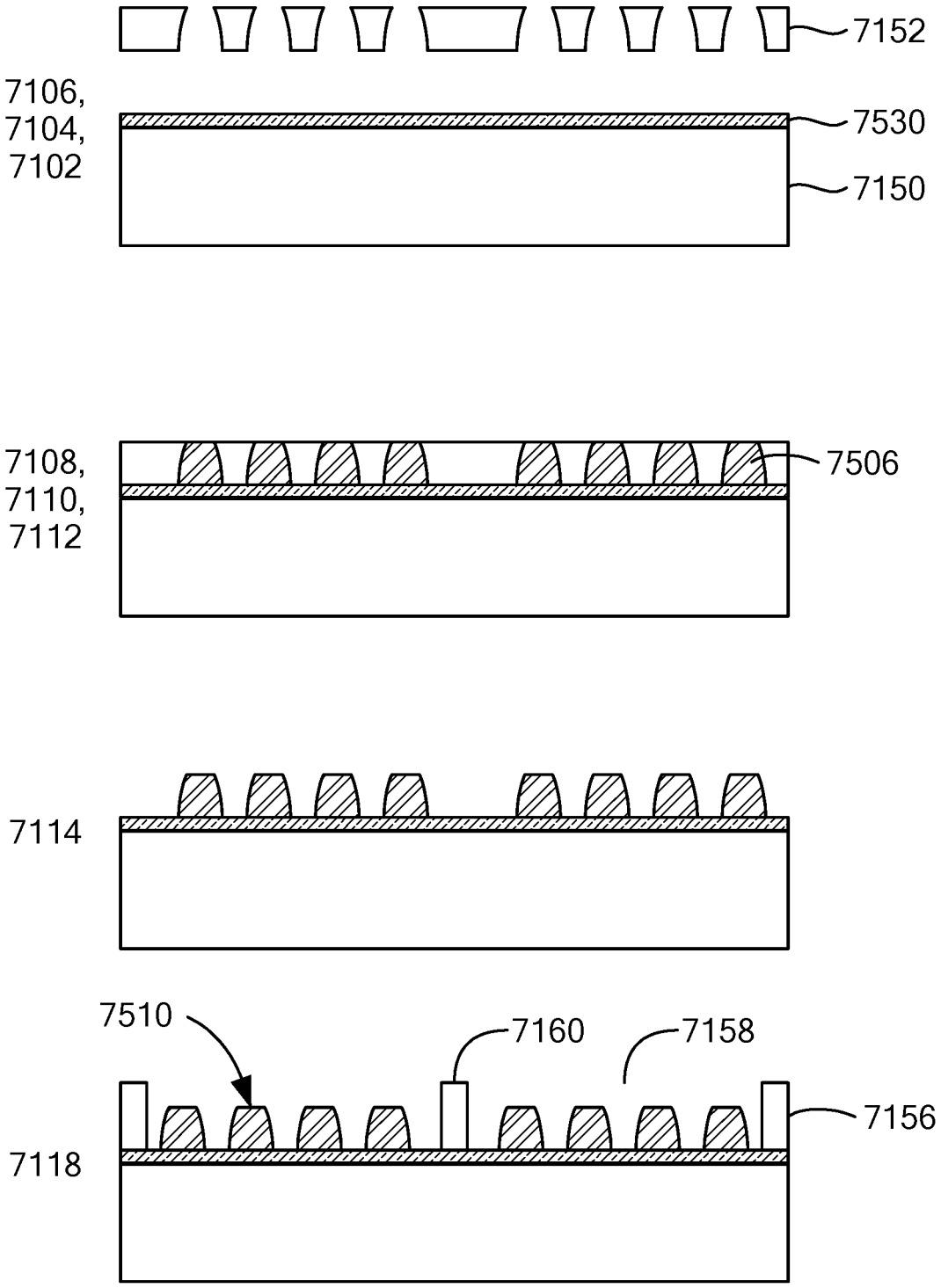
Figure 7C:
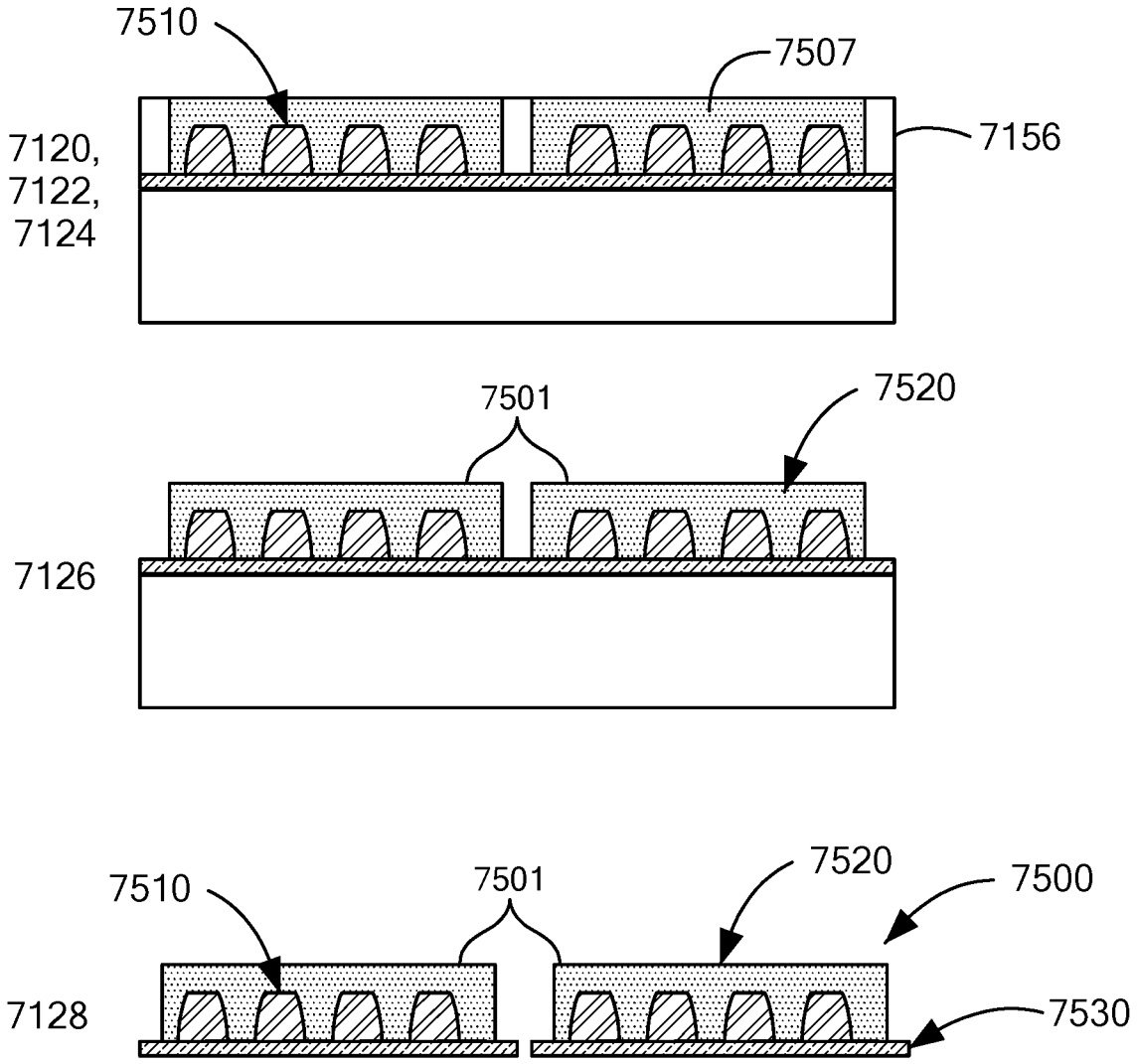
Figure 7D:
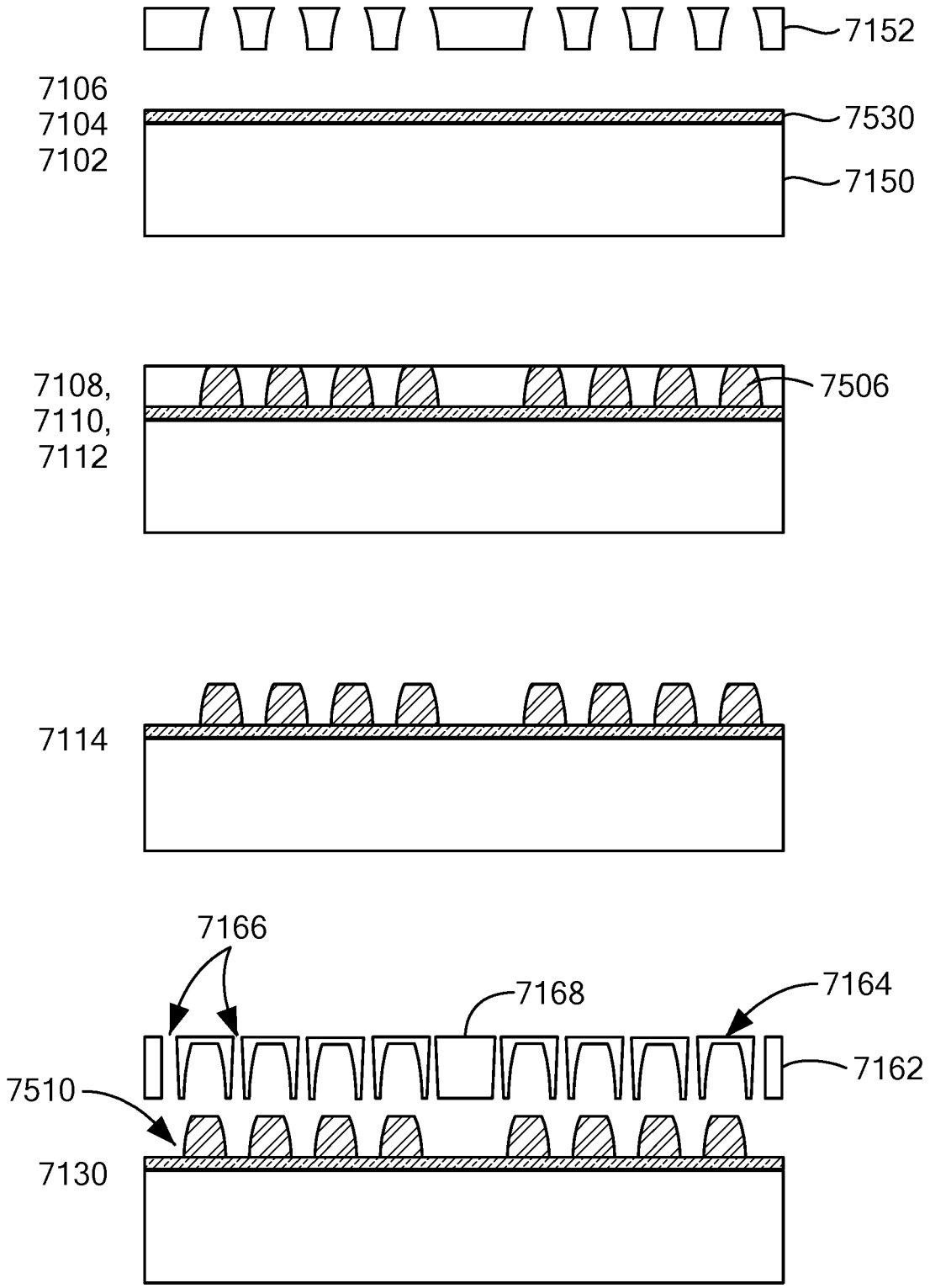
Figure 7E:
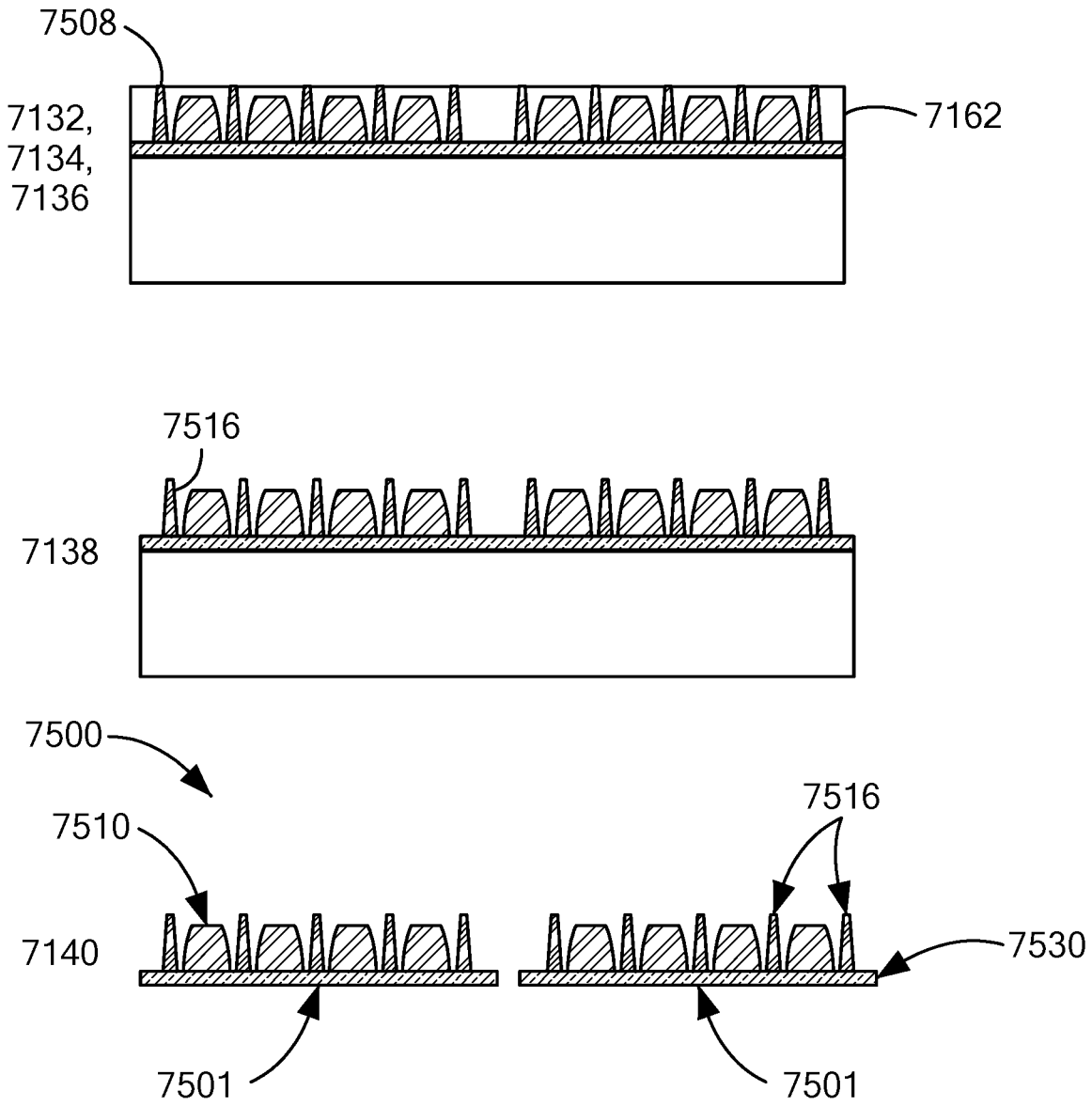

The following description of an example method 7100 of making a Dk EM structure 7500 is made with particular reference to FIGS. 7A, 7B, 7C, 7D, and 7E, collectively, where FIG. 7A depicts method steps 7102, 7104, 7106, 7108, 7110, 7112, 7114, and 7116, and a resulting Dk EM structure 7500 and array 7501 thereof, FIG. 7B depicts an additional method step 7118, FIG. 7C depicts additional method steps 7120, 7122, 7124, 7126, and 7128, and a resulting Dk EM structure 7500 and array 7501 thereof, FIG. 7D depicts an additional step 7130, and FIG. 7E depicts additional method steps 7132, 7134, 7136, 7138, and 7140, and a resulting Dk EM structure 7500 and array 7501 thereof.

In an embodiment and with particular reference to FIG. 7A, the example method 7100 of making the Dk EM structure 7500 having a plurality of a first dielectric portion 7510, 1DP, each 1DP 7510 of the plurality of 1DPs having a proximal end 7512 and a distal end 7514, the distal end 7514 having a cross-section area that is smaller than a cross-section area of the proximal end 7512 as observed in an x-y plane cross-section, includes the following steps: a step of providing 7102 a carrier 7150; a step of placing 7104 a substrate 7530 on the carrier 7150; a step of placing 7106 a first stenciling mask 7152 on the substrate 7530, the first stenciling mask 7152 having a plurality of openings 7154 arranged in at least one array, each opening 7154 having a shape configured for forming a corresponding one of the 1DP 7510; a step of filling 7108 a first flowable form of a curable first Dk composition 7506 into the openings 7154 of the first stenciling mask 7152, the first Dk composition 7506 having a first average dielectric constant after cure; a step of squeegeeing 7110 across an upper surface of the first stenciling mask 7152 to remove any excess of the first Dk composition 7506, leaving the remaining first Dk composition 7506 flush with the upper surface of the first stenciling mask 7152; a step of at least partially curing 7112 the curable first Dk composition 7506, forming at least one array 7501 of the 1DPs 7510; a step of removing 7114 the first stenciling mask 7152; and, a step of removing 7116 from the carrier 7150 a resulting assembly 7500 having the substrate 7530 with the at least one array 7501 of the 1DPs 7510 attached thereto.

In an embodiment and with particular reference to FIGS. 7B and 7C in combination with FIG. 7A, the method 7100 further includes the following steps: subsequent to the step of removing 7114 the first stenciling mask 7152 and prior to the step of removing 7116 the substrate 7530 with the at least one array of the 1DPs 7510 attached thereto, a step of placing 7118 a second stenciling mask 7156 on the substrate 7530, the second stenciling mask 7156 having openings 7158 surrounded by partitioning walls 7160 configured and disposed to surround a subset of the plurality of 1DPs 7510 for forming a plurality of arrays 7501 of the 1DPs, where each array 7501 of the 1DPs 7510 is to be encased in a second dielectric portion 7520, 2DP (see FIG. 7C); a step of filling 7120 a second flowable form of a curable second Dk composition 7507 into the openings 7158 of the second stenciling mask 7156, the second Dk composition 7507 having a second average dielectric constant after cure that is less than the first average dielectric constant; a step of squeegeeing 7122 across an upper surface of the second stenciling mask 7156 to remove any excess of the second Dk composition 7507, leaving the remaining second Dk composition 7507 flush with the upper surface of the second stenciling mask 7156; a step of at least partially curing 7124 the curable second Dk composition 7507, forming the plurality of arrays 7501 of the 1DPs 7510 encased in the 2DP 7520; a step of removing 7126 the second stenciling mask 7156 from the plurality of arrays 7501 of the 1DPs 7510 encased in the 2DP 7520; and, a step of removing 7128 from the carrier 7150 the resulting assembly 7500 having the substrate 7530 with the plurality of arrays 7501 of the 1DPs 7510 encased in a corresponding 2DP 7520 attached thereto.

In an embodiment and with particular reference to FIGS. 7D and 7E in combination with FIGS. 7A-7C, the method 7100 further includes the following steps: subsequent to the step of removing 7114 the first stenciling mask 7152 and prior to the step of removing 7116 the substrate 7530 with the at least one array of the 1DPs 7510 attached thereto, a step of placing 7130 a second stenciling mask 7162 on the substrate 7530, the second stenciling mask 7162 having covers 7164 that cover corresponding and individual ones of the plurality of 1DPs 7510, openings 7166 that surround, as observed in a plan view, individual ones of the plurality of 1DPs 7510, and partitioning walls 7168 that surround, as observed in a plan view, a subset of the plurality of 1DPs 7510 for forming a plurality of arrays 7501 of the 1DPs 7510 where each one of the plurality of 1DPs 7510 is to be surrounded by an electrically conductive structure 7516 (see FIG. 7E); a step of filling 7132 a flowable form of a curable composition 7508 into the openings 7166 of the second stenciling mask 7162, the curable composition 7508 being electrically conductive when fully cured; a step of squeegeeing 7134 across the upper surface of the second stenciling mask 7162 to remove any excess of the curable composition 7508, leaving the remaining curable composition flush with the upper surface of the second stenciling mask 7162; a step of at least partially curing 7136 the curable composition 7508, forming the plurality of arrays 7501 of the 1DPs 7510 where each 1DP 7510 is surrounded, as observed in a plan view, by the electrically conductive structure 7516; a step of removing 7138 the second stenciling mask 7162 from the plurality of arrays 7501; and, a step of removing 7140 from the carrier 7150 the resulting assembly 7500 having the substrate 7530 with the plurality of arrays 7501 of the 1DPs 7510, where each 1DP 7510 is surrounded by the electrically conductive structure 7516, attached thereto.

In an embodiment, the first stenciling mask 7152 may have vertical, slanted, or curved, sidewalls to provide any desired shape to the 1DPs 7510 produced from the first Dk composition 7506.

In an embodiment of the method 7100, the curable first Dk composition 7506 includes a curable resin, preferably wherein the curable resin includes a Dk material. In an embodiment of the method 7100, the curable first Dk composition 7506 further includes an inorganic particulate material, preferably wherein the inorganic particulate material includes titanium dioxide.

In an embodiment of the method 7100, each of the plurality of the 1DPs 7510 has an outer cross-section shape, as observed in an x-y plane cross-section, that is circular. (see FIG. 16B, for example, and for other example shapes contemplated herein).

In an embodiment of the method 7100, the curable composition 7508 includes any one of: a polymer having metal particles; a polymer having copper particles; a polymer having aluminum particles; a polymer having silver particles; an electrically conductive ink; a carbon ink; or, a combination of the foregoing curable compositions.

In an embodiment of the method 7100, the electrically conductive structure 7516 has an inner cross-section shape, as observed in an x-y plane cross-section, that is circular. (see FIG. 16B, for example, and for other example shapes contemplated herein).

In an embodiment of the method 7100, the substrate 7530 includes any one of a dielectric panel; a metal panel; a combination of a dielectric panel and a metal panel; a printed circuit board; a flexible circuit board; a substrate integrated waveguide, SIW; a metal panel comprising a plurality of slotted apertures disposed in a one-to-one correspondence with a given one of the plurality of 1DPs; or, an EM signal feed network.

Eighth Example Embodiment: Method 8100, Dk EM Structure 8500

The following description of an example method 8100 of making a Dk EM structure 8500 is made with particular reference to FIG. 8. While method 8100 and Dk EM structure 8500 are described herein below with respect to FIG. 8, it will be appreciated that the same method may be applicable to any of the foregoing methods 1100, 2100, 3100, 5100, 6100, and 7100, and that the illustrated Dk EM structure 8500 may be applicable and representative of any of the foregoing DK EM structures 1500, 2500, 3500, 4500, 5500, 6500, and 7500. As such, any reference to method 8100 and Dk EM structure 8500 in FIG. 8 should also be read in view of any of the foregoing methods and structures depicted in FIGS. 1A-7E.

In an embodiment, the example method 8100 is with respect to any of the foregoing methods, where the Dk EM structure 8500 comprises the at least one array 8501 (see also 1501, 2501, 5501, 7501, which may be substituted for array 8501) of 1DPs (any of the aforementioned 1DPs), which is formed by a process of panel-level processing where multiple arrays 8501 of the at least one array of 1DPs are formed on a single Dk EM structure 8500 in the form of a panel, also herein referred to by reference numeral 8500.

In an embodiment of the method 8100, the panel 8500 further includes a substrate 8508 (see any of the herein disclosed substrates, for example), or any one of a dielectric panel; a metal panel; a combination of a dielectric panel and a metal panel; a printed circuit board; a flexible circuit board; a substrate integrated waveguide, SIW; a metal panel comprising a plurality of slotted apertures disposed in a one-to-one correspondence with a given one of the plurality of 1DPs; or, an EM signal feed network.

Ninth Example Embodiment: Method 9100, Dk EM Structure 9500

Figure 9A:
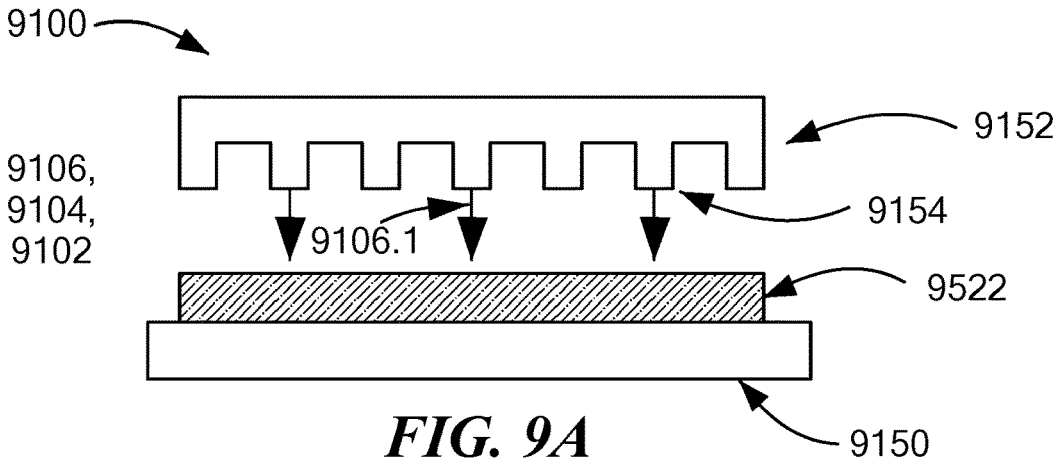
FIGS. 9A, 9B, and 9C, depict in cross section side view block diagram representations of a method of making an alternative Dk EM structure, in accordance with an embodiment.
Figure 9B:
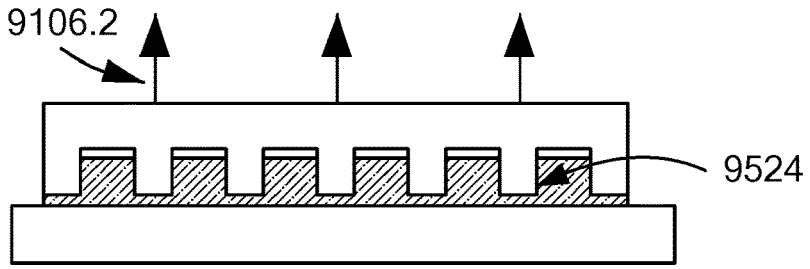
Figure 9C:
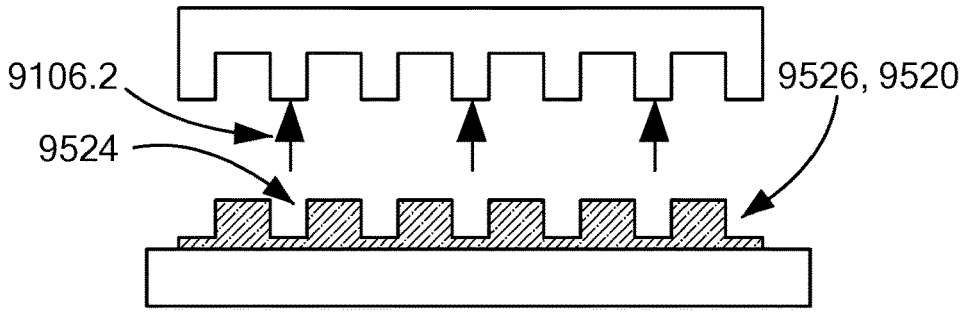
Figure 9D:
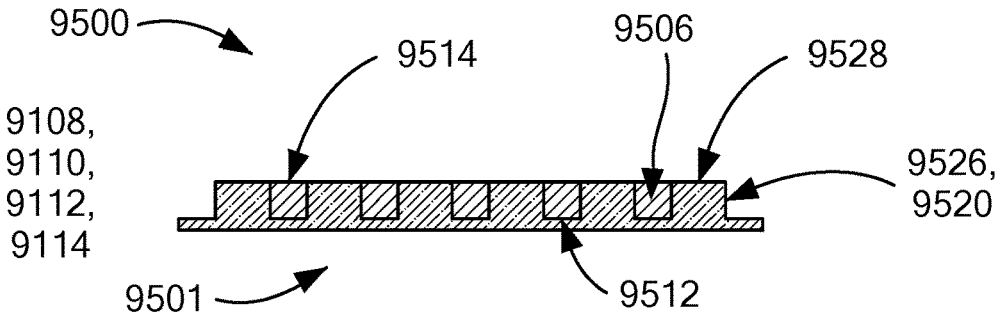
FIG. 9D depicts in cross section side view a Dk EM structure made according to the method depicted in FIGS. 9A-9C, in accordance with an embodiment.
Figure 9E:
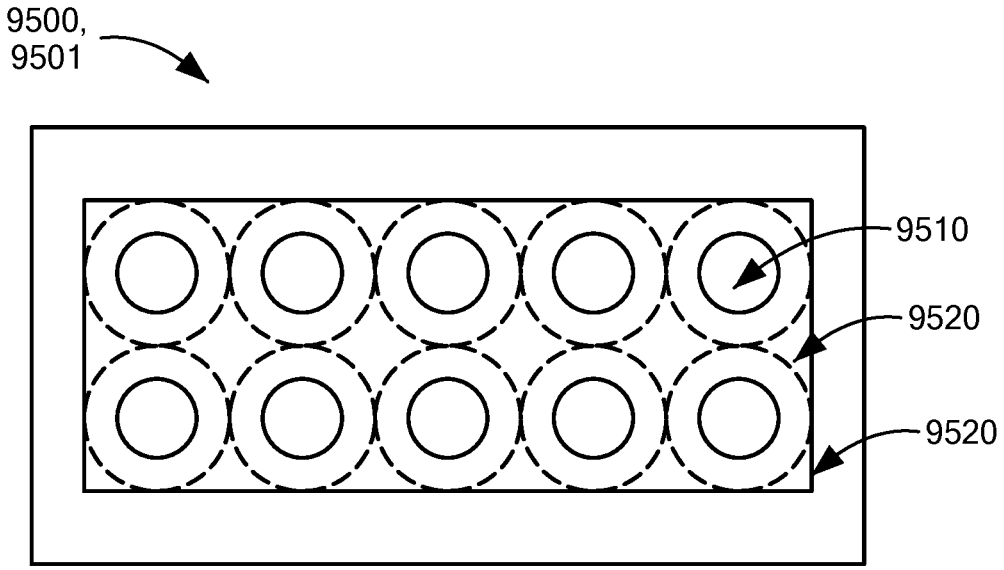
FIG. 9E depicts a top-down plan view of the Dk EM structure of FIG. 9D, in accordance with an embodiment.
Figure 9F:
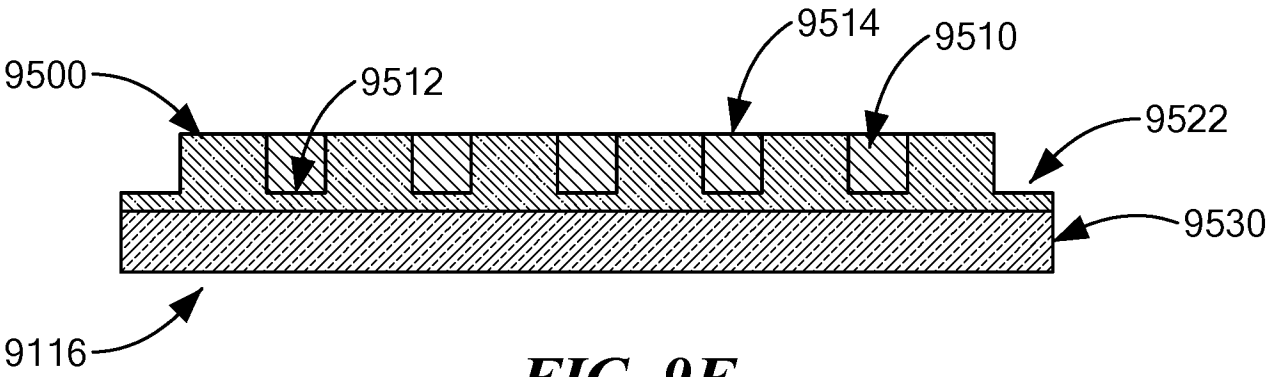
FIGS. 9F and 9G depict in cross section side view alternative Dk EM structures made according to the method depicted in FIGS. 9A-9D, in accordance with an embodiment.
Figure 9G:
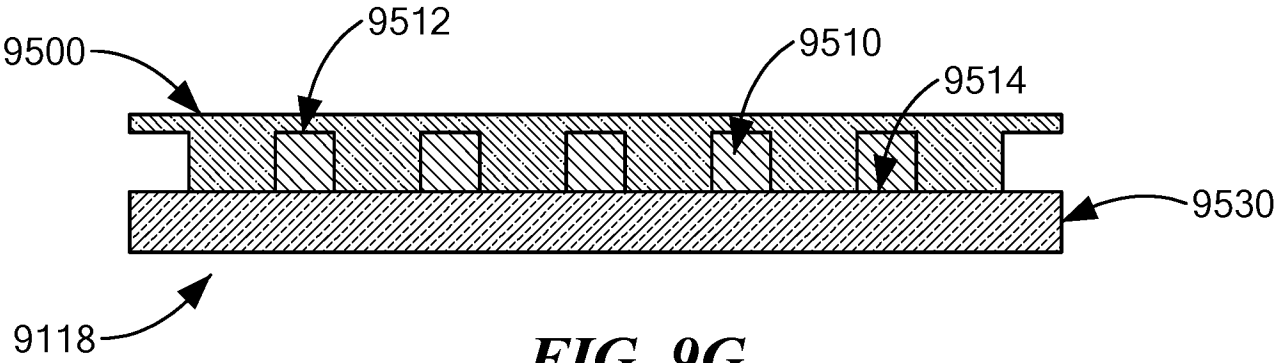

The following description of an example method 9100 of making a Dk EM structure 9500 is made with particular reference to FIGS. 9A, 9B, 9C, 9D, 9E, 9F, and 9G, collectively, where FIG. 9A depicts process steps 9102, 9104, 9106, FIG. 9B depicts process step 9106.1, FIG. 9C depicts process step 9106.2, FIG. 9D depicts process steps 9108, 9110, 9112, 9114, and a side cross section elevation view of the Dk EM structure 9500, FIG. 9E depicts a top-down plan view of the Dk EM structure 9500 having a plurality of 1DPs 9510 arranged in an array surrounded by a plurality of 2DPs 9520 (which may be rectangular as depicted by a solid line, or circular as depicted by a dashed line, or any other shape suitable for a purpose disclosed herein), FIG. 9F depicts process step 9116, and FIG. 9G depicts process step 9118 that is alternative to process step 9116.

In an embodiment and with particular reference to FIGS. 9A-9E, the example method 9100 of making the Dk EM structure 9500 (see FIGS. 9D and 9E) having a plurality of a first dielectric portion 9510, 1DP, and a plurality of a second dielectric portion 9520, 2DP, each 1DP 9510 having a proximal end 9512 and a distal end 9514, includes the following steps: a step of providing 9102 a support form 9150; a step of disposing 9104 a sheet of a polymer 9522 on the support form 9150; a step of providing a stamping form 9152 and stamping 9106, down 9106.1 then up 9106.2, the sheet of polymer 9522 supported by the support form 9150, the stamping form 9152 having a plurality of substantially identically configured projections 9154 arranged in an array, wherein the stamping 9106 results in displaced material of the sheet of polymer 9522, a plurality of depressions 9524 having a blind end arranged in the array in the sheet of polymer 9522, the plurality of depressions 9524 for forming the plurality of 1DPs 9510, and a plurality of raised walls 9526 of the sheet of polymer 9522 surrounding each one of the plurality of depressions 9524, the plurality of raised walls 9526 forming the plurality of 2DPs 9520; a step of filling 9108 a flowable form of a curable Dk composition 9506 into the plurality of depressions 9524, wherein each depression of the plurality of depressions forms a corresponding one of the plurality of 1DPs 9510 having a first average dielectric constant, wherein the sheet of polymer 9522 has a second average dielectric constant that is less than the first average dielectric constant, wherein the distal end 9514 of each 1DP 9510 is proximate an upper surface 9528 of the plurality of raised walls 9526 of the sheet of polymer 9522; optionally a step of removing 9110 any excess Dk composition above the upper surface 9528 of the plurality of raised walls 9526 of the sheet of polymer 9522, leaving the Dk composition 9506 flush with the upper surface 9528 of the plurality of raised walls 9526; a step of at least partially curing 9112 the curable Dk composition 9506 to form at least one array 9501 of the plurality of 1DPs 9510; a step of removing 9114 from the support form 9150 a resulting assembly 9500 comprising the stamped sheet of polymer material 9522 with the plurality of raised walls 9526, the plurality of depressions 9524, and the at least one array 9501 of the plurality of 1DPs 9510 formed in the plurality of depressions 9524 with the plurality of 2DPs 9520 disposed surrounding the plurality of 1DPs 9510.

In an embodiment and with particular reference to FIG. 9F in combination with FIGS. 9A-9E, the method 9100 further includes the following steps: a step of providing a substrate 9530 and placing 9116 the assembly 9500 onto the substrate 9530 with the stamped polymer sheet 9522 disposed on the substrate 9530 such that the proximal end 9512 of each 1DP 9510 is disposed proximate the substrate 9530 and the distal end 9514 of each 1DP 9510 is disposed at a distance away from the substrate 9530.

In an embodiment and with particular reference to FIG. 9G in combination with FIGS. 9A-9E, the method 9100 further includes the following steps: a step of providing a substrate 9530 and placing 9118 the assembly 9500 onto the substrate 9530 with at least the distal ends 9514 of the plurality of 1DPs 9510 disposed on the substrate 9530 and the proximal ends 9512 of the plurality of 1DPs 9510 disposed at a distance away from the substrate 9530.

In an embodiment of the method 9100, the substrate 9530 includes any one of: a dielectric panel; a metal panel; a combination of a dielectric panel and a metal panel; a printed circuit board; a flexible circuit board; a substrate integrated waveguide, SIW; a metal panel comprising a plurality of slotted apertures disposed in a one-to-one correspondence with a given one of the plurality of 1DPs; or, an EM signal feed network.

In an embodiment of the method 9100, the curable Dk composition 9506 includes a curable resin, preferably wherein the curable resin includes a Dk material.

In an embodiment of the method 9100, the curable Dk composition 9506 further includes an inorganic particulate material, preferably wherein the inorganic particulate material includes titanium dioxide.

In an embodiment of the method 9100, each of the plurality of the 1DPs 9510 has an outer cross-section shape, as observed in an x-y plane cross-section, that is circular. (see FIG. 16B, for example, and for other example shapes contemplated herein).

In an embodiment of the method 9100, each raised wall 9526 of a corresponding 2DP 9520 has an inner cross-section shape, as observed in an x-y plane cross-section, that is circular. (see FIG. 16B, for example, and for other example shapes contemplated herein).

In an embodiment of the method 9100, the step of at least partially curing 9112 includes at least partially curing the curable Dk composition at a temperature equal to or greater than about 170 degree Celsius for a time duration equal to or greater than about 1 hour.

Tenth Example Embodiment: Method 10100, Stamping Form 10500

Figure 10A:
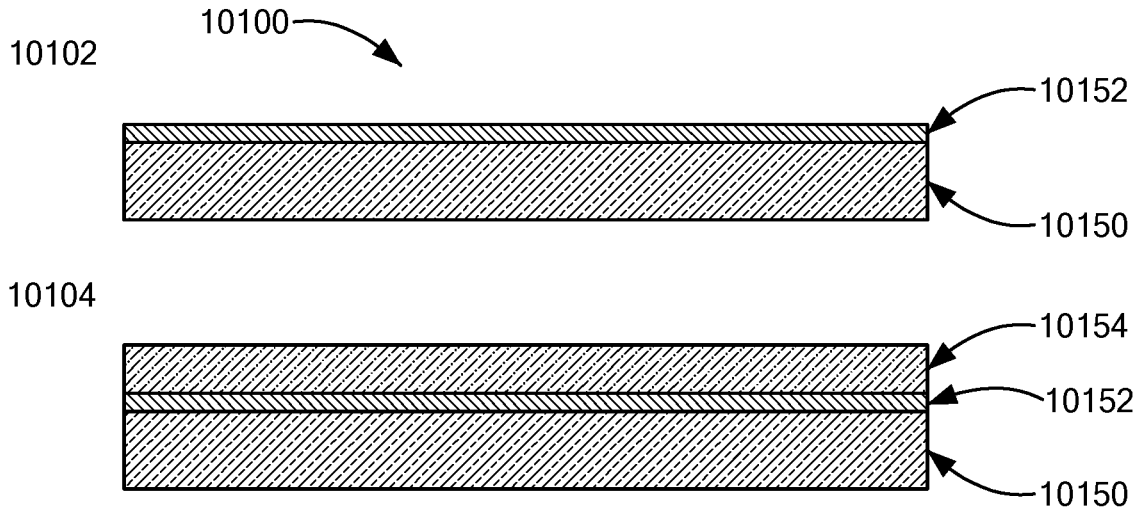
FIGS. 10A, 10B, 10C, and 10D, depict in cross section side view block diagram representations of a method of making a stamping form, in accordance with an embodiment.
Figure 10B:
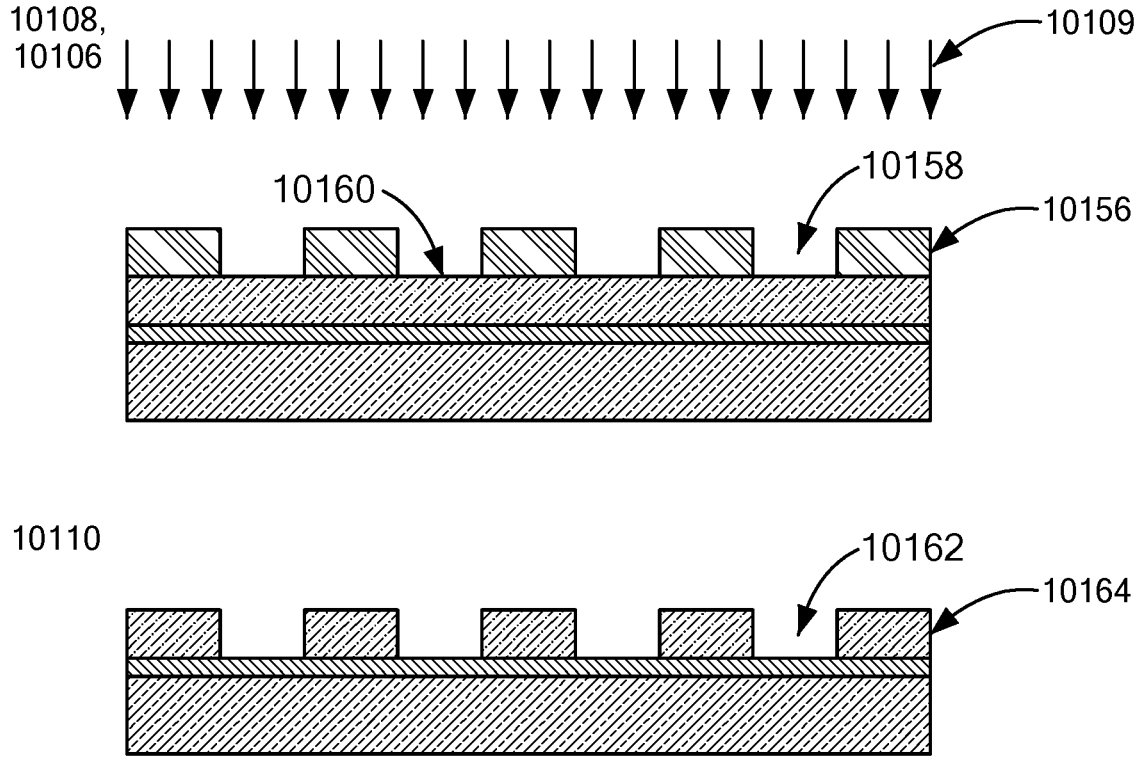
Figure 10C:
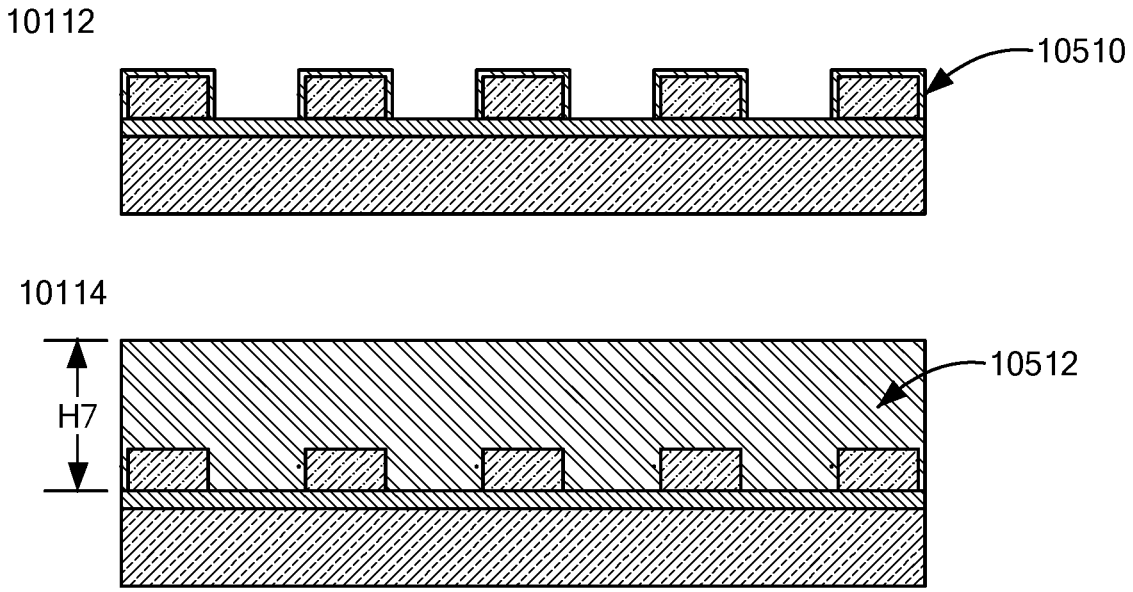
Figure 10D:
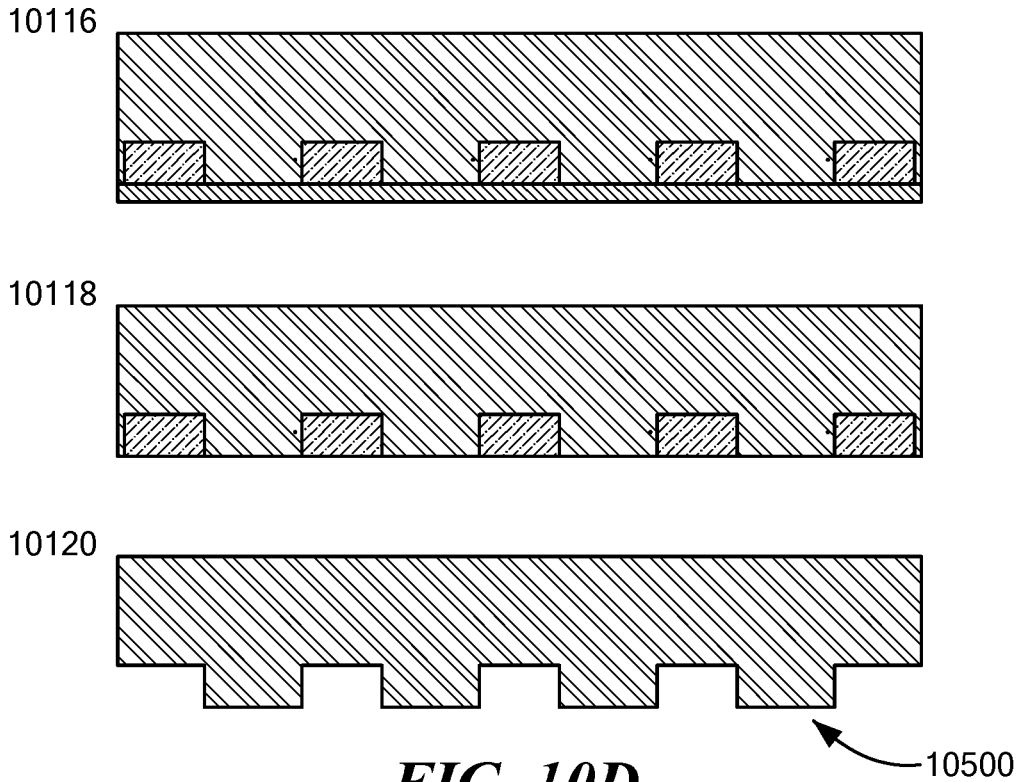

The following description of an example method 10100 of making a stamping form 10500 is made with particular reference to FIGS. 10A, 10B, 10C, and 10D, collectively, where FIG. 10A depicts method steps 10102 and 10104, FIG. 10B depicts method steps 10105, 10108, and 10110, FIG. 10C depicts method steps 10112 and 10114, FIG. 10D depicts method steps 10116, 10118, and 10120, and the resulting stamping form 10500.

In an embodiment and with particular reference to FIGS. 10A-10D, the example method 10100 is for making a stamping form 10500 (see FIG. 10D) for use in accordance with making any of the foregoing Dk EM structures formed via a stamping form, such as Dk EM structure 9500 for example, the method 10100 including the following steps: a step of providing 10102 a substrate 10150 having a metal layer 10152 on top thereof, the metal layer 10152 covering the substrate 10150; a step of disposing 10104 a photoresist 10154 on top of and covering the metal layer 10152; a step of disposing 10106 a photomask 10156 on top of the photoresist 10154, the photomask 10156 having a plurality of substantially identically configured openings 10158 arranged in an array thereby providing exposed photoresist 10160; a step of exposing 10108 at least the exposed photoresist 10160 to EM radiation 10109; a step of removing 10110 the exposed photoresist 10160 subjected to the EM radiation 10109 exposure 10108 from the metal layer 10152, resulting in a plurality of substantially identically configured pockets 10162 in the remaining photoresist 10164 arranged in the array; a step of applying 10112 a metal coating 10510 to all exposed surfaces of the remaining photoresist 10164 having the plurality of pockets therein 10162; a step of filling 10114 the plurality of pockets 10162 and covering the remaining metal coated photoresist 10510 with a stamp-suitable metal 10512 to a particular thickness, H7, relative to a top surface of the metal layer 10152; a step of removing 10116 the substrate 10150 from the bottom of the metal layer 10152; a step of removing 10118 the metal layer 10152; and, a step of removing 10120 the remaining photoresist 10164, resulting in the stamping form 10500. In an embodiment, the filling 10114 with a stamp-suitable metal 10512 includes metal electroforming, which in an embodiment includes electroplating metal using existing metal surfaces as a seed layer.

In an embodiment of the method 10100, the substrate 10150 includes any one of a metal; an electrical insulating material; a wafer; a silicon substrate or wafer; a silicon dioxide substrate or wafer; an aluminum oxide substrate or wafer; a sapphire substrate or wafer; a germanium substrate or wafer; a gallium arsenide substrate or wafer; an alloy of silicon and germanium substrate or wafer; or, an indium phosphide substrate or wafer; wherein the photoresist 10154 is a positive photoresist; wherein the EM radiation 10109 is X-ray or UV radiation; wherein the metal coating 10510 is applied via metal deposition, such as for example metal evaporation or sputtering at multiple tilt angles to achieve coverage on all sides; wherein the stamp-suitable metal 10512 includes nickel or a nickel alloy; wherein the substrate 10150 is removed 10116 via etching or grinding; wherein the metal layer 10152 is removed 10118 via polishing, etching, or a combination of polishing and etching; and, wherein the exposed photoresist 10160 and the remaining photoresist 10164 are removed 10120 via etching.

In an embodiment, the photoresist layer may also be a low-water-absorption resist layer (e.g., less than 1% water absorption by volume).

Eleventh Example Embodiment: Method 11100, Dk EM Structure 11500

Figure 11A:
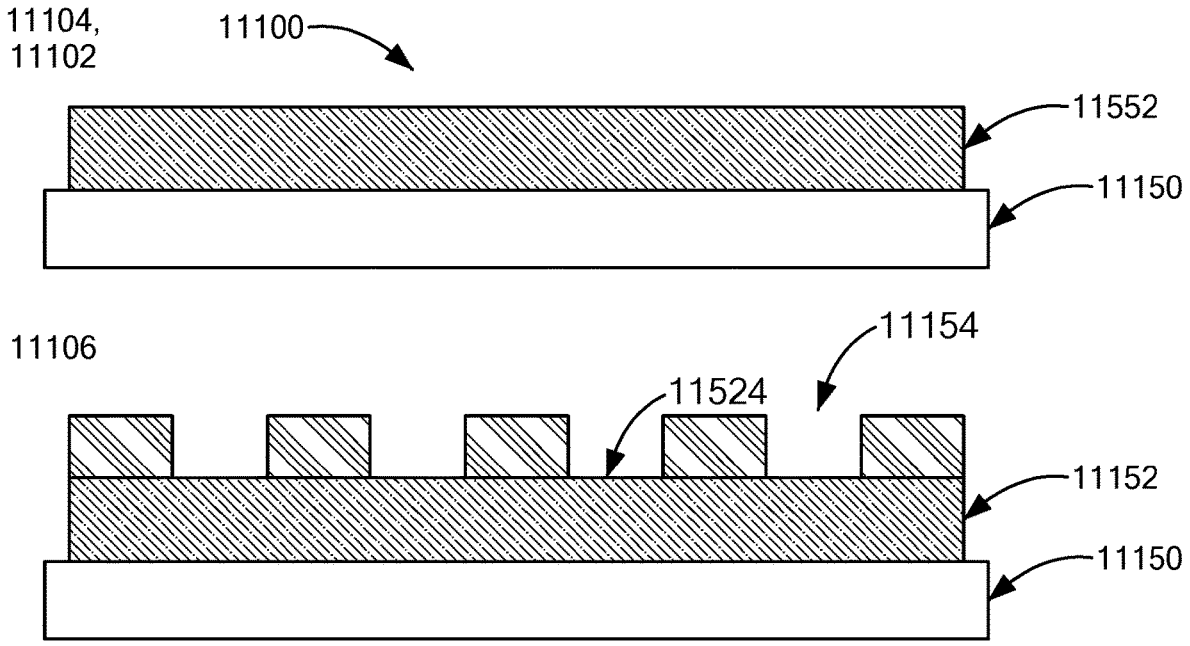
FIGS. 11A and 11B depict in cross section side view block diagram representations of an alternative method of making an alternative Dk EM structure, in accordance with an embodiment.
Figure 11B:
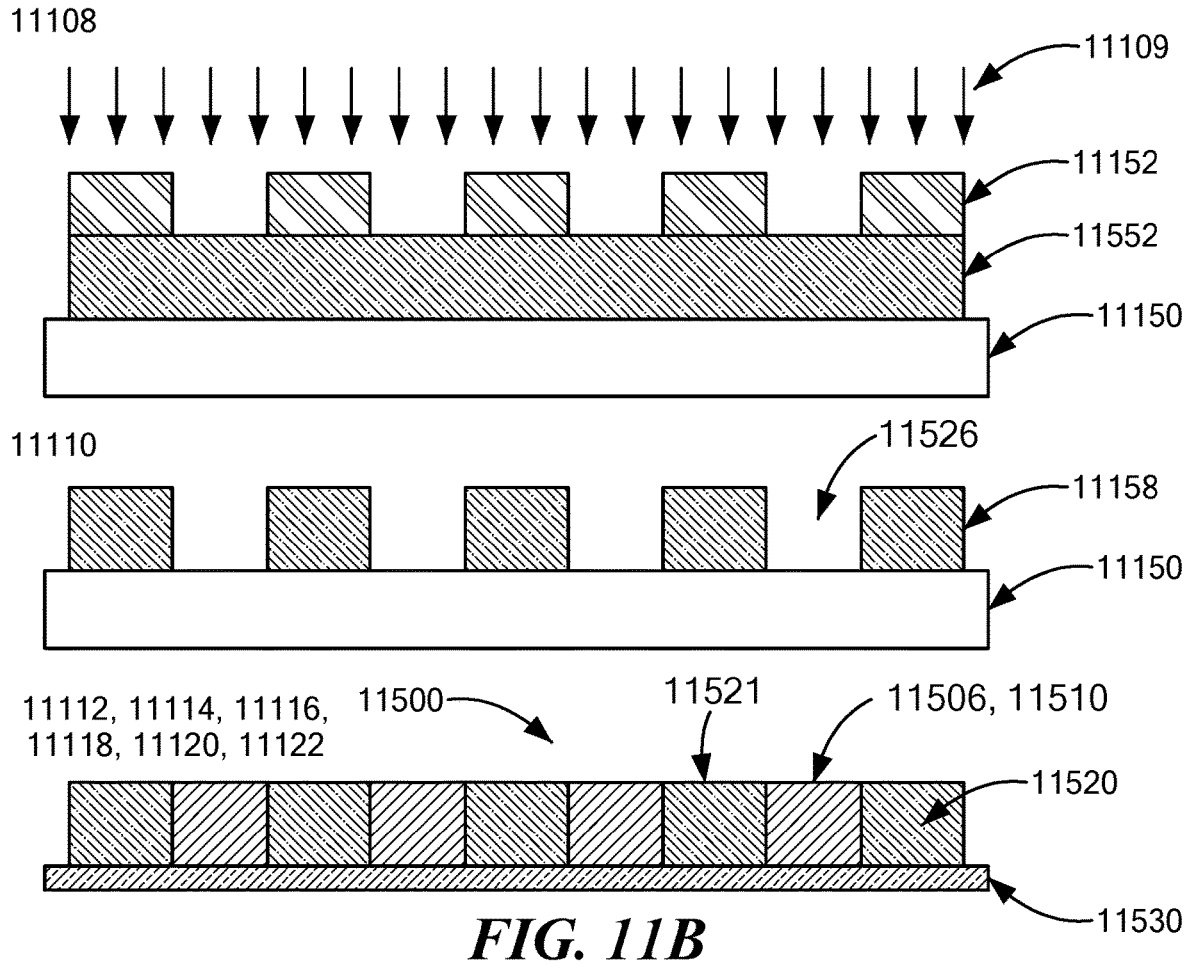

The following description of an example method 11100 of making a Dk EM structure 11500 is made with particular reference to FIGS. 11A, and 11B, collectively, where FIG. 11A depicts method steps 11102, 11104, and 11106, and FIG.

11B depicts method steps 11108, 11110, 11112, 11114, 11116, 11118, 11120, and 11122, and the resulting Dk EM structure 11500.

In an embodiment and with particular reference to FIGS. 11A-11B, the example method 11100 of making the Dk EM structure 11500 having a plurality of a first dielectric portion 11510, 1DP, and a plurality of a second dielectric portion 11520, 2DP, includes the following steps: a step of providing 11102 a support form 11150; a step of disposing 11104 a layer of photoresist 11522 on top of the support form 11150; a step of disposing 11106 a photomask 11152 on top of the photoresist 11522, the photomask 11152 having a plurality of substantially identically configured openings 11154 arranged in an array thereby providing exposed photoresist 11524; a step of exposing 11108 at least the exposed photoresist 11524 to EM radiation 11109; a step of removing 11110 the exposed photoresist 11524 subjected to the EM radiation 11109 exposure 11108 from the support form 11150, resulting in a plurality of the substantially identically configured openings 11526 in the remaining photoresist 11528 arranged in the array; a step of filling 11112 a flowable form of a curable Dk composition 11506 into the plurality of openings 11526 in the remaining photoresist 11528, wherein the plurality of filled openings 11526 provide corresponding ones of the plurality of 1DPs 11510 having a first average dielectric constant, wherein the remaining photoresist provides the plurality of 2DPs 11520 having a second average dielectric constant that is less than the first average dielectric constant; optionally a step of removing 11114 any excess Dk composition 11506 above an upper surface 11521 of the plurality of 2DPs 11520, leaving the Dk composition 11506 flush with the upper surface 11521 of the plurality of 2DPs 11520; a step of at least partially curing 11116 the curable Dk composition 11506 to form at least one array of the plurality of 1DPs 11510; a step of removing 11118 from the support form 11150 a resulting assembly 11500 having the plurality of 2DPs 11520 and the at least one array of the plurality of 1DPs 11510 formed therein.

In an embodiment, the method 11100 further includes the following steps: a step of providing 11120 a substrate 11530 and adhering 11122 the resulting assembly 11500 to the substrate 11530; wherein the substrate 11530 includes any one of: a dielectric panel; a metal panel; a combination of a dielectric panel and a metal panel; a printed circuit board; a flexible circuit board; a substrate integrated waveguide, SIW; a metal panel comprising a plurality of slotted apertures disposed in a one-to-one correspondence with a given one of the plurality of 1DPs; or, an EM signal feed network; wherein the photoresist 11522 is a positive photoresist; wherein the EM radiation 11109 is X-ray or UV radiation; wherein the exposed photoresist 11524 and the remaining photoresist 11528 are removed 11110 via etching; wherein the step of at least partially curing 11116 includes curing the curable Dk composition 11506 at a temperature equal to or greater than about 170 degree Celsius for a time duration equal to or greater than about 1 hour.

In an embodiment of the method 11100, the curable Dk composition 11506 includes a curable resin, preferably wherein the curable resin includes a Dk material.

In an embodiment of the method 11100, the curable Dk composition 11506 further includes an inorganic particulate material, preferably wherein the inorganic particulate material includes titanium dioxide.

In an embodiment of the method 11100, each of the plurality of the 1DPs 11510 has an outer cross-section shape, as observed in an x-y plane cross-section, that is circular. (see FIG. 16B, for example, and for other example shapes contemplated herein).

In an embodiment of the method 11100, each opening 11526 of a corresponding one of the plurality of 2DPs 11520 has an inner cross-section shape, as observed in an x-y plane cross-section, that is circular. (see FIG. 16B, for example, and for other example shapes contemplated herein).

Twelfth Example Embodiment: Method 12100, Dk EM Structure 12500

Figure 12A:
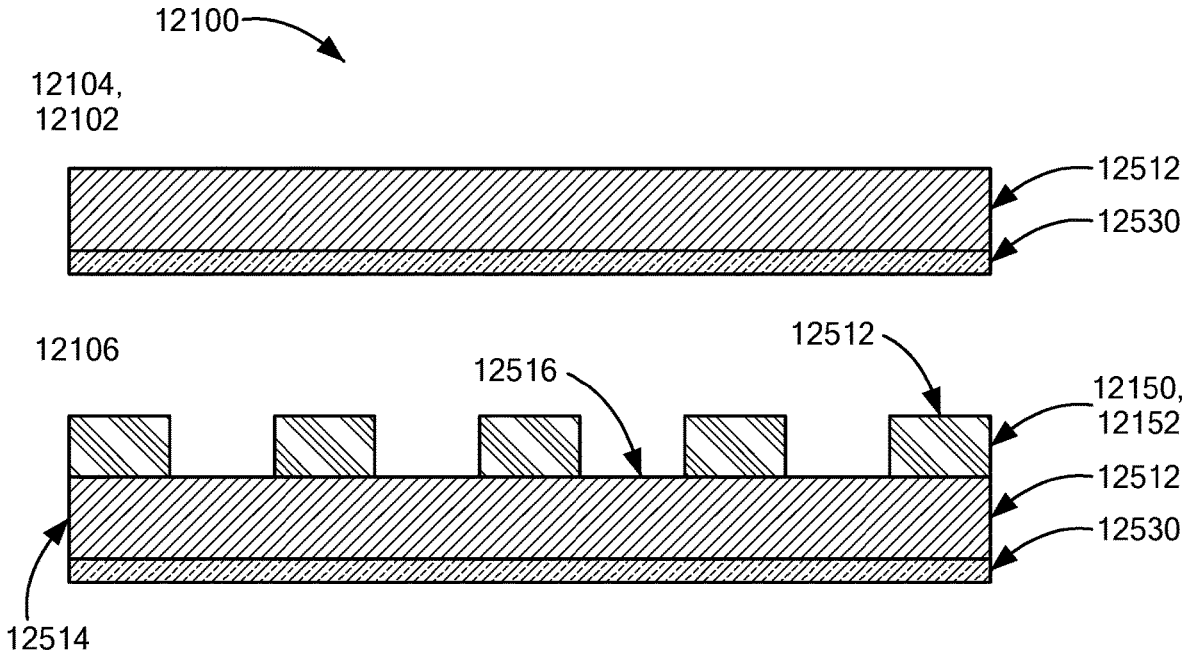
FIGS. 12A, 12B, and 12C, depict in cross section side view block diagram representations of an alternative method of making an alternative Dk EM structure, in accordance with an embodiment.
Figure 12B:
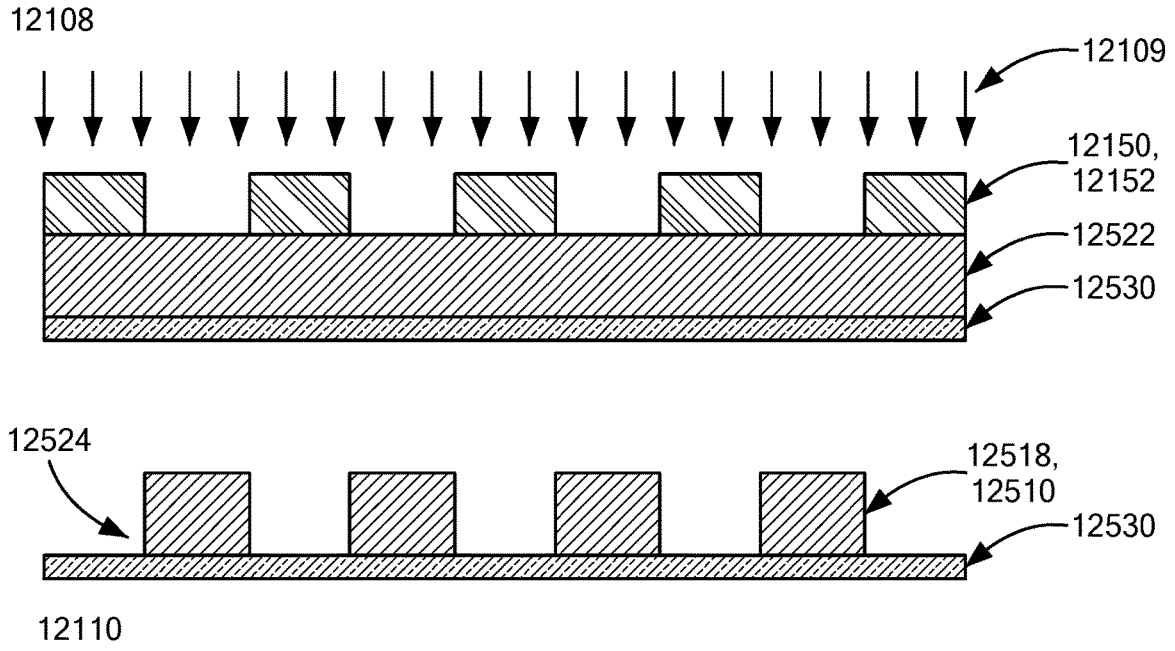
Figure 12C:
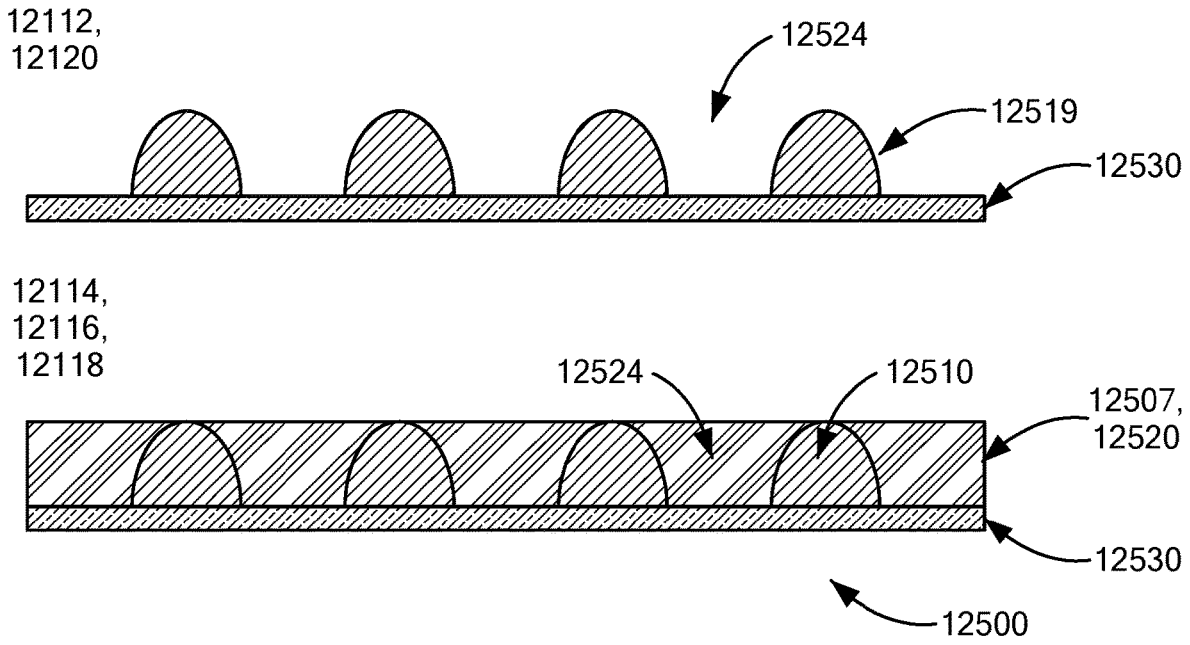

The following description of an example method 12100 of making a Dk EM structure 12500 is made with particular reference to FIGS. 12A, 12B and 12C, collectively, where FIG. 12A depicts method steps 12102, 12104 and 12106, FIG. 12B depicts method steps 12108 and 12110, and FIG. 12C depicts method steps 12112, 12114, 12116, 12118, and 12120, and the resulting Dk EM structure 12500.

In an embodiment and with particular reference to FIGS. 12A-12C, the example method 12100 of making the Dk EM structure 12500 having a plurality of a first dielectric portion 12510, 1DP, and a plurality of a second dielectric portion 12520, 2DP, includes the following steps: a step of providing 12102 a substrate 12530; a step of disposing 12104 a layer of photoresist 12512 on top of the substrate 12530; a step of disposing 12106 a photomask 12150 on top of the photoresist 12512, the photomask 12150 having a plurality of substantially identically configured opaque covers 12152 arranged in an array, thereby providing non-exposed photoresist 12514 in areas covered by the opaque covers 12152, and exposed photoresist 12516 in areas not covered by the opaque covers 12152; a step of exposing 12108 at least the exposed photoresist 12516 to EM radiation 12109; a step of removing 12110 the non-exposed photoresist 12514 from the substrate 12530, resulting in a plurality of substantially identically configured portions of remaining photoresist 12518 arranged in the array that form corresponding ones of the plurality of 1DPs 12510 having a first average dielectric constant; optionally a step of shaping 12112 via a stamping form (see FIG. 13C for example) each 1DP 12510 (or remaining photoresist 12518) of the plurality of 1DPs into a dome structure having a convex distal end 12519; a step of filling 12114 a flowable form of a curable Dk composition 12507 into spaces 12524 between the plurality of 1DPs 12510, wherein the filled spaces 12524 provide corresponding ones of the plurality of 2DPs 12520 having a second average dielectric constant that is less than the first average dielectric constant; optionally a step of removing 12116 any excess Dk composition above an upper surface of the plurality of 1DPs 12510, leaving the Dk composition 12507 flush with the upper surface of the plurality of 1DPs 12510; a step of at least partially curing 12118 the curable Dk composition 12507, resulting in the Dk EM structure 12500 in the form of at least one array of the plurality of 1DPs 12510 surrounded by the plurality of 2DPs 12520.

In an embodiment of the method 12100, the step of optionally shaping 12112 includes shaping via application of the stamping form (see FIG. 13C for example) to the plurality of 1DPs 12519 at a temperature that causes reflow but not curing of the photoresist 12518, followed by at least partially curing 12120 the shaped plurality of 1DPs 12519 to maintain the dome shape.

In an embodiment of the method 12100, the substrate 12530 includes any one of a dielectric panel; a metal panel; a combination of a dielectric panel and a metal panel; a printed circuit board; a flexible circuit board; a substrate integrated waveguide, SIW; a metal panel comprising a plurality of slotted apertures disposed in a one-to-one correspondence with a given one of the plurality of 1DPs; or, an EM signal feed network; wherein the photoresist 12512 is a positive photoresist; wherein the EM radiation 12109 is X-ray or UV radiation; wherein the non-exposed photoresist 12514 is removed 12110 via etching; and, wherein the step of at least partially curing 12118 includes curing the curable Dk composition at a temperature equal to or greater than about 170 degree Celsius for a time duration equal to or greater than about 1 hour.

In an embodiment of the method 12100, the curable Dk composition 12507 includes a curable resin, preferably wherein the curable resin includes a Dk material.

In an embodiment of the method 12100, the curable Dk composition further includes an inorganic particulate material, preferably wherein the inorganic particulate material includes titanium dioxide.

In an embodiment of the method 12100, each of the plurality of the 1DPs 12510 has an outer cross-section shape, as observed in an x-y plane cross-section, that is circular. (see FIG. 16B, for example, and for other example shapes contemplated herein).

In an embodiment of the method 12100, each opaque cover 12152 has an outer shape, as observed in an x-y plane plan view, that is circular. (see FIG. 16B, for example, and for other example shapes contemplated herein).

Thirteenth Example Embodiment: Method 13100, Stamping Form 13500

Figure 13A:
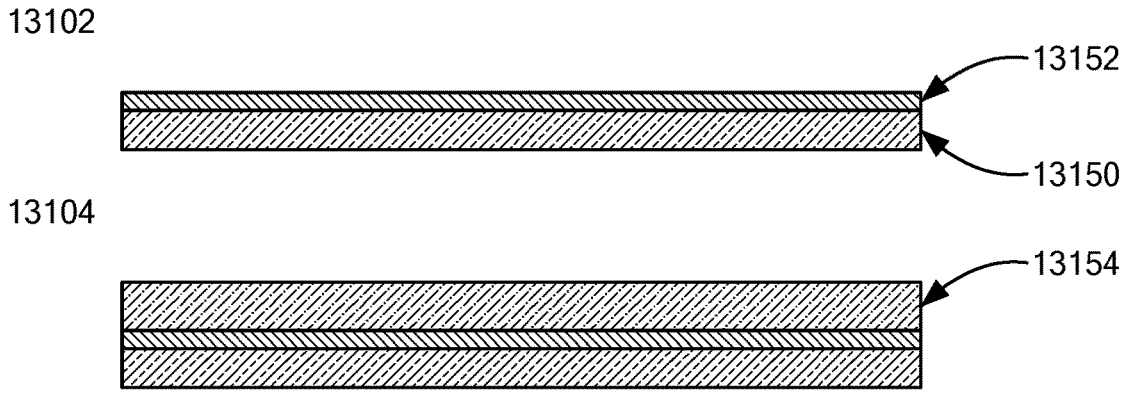
FIGS. 13A, 13B, and 13C, depict in cross section side view block diagram representations of a method of making an alternative stamping form, in accordance with an embodiment.
Figure 13B:
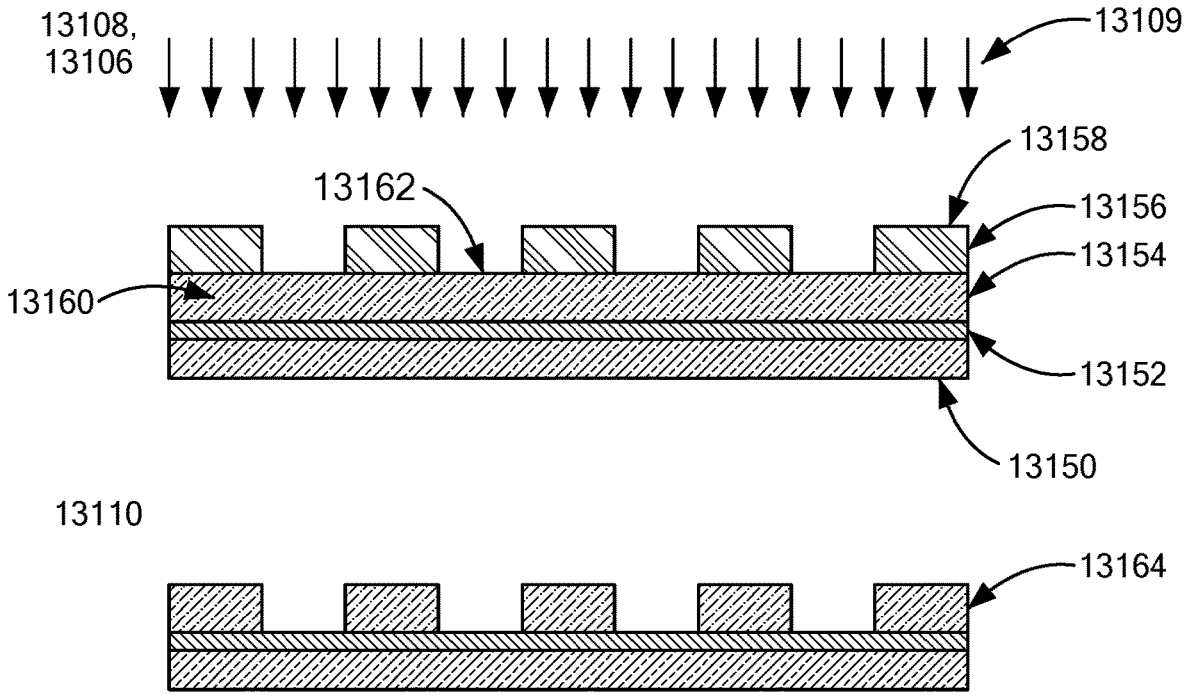
Figure 13C:
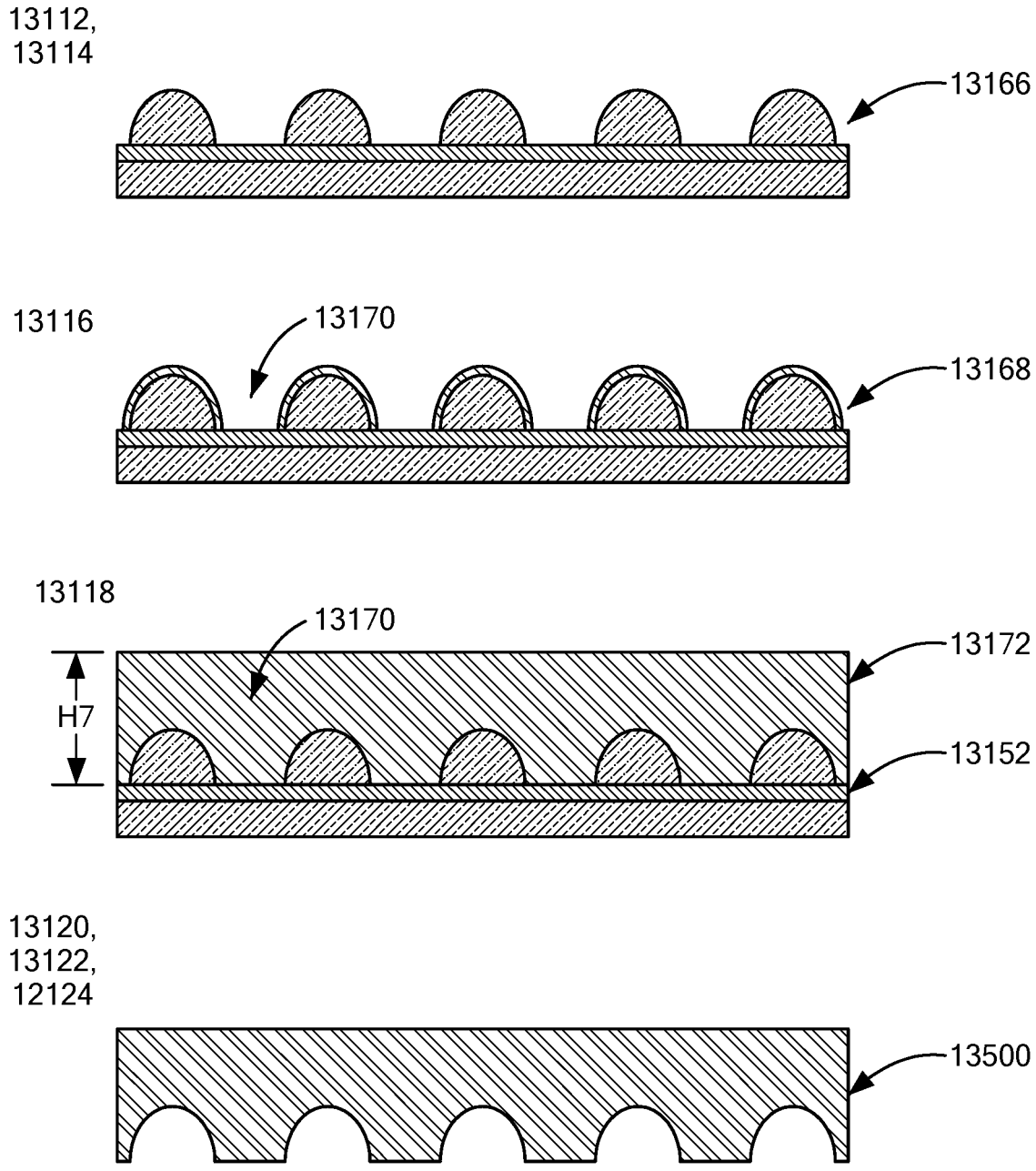

The following description of an example method 13100 of making a stamping form 13500 is made with particular reference to FIGS. 13A, 13B and 13C, collectively, where FIG. 13A depicts method steps 13102, 13104, FIG. 13B depicts method steps 13106, 13108, 13110, and FIG. 13C depicts method steps 13112, 13114, 13116, 13118, 13120, 13122, and 13124, and a resulting stamping form 13500.

In an embodiment, the example method 13100 is useful for making the stamping form 13500 for use in accordance with making Dk EM structure 12500, and more particularly in making the plurality of 1DPs 12510 into a dome structure having a convex distal end 12519, the method 13100 including the following steps: a step of providing 13102 a substrate 13150 having a metal layer 13152 on top thereof, the metal layer 13152 covering the substrate 13150; a step of disposing 13104 a layer of photoresist 13154 on top of and covering the metal layer 13152; a step of disposing 13106 a photomask 13156 on top of the photoresist 13154, the photomask 13156 having a plurality of substantially identically configured opaque covers 13158 arranged in an array, thereby providing non-exposed photoresist 13160 in areas covered by the opaque covers 13158, and exposed photoresist 13162 in areas not covered by the opaque covers 13158; a step of exposing 13108 at least the exposed photoresist 13162 to EM radiation 13109; a step of removing 13110 the exposed photoresist 13162 subjected to the EM radiation 13109 exposure 13108 from the metal layer 13152, resulting in a plurality of substantially identically configured portions of remaining photoresist 13164 arranged in the array; a step of shaping 13112 via application of shaping form (see stamping form 15500 in FIG. 15B for example) to each of the plurality of substantially identically configured portions of remaining photoresist 13164 at a temperature that causes reflow but not curing of the photoresist 13164 to form a shaped photoresist 13166, followed by at least partially curing 13114 the shaped plurality of substantially identically configured portions of remaining photoresist to maintain the plurality of substantially identically formed shapes 13166, in an embodiment the formed shapes 13166 are a dome structure having a convex distal end; a step of applying 13116 a metal coating 13168 to all exposed surfaces of the remaining photoresist having the substantially identically formed shapes 13166; a step of filling 13118 the spaces 13170 between the substantially identically formed shapes 13166 and covering the remaining metal coated photoresist with a stamp-suitable metal 13172 to a particular thickness, H7, relative to a top surface of the metal layer 13152; a step of removing 13120 the substrate 13150 from the bottom of the metal layer 13152; a step of removing 13122 the metal layer 13152; and, a step of removing 13124 the remaining photoresist 13166, resulting in the stamping form 13500.

In an embodiment of the method 13100, the substrate 13150 includes any one of a metal; an electrical insulating material; a wafer; a silicon substrate or wafer; a silicon dioxide substrate or wafer; an aluminum oxide substrate or wafer; a sapphire substrate or wafer; a germanium substrate or wafer; a gallium arsenide substrate or wafer; an alloy of silicon and germanium substrate or wafer; or, an indium phosphide substrate or wafer; wherein the photoresist 13154 is a positive photoresist; wherein the EM radiation 13108 is X-ray or UV radiation; wherein the metal coating 13168 is applied via metal deposition; wherein the stamp-suitable metal 13172 includes nickel; wherein the substrate 13150 is removed 13120 via etching or grinding; wherein the metal layer 13152 is removed 13122 via polishing, etching, or a combination of polishing and etching; and, wherein the exposed photoresist 13162 and the remaining photoresist 13166 are removed via etching.

Fourteenth Example Embodiment: Method 14100, Dk EM Structure 14500

Figure 14A:
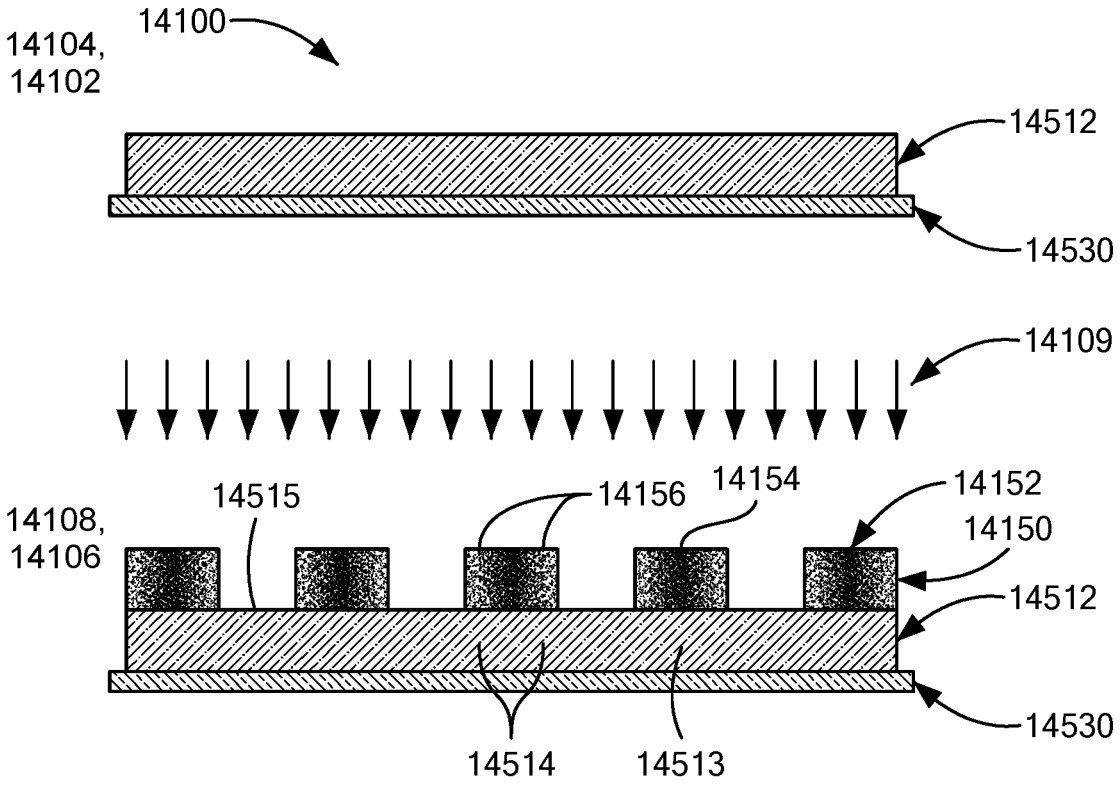
FIGS. 14A and 14B depict in cross section side view block diagram representations of an alternative method of making an alternative Dk EM structure, in accordance with an embodiment.
Figure 14B:
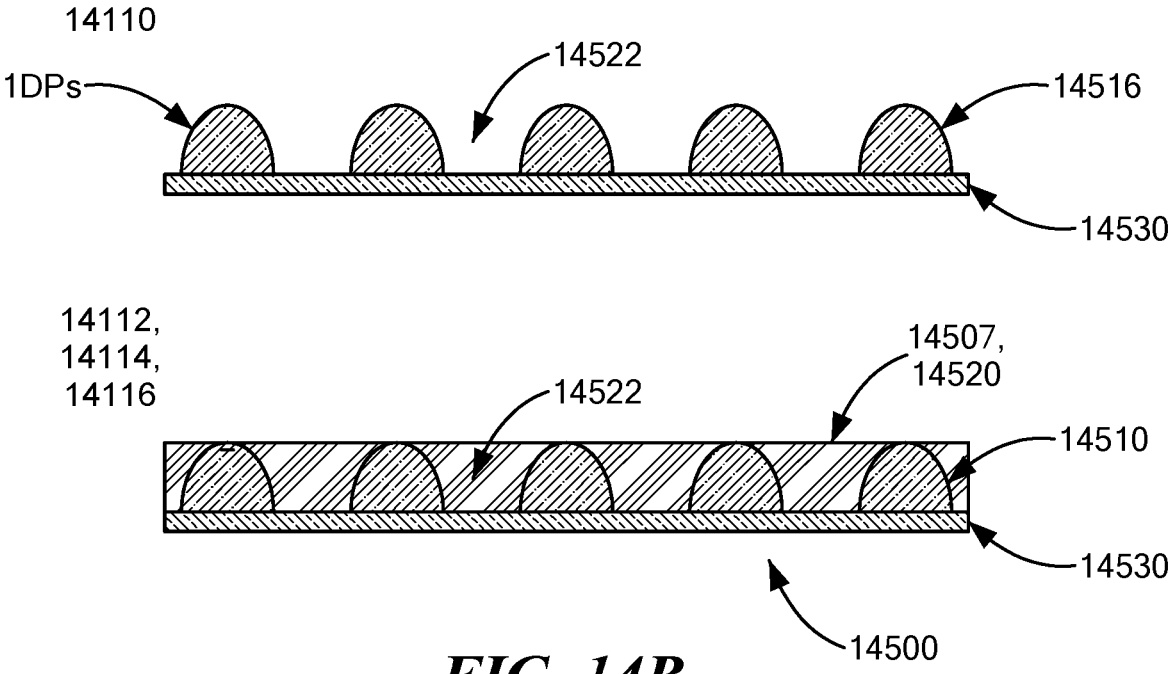

The following description of an example method 14100 of making a Dk EM structure 14500 is made with particular reference to FIGS. 14A and 14B, collectively, where FIG. 14A depicts method steps 14102, 14104, 14106, and 14108, and FIG. 14B depicts method steps 14110, 14112, 14114, and 14116, and resulting Dk EM structure 14500.

In an embodiment, the example method 14100 of making the Dk EM structure 14500 having a plurality of a first dielectric portion 14510, 1DP, and a plurality of a second dielectric portion 14520, 2DP, includes the following steps: a step of providing 14102 a substrate 14530; a step of disposing 14104 a layer of photoresist 14512 on top of the substrate 14530; a step of disposing 14106 a grayscale photomask 14150 on top of the photoresist 14512, the grayscale photomask 14150 having a plurality of substantially identically configured covers 14152 arranged in an array, the covers 14152 of the grayscale photomask 14150 having an opaque axially central region 14154 transitioning radially outward to a partially translucent outer region 14156, thereby providing substantially non-exposed photoresist 14513 in areas covered by the opaque central region 14154, partially exposed photoresist 14514 in areas covered by the partially translucent region 14156, and fully exposed photoresist 14515 in areas not covered by the covers 14152 at all; a step of exposing 14108 the grayscale photomask 14150 and the fully exposed photoresist 14515 to EM radiation 14109; a step of removing 14110 the partially exposed photoresist 14514 and the fully exposed photoresist 14515 subjected to the EM radiation 14109 exposure 14108, resulting in a plurality of substantially identically shaped forms of remaining photoresist 14516 arranged in the array that forms the plurality of 1DPs 14510 having a first average dielectric constant, in an embodiment the shaped forms 14516 are a dome structure having a convex distal end; a step of filling 14112 a flowable form of a curable Dk composition 14507 into spaces 14522 between the plurality of 1DPs 14510, wherein the filled spaces provide corresponding ones of the plurality of 2DPs 14520 having a second average dielectric constant that is less than the first average dielectric constant; optionally a step of removing 14114 any excess Dk composition 14507 above an upper surface of the plurality of 1DPs 14510, leaving the Dk composition 14507 flush with the upper surface of the plurality of 1DPs 14510; a step of at least partially curing 14116 the curable Dk composition 14507, resulting in an assembly 14500 having the substrate 14530 and the at least one array of the plurality of 1DPs 14510 having the substantially identically shaped forms 14516 surrounded by the plurality of 2DPs 14520 disposed on the substrate 14530. In an embodiment, the photoresist 14512 is a relatively high Dk material (first average dielectric constant) that may be unfilled, or filled with a ceramic filler for example.

In an embodiment of the method 14100, the substrate 14530 includes any one of a dielectric panel; a metal panel; a combination of a dielectric panel and a metal panel; a printed circuit board; a flexible circuit board; a substrate integrated waveguide, SIW; a metal panel comprising a plurality of slotted apertures disposed in a one-to-one correspondence with a given one of the plurality of 1DPs; or, an EM signal feed network; wherein the photoresist 14512 is a positive photoresist; wherein the EM radiation 14109 is X-ray or UV radiation; wherein the partially 14514 and fully 14515 exposed photoresist is removed 14110 via etching; wherein the step of at least partially curing 14116 includes curing the curable Dk composition at a temperature equal to or greater than about 170 degree Celsius for a time duration equal to or greater than about 1 hour.

In an embodiment of the method 14100, the curable Dk composition 14507 includes a curable resin, preferably wherein the curable resin includes a Dk material.

In an embodiment of the method 14100, the curable Dk composition 14507 further includes an inorganic particulate material, preferably wherein the inorganic particulate material includes titanium dioxide.

In an embodiment of the method 14100, each of the plurality of the 1DPs 14510 has an outer cross-section shape, as observed in an x-y plane cross-section, that is circular. (see FIG. 16B, for example, and for other example shapes contemplated herein).

In an embodiment of the method 14100, each of the plurality of the 1DPs 14510 has any one of a dome shape; a conical shape; a frustoconical shape; a cylindrical shape; a ring shape; or, a rectangular shape. (see FIG. 16A, for example, and for other example shapes contemplated herein).

Fifteenth Example Embodiment: Method 15100, Stamping Form 15500

Figure 15A:
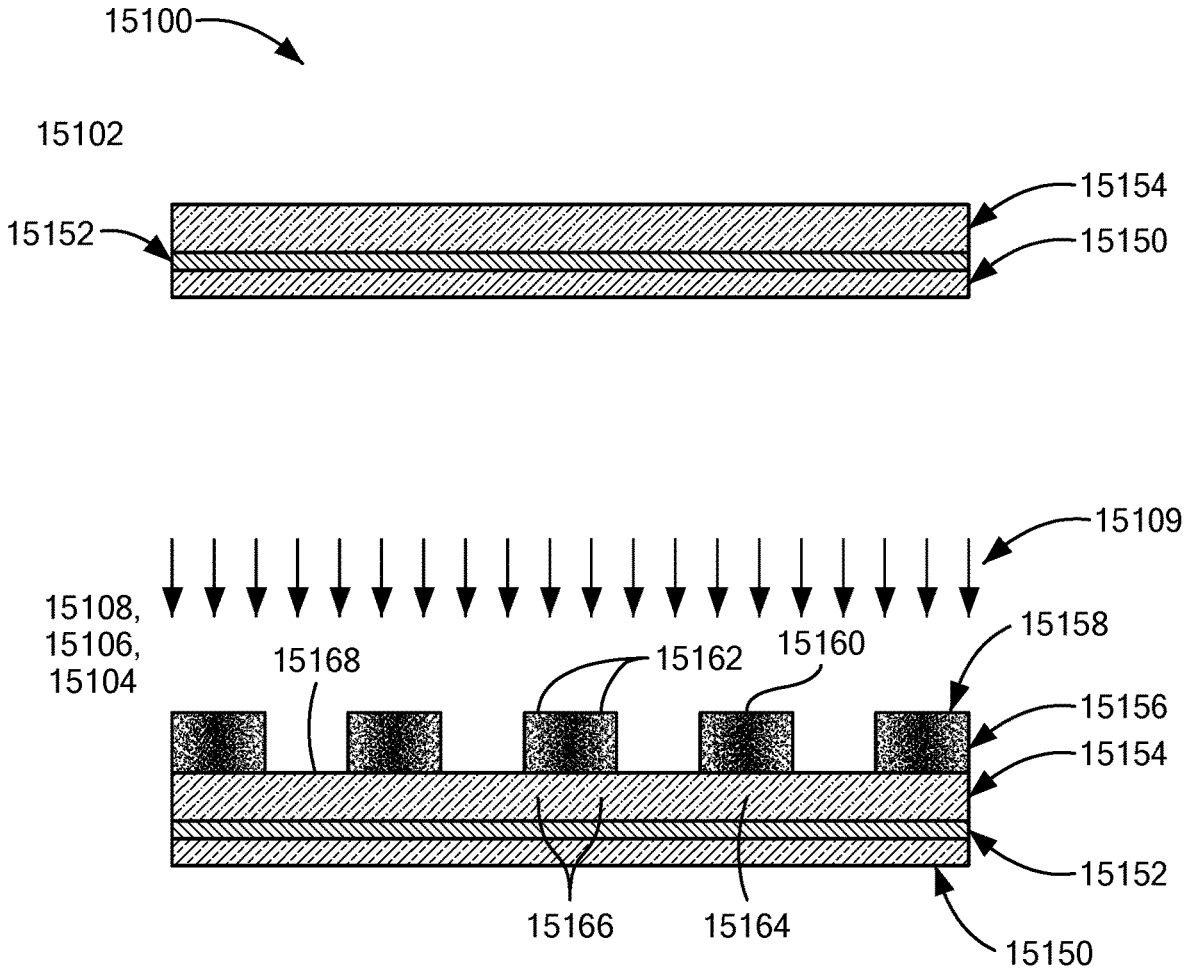
FIGS. 15A and 15B depict in cross section side view block diagram representations of a method of making an alternative stamping form, in accordance with an embodiment.
Figure 15B:
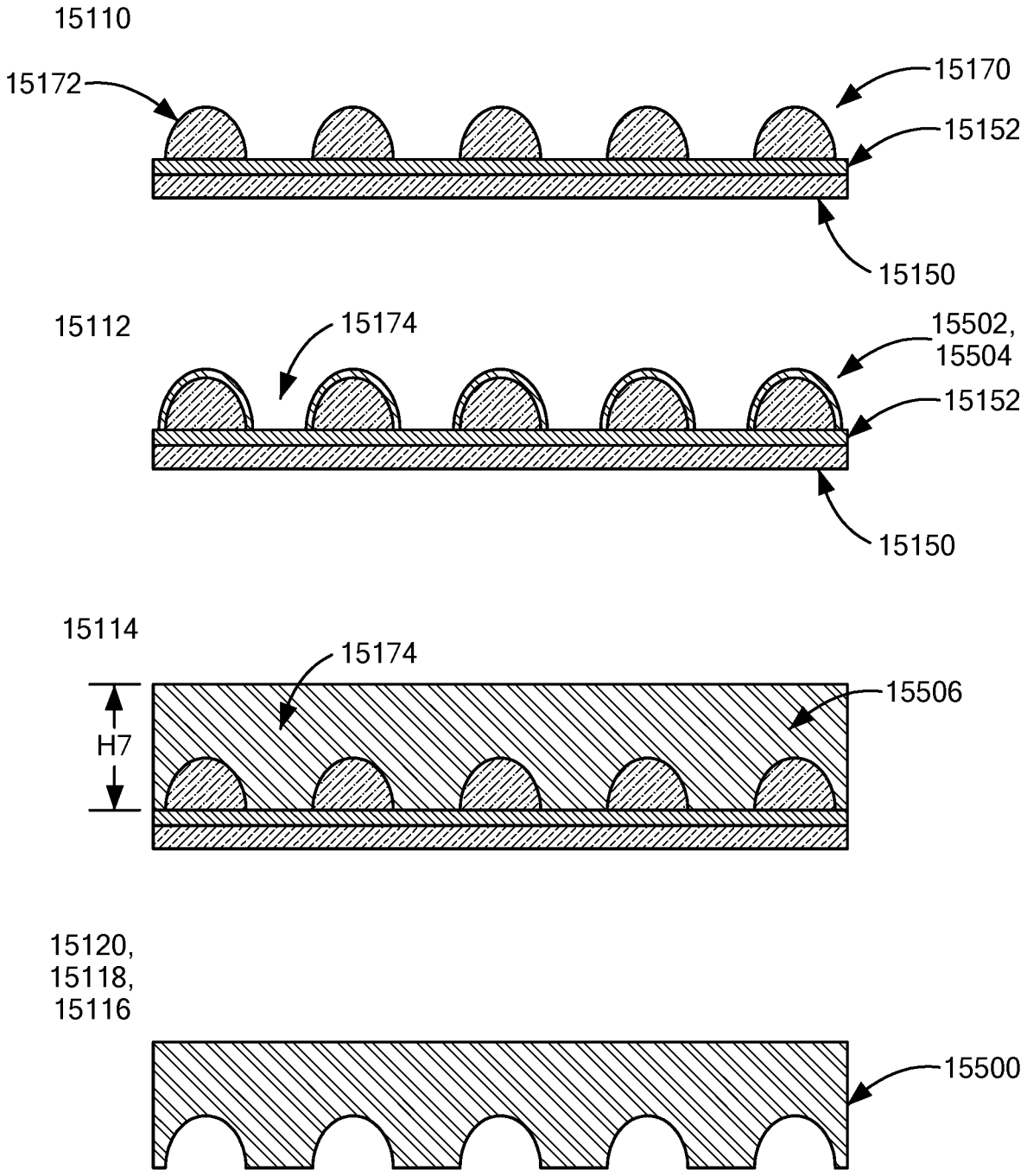

The following description of an example method 15100 of making a stamping form 15500 is made with particular reference to FIGS. 15A and 15B, collectively, where FIG. 15A depicts method steps 15102, 15104, 15106, and 15108, and FIG. 15B depicts method steps 15110, 15112, 15114, 15116, 15118, and 15120, and resulting stamping form 15500.

In an embodiment, the example method 15100 is useful for making the stamping form 15500 for use in accordance with making Dk EM structure 12500, the method 15100 including the following steps: a step of providing 15102 a substrate 15150 having a metal layer 15152 on top thereof, the metal layer 15152 covering the substrate 15150; a step of disposing 15104 a layer of photoresist 15154 on top of and covering the metal layer 15152; a step of disposing 15106 a grayscale photomask 15156 on top of the photoresist 15154, the grayscale photomask 15156 having a plurality of substantially identically configured covers 15158 arranged in an array, the covers 15158 of the grayscale photomask 15156 having an opaque axially central region 15160 transitioning radially outward to a partially translucent outer region 15162, thereby providing non-exposed photoresist 15164 in areas covered by the opaque region 15160, partially exposed photoresist 15166 in areas covered by the partially translucent region 15162, and fully exposed photoresist 15168 in areas not covered by the covers 15158; a step of exposing 15108 the grayscale photomask 15156 and the fully exposed photoresist 15168 to EM radiation 15109; a step of removing 15110 the partially 15166 and fully 15168 exposed photoresist subjected to the EM radiation 15109 exposure 15108, resulting in a plurality of substantially identically shaped forms 15170 of remaining photoresist 15172 arranged in the array, in an embodiment the shaped forms 15170 are a dome structure having a convex distal end; applying 15112 a metal coating 15502 to all exposed surfaces of the remaining photoresist 15172 having the substantially identically shaped forms 15170; a step of filling 15114 the spaces 15174 between the metal coated substantially identically shaped forms 15504 and covering the metal coated substantially identically shaped forms 15504 with a stamp-suitable metal 15506 to a particular thickness, H7, relative to atop surface of the metal layer 15152; a step of removing 15116 the substrate 15150 from the bottom of the metal layer 15152; a step of removing 15118 the metal layer 15152; and, a step of removing 15120 the remaining photoresist 15170, resulting in the stamping form 15500.

In an embodiment of the method 15100, the substrate 15150 includes any one of: a metal; an electrical insulating material; a wafer; a silicon substrate or wafer; a silicon dioxide substrate or wafer; an aluminum oxide substrate or wafer; a sapphire substrate or wafer; a germanium substrate or wafer; a gallium arsenide substrate or wafer; an alloy of silicon and germanium substrate or wafer; or, an indium phosphide substrate or wafer; the photoresist 15154 is a positive photoresist; the EM radiation 15109 is X-ray or UV radiation; the metal coating 15502 is applied via metal deposition; the stamp-suitable metal 15504 includes nickel; the substrate 15150 is removed via etching or grinding; the metal layer 15152 is removed via polishing, etching, or a combination of polishing and etching; and the exposed photoresist 15168 and the remaining photoresist 15170 are removed via etching.

In an embodiment of the method 15100, each of the plurality of substantially identically shaped forms 15170, 15504 has an outer cross-section shape, as observed in an x-y plane cross-section, that is circular. (see FIG. 16B, for example, and for other example shapes contemplated herein).

In an embodiment of the method 15100, each of the plurality of substantially identically shaped forms 15170, 15504 has any one of: a dome shape; a conical shape; a frustoconical shape; a cylindrical shape; a ring shape; or, a rectangular shape. (see FIG. 16A, for example, and for other example shapes contemplated herein).

Dk EM Structures Generally

From the foregoing descriptions of method steps for making the example Dk EM structures disclosed herein, it will be appreciated that injection or compression molding methods, in addition to any other method disclosed herein or considered suitable for a purpose disclosed herein, may be employed where first and second mold portions are disclosed herein.

Reference is now made to FIGS. 16A and 16B. While certain embodiments disclosed herein depict Dk EM structures having cylindrical or dome-shaped 3D shapes, it will be appreciate that this is for illustration and discussion purposes only, and that any Dk EM structure disclosed herein may have any 3D shape suitable for a purpose disclosed herein, and my have any 2D cross-sectional shape as observed in an x-y plane cross-section suitable for a purpose disclosed herein. By way of example and not limitation, FIG. 16A depicts the following non-limiting 3D shapes: a dome shape 1602; a conical shape 1604; a frustoconical shape 1606; a cylindrical shape 1608; a ring shape 1610; a shape of concentric rings 1612; any shape such as a cylinder with a central hole or void 1614; any shape stacked on each other, which may be formed, for example, with single or multiple stamping, embossing, or photolithography processes, in stacked cylindrical shapes 1616, stacked rectangular shapes 1518, or any other shape or stacked shape suitable for a purpose disclosed herein. By way of example and not limitation, FIG. 16B depicts the following non-limiting 2D x-y plane cross-section shapes: a circular shape 1652; a cylindrical shape 1654; an oval shape 1656; a rectangular shape 1658; a square shape 1660; a triangular shape 1662; a pentagonal shape 1664; an hexagonal shape 1666, an octagonal shape 1668, or any shape suitable for a purpose disclosed herein.

In addition to all of the foregoing descriptions of Dk EM structures disclosed herein, and in the interest of completeness of disclosure, it will be appreciated that any of the foregoing substrates 1508, 2526, 6508, 7530, 8508, 9530, 11530, 12530, and 14530, that may be useful as a signal feed for a purpose disclosed herein, may be in the form of any one of the following (also herein represented by a corresponding one of the aforementioned reference numerals): a Dk layer or dielectric panel; a metal layer or metal panel; a combination of a Dk layer and a metal layer; a combination of a dielectric panel and a metal panel; a metal panel comprising a plurality of slotted apertures disposed in a one-to-one correspondence with a given one of a plurality of 1DPs or DRAs; a metal layer having a plurality of slots, each one of the plurality of slots disposed in a one-to-one correspondence with a filled recess of a corresponding plurality of filled recesses; a printed circuit board; a flexible circuit board; or, a substrate integrated waveguide, SIW; or, an EM signal feed network. In particular reference to substrate 6508 depicted in FIG. 6C, it will be recognized by one skilled in the art that the illustrated substrate 6508 depicts a laminated arrangement of a dielectric medium disposed between two conductive layers having a slotted aperture signal feed structure for electromagnetically exciting the associated 1DP or DRA.

Dk EM Structure Materials Generally

Any curable composition disclosed herein generally includes a curable polymer component and optionally a dielectric filler, each selected to provide a fully cured material having a dielectric constant consistent for a purpose disclosed herein and a dielectric loss (also referred to as a dissipation factor) of less than 0.01, or less than or equal to 0.008 as measured at 10 gigahertz (GHz), 23° C. In some aspects the dielectric constant is greater than 10, or greater than 15, for example 10 to 25 or 15 to 25; and the dissipation factor is less than or equal to 0.007, or less than or equal to 0.006, or 0.0001 to 0.007 at a frequency of 10 GHz at 23° C. The dissipation factor can be measured by the IPC-TM-650 X-band strip line method or by the Split Resonator method.

The curable composition can be radiation-curable or heat-curable. In some aspects the components of the curable compositions are selected to have at least two different cure mechanisms, (e.g., irradiation and thermal curing) or at least two different cure conditions (e.g., a lower temperature cure and a higher temperature cure). The components of the curable composition can include co-reactive components such as monomers, prepolymers, crosslinking agents, or the like, as well as a curing agent (including catalysts, cure accelerators, cure promoters, or the like). The co-reactive components can include co-reactive groups such as epoxy groups, isocyanate groups, active hydrogen-containing groups (such as hydroxy or primary amino groups), ethylenically unsaturated groups (e.g., vinyl, allyl, (meth)acryl), and the like. Examples of specific co-reactive components include 1,2-polybutadiene (PBD), olybutadiene-polyisoprene copolymers, allylated polyphenylene ethers (such as OPE-2ST 1200 or OPE-2ST 2200 (commercially available from Mitsubishi Gas Chemical Co.) or NORYL SA9000 (commercially available from Sabic Innovative Plastics)), cyanate esters, triallyl cyanurate, triallyl isocyanurate, 1,2,4-trivinyl cyclohexane, trimethylolpropane triacrylate, or trimethylolpropane trimethacrylate, and the like.

In an aspect the co-reactive component includes butadiene, isoprene, or a combination thereof, optionally together with other co-reactive monomers, for example substituted or unsubstituted vinylaromatic monomers (such as styrene, 3-methylstyrene, 3,5-diethylstyrene, 4-n-propylstyrene, alpha-methylstyrene, alpha-methyl vinyltoluene, para-hydroxystyrene, para-methoxystyrene, alpha-chlorostyrene, alpha-bromostyrene, dichlorostyrene, dibromostyrene, tetrachlorostyrene, or the like), or substituted or unsubstituted divinylaromatic monomers (such as divinylbenzene, divinyltoluene, and the like). A combination of co-reactive mononmers can also be used. The fully cured composition derived from polymerization of these monomers are a "thermoset polybutadiene or polyisoprene", which as used herein includes butadiene homopolymers, isoprene homopolymers, and copolymers comprising units derived from butadiene, isoprene, or a combination thereof and optionally a corective monomer, such as butadiene-styrene, copolymers such as isoprene-styrene copolymers, or the like. A combination can also be used, for example, a combination of a polybutadiene homopolymer and a poly(butadiene-isoprene) copolymer. A combination comprising a syndiotactic polybutadiene can also be used. The co-reactive components can include post-reacted pre-polymers or polymers such as epoxy-, maleic anhydride-, or urethane-modified polymers or copolymers of butadiene or isoprene.

Other co-reactive components can be present for specific property or processing modifications. For example, to improve stability of dielectric strength and mechanical properties of the fully cured dielectric, a lower molecular weight ethylene-propylene elastomer can be present, i.e., a copolymer, terpolymer, or other polymer comprising primarily ethylene and propylene. Ethylene-propylene elastomers include EPM copolymers (copolymers of ethylene and propylene monomers) and EPDM terpolymers (terpolymers of ethylene, propylene, and diene monomers). The molecular weights of the ethylene-propylene elastomers can be less than 10,000 gram per mole (g/mol) viscosity average molecular weight (Mv), for example 5,000 to 8,000 g/mol Mv. The ethylene-propylene elastomer can be present in the curable composition in an amount such as up to 20 wt % with respect to the total weight of curable composition, for example 4 to 20 wt %, or 6 to 12 wt %, each based on the total weight of the curable composition.

Another type of co-curable component is an unsaturated polybutadiene- or polyisoprene-containing elastomer. This component can be a random or block copolymer of primarily 1,3-addition butadiene or isoprene with an ethylenically unsaturated monomer, for example a vinylaromatic compound such as styrene or alpha-methyl styrene, a (meth) acrylate such methyl methacrylate, or acrylonitrile. The elastomer can be a solid, thermoplastic elastomer comprising a linear or graft-type block copolymer having a polybutadiene or polyisoprene block and a thermoplastic block that can be derived from a monovinylaromatic monomer such as styrene or alpha-methyl styrene. Block copolymers of this type include styrene-butadiene-styrene triblock copolymers, for example, those available from Dexco Polymers, Houston, Tex. under the trade name VECTOR 8508M™, from Enichem Elastomers America, Houston, Tex. under the trade name SOL-T-6302™, and those from Dynasol Elastomers under the trade name CALPRENE™ 401; and styrene-butadiene diblock copolymers and mixed triblock and diblock copolymers containing styrene and butadiene, for example, those available from Kraton Polymers (Houston, Tex.) under the trade name KRATON D 1118. KRATON D 1118 is a mixed diblock/triblock styrene and butadiene containing copolymer that contains 33 wt % styrene.

The optional polybutadiene- or polyisoprene-containing elastomer can further comprise a second block copolymer similar to that described above, except that the polybutadiene or polyisoprene block is hydrogenated, thereby forming a polyethylene block (in the case of polybutadiene) or an ethylene-propylene copolymer block (in the case of polyisoprene). When used in conjunction with the above-described copolymer, materials with greater toughness can be produced. An exemplary second block copolymer of this type is KRATON GX1855 (commercially available from Kraton Polymers, which is believed to be a combination of a styrene-high 1,2-butadiene-styrene block copolymer and a styrene-(ethylene-propylene)-styrene block copolymer. The unsaturated polybutadiene- or polyisoprene-containing elastomer component can be present in the curable composition in an amount of 2 to 60 wt % with respect to the total weight of the dielectric material, specifically, 5 to 50 wt %, or 10 to 40 or 50 wt %. Still other co-curable polymers that can be added for specific property or processing modifications include, but are not limited to, homopolymers or copolymers of ethylene such as polyethylene and ethylene oxide copolymers, natural rubber; norbornene polymers such as polydicyclopentadiene; hydrogenated styrene-isoprene-styrene copolymers and butadiene-acrylonitrile copolymers; unsaturated polyesters; and the like. Levels of these copolymers are generally less than 50 wt % of the total organic components in curable compositions.

Free radical-curable monomers can also be added for specific property or processing modifications, for example, to increase the crosslink density of the system after cure. Exemplary monomers that can be suitable crosslinking agents include, for example, at least one of di, tri-, or higher ethylenically unsaturated monomers such as divinyl benzene, triallyl cyanurate, diallyl phthalate, or multifunctional acrylate monomers (e.g., SARTOMER™ polymers from Sartomer USA, Newtown Square, Pa.), all of which are commercially available. The crosslinking agent, when used, can be present in the curable component in an amount of up to 20 wt %, or 1 to 15 wt %, based on the total weight of the dielectric composition.

A curing agent can be added to the dielectric composition to accelerate the curing reaction of polyenes having olefinic reactive sites. Curing agents can comprise organic peroxides, for example, dicumyl peroxide, t-butyl perbenzoate, 2,5-dimethyl-2,5-di(t-butyl peroxy)hexane, α,α-di-bis(t-butyl peroxy)diisopropylbenzene, 2,5-dimethyl-2,5-di(t-butyl peroxy) hexyne-3, or a combination comprising at least one of the foregoing. Carbon-carbon initiators, for example, 2,3-dimethyl-2,3 diphenylbutane can be used. Curing agents or initiators can be used alone or in combination. The amount of curing agent can be 1.5 to 10 wt % based on the total weight of the polymer in the dielectric composition.

In some aspects, the polybutadiene or polyisoprene polymer is carboxy-functionalized. Functionalization can be accomplished using a polyfunctional compound having in the molecule both (i) a carbon-carbon double bond or a carbon-carbon triple bond, and (ii) at least one of a carboxy group, including a carboxylic acid, anhydride, amide, ester, or acid halide. A specific carboxy group is a carboxylic acid or ester. Examples of polyfunctional compounds that can provide a carboxylic acid functional group include at least one of maleic acid, maleic anhydride, fumaric acid, or citric acid. In particular, polybutadienes adducted with maleic anhydride can be used in the thermosetting composition. Suitable maleinized polybutadiene polymers are commercially available, for example, from Cray Valley or Sartomer under the trade name RICON.

The curable composition can comprise a particulate dielectric material (a filler composition) that can be selected to adjust at least one of the dielectric constant, dissipation factor, or coefficient of thermal expansion. The filler composition can comprise at least one dielectric filler, for example, at least one of titanium dioxide (rutile and anatase), barium titanate, strontium titanate, silica (including fused amorphous silica), corundum, wollastonite, $Ba_2Ti_9O_{20}$, solid glass spheres, synthetic glass or ceramic hollow spheres, quartz, boron nitride, aluminum nitride, silicon carbide, beryllia, alumina, alumina trihydrate, magnesia, mica, talcs, nanoclays, or magnesium hydroxide. The dielectric filler can be at least one of particulate, fibers, or whiskers.

The filler composition can have a multimodal particle size distribution, wherein a peak of a first mode of the multimodal particle size distribution is at least seven times that of a peak of a second mode of the multimodal particle size distribution. The multimodal particle size distribution can be, for example, bimodal, trimodal, or quadramodal. When present, the fully cured dielectric material can comprise 1 to 80 volume percent (vol %), or 10 to 70 vol %, or 20 to 60 vol %, or 40 to 60 vol % of the dielectric filler based on the total volume of the curable composition.

Optionally, the dielectric filler can be surface treated with a coupling agent, for example an organofunctional alkoxy silane coupling agent, a zirconate coupling agent, or a titanate coupling agent. Such coupling agents can improve the dispersion of the dielectric filler in the curable composition or can reduce water absorption of the fully cured composition.

The curable composition can further include a flame retardant compound or particulate filler, for example flame retardant phosphorus-containing compounds), flame retardant bromine-containing compounds), alumina, magnesia, magnesium hydroxide, antimony-containing compounds, and the like.

The high-temperature polymer disclosed herein is generally a material having a thermal decomposition temperature of 200° C. or higher, preferably 220° C. or higher, more preferably 250° C. or higher. There is no particular upper limit, although 400° C. may be a practical upper limit. Such polymers generally have aromatic groups, for example a liquid crystal polymer (LCP), polyphthalamide (PPA), aromatic polyimide, aromatic polyetherimide, polyphenylene sulfide (PPS), polyaryletherketone (PAEK), polyetherether ketone (PEEK), polyetherketoneketone (PEKK), polyethersulfone (PES), polyphenylenesulfone (PPSU), polyphenylenesulfone urea, self-reinforced polyphenylene (SRP), or the like. A combination of different polymers can be used. In an aspect the high temperature polymer is an LCP. LCPs can be thermoplastic, although they can also be used as thermosets by functionalization or by compounding with a thermoset, for example, an epoxy. Examples of commercial LCPs include those commercially available under the trade names VECTRA (from Ticona, Florence, Ky.), XYDAR (from Amoco Polymers), ZENITE (from Dow DuPont, Wilmington, Del.), and those available from RTP Co., for example, the RTP-3400 series LCPs.

For any adhesive, adhering, or adhesive layer, disclosed or noted herein, the adhesive layer can be selected based on the desired properties, and can be, for example, a thermoset polymer having a low melting temperature or other composition for bonding two dielectric layers or a conductive layer to a dielectric layer. The adhesion layer can comprise a poly(arylene ether), a carboxy-functionalized polybutadiene or polyisoprene polymer comprising butadiene, isoprene, or butadiene and isoprene units, and zero to less than or equal to 50 wt % of co-curable monomer units. The adhesive composition of the adhesive layer can be different from the dielectric composition. The adhesive layer can be present in an amount of 2 to 15 grams per square meter. The poly (arylene ether) can comprise a carboxy-functionalized poly (arylene ether). The poly(arylene ether) can be the reaction product of a poly(arylene ether) and a cyclic anhydride or the reaction product of a poly(arylene ether) and maleic anhydride. The carboxy-functionalized polybutadiene or polyisoprene polymer can be a carboxy-functionalized butadiene-styrene copolymer. The carboxy-functionalized polybutadiene or polyisoprene polymer can be the reaction product of a polybutadiene or polyisoprene polymer and a cyclic anhydride. The carboxy-functionalized polybutadiene or polyisoprene polymer can be a maleinized polybutadiene-styrene or maleinized polyisoprene-styrene copolymer.

The adhesive layer can comprise a dielectric filler (e.g., ceramic particles) to adjust the dielectric constant thereof. For example, the dielectric constant of the adhesive layer can be adjusted to improve or otherwise modify the performance of the electromagnetic device (e.g., DRA devices).

While certain combinations of individual features and/or processes have been described and illustrated herein, it will be appreciated that these certain combinations of features and/or processes are for illustration purposes only and that any combination of any of such individual features and/or processes may be employed in accordance with an embodiment, whether or not such combination is explicitly illustrated, and consistent with the disclosure herein. Any and all such combinations of features and/or processes as disclosed herein are contemplated herein, are considered to be within the understanding of one skilled in the art when considering the application as a whole, and are considered to be within the scope of the appended claims in a manner that would be understood by one skilled in the art.

While an invention has been described herein with reference to example embodiments, it will be understood by those skilled in the art that various changes may be made and equivalents may be substituted for elements thereof without departing from the scope of the claims. Many modifications may be made to adapt a particular situation or material to the teachings of the invention without departing from the essential scope thereof. Therefore, it is intended that the invention not be limited to the particular embodiment or embodiments disclosed herein as the best or only mode contemplated for carrying out this invention, but that the invention will include all embodiments falling within the scope of the appended claims. In the drawings and the description, there have been disclosed example embodiments and, although specific terms and/or dimensions may have been employed, they are unless otherwise stated used in a generic, exemplary and/or descriptive sense only and not for purposes of limitation, the scope of the claims therefore not being so limited. When an element is referred to as being "on" another element, it can be directly on the other element, or intervening elements may also be present. In contrast, when an element is referred to as being "directly on" another element, there are no intervening elements present. The use of the terms first, second, etc. do not denote any order or importance, but rather the terms first, second, etc. are used to distinguish one element from another. The use of the terms a, an, etc. do not denote a limitation of quantity, but rather denote the presence of at least one of the referenced item. The term "comprising" as used herein does not exclude the possible inclusion of one or more additional features. And, any background information provided herein is provided to reveal information believed by the applicant to be of possible relevance to the invention disclosed herein. No admission is necessarily intended, nor should be construed, that any of such background information constitutes prior art against an embodiment of the invention disclosed herein.

In view of all of the foregoing, it will be appreciated that various aspects of a structure are disclosed herein, which are in accordance with, but not limited to, at least the following aspects and combinations of aspects.

Aspect 1: A method of making a dielectric, Dk, electromagnetic, EM, structure, comprising: providing a first mold portion comprising substantially identical ones of a first plurality of recesses arranged in an array; filling the first plurality of recesses with a curable first Dk composition having a first average dielectric constant greater than that of air after full cure; placing a substrate on top of and across multiple ones of the first plurality of recesses filled with the first Dk composition, and at least partially curing the curable first Dk composition; and removing the substrate with the at least partially cured first Dk composition from the first mold portion, resulting in an assembly comprising the substrate and a plurality of Dk forms comprising the at least partially cured first Dk composition, each of the plurality of Dk forms having a three dimensional, 3D, shape defined by corresponding ones of the first plurality of recesses.

Aspect 2: The method of Aspect 1, subsequent to placing the substrate on top of and across multiple ones of the first plurality of recesses filled with the first Dk composition, and prior to removing the substrate with the at least partially cured first Dk composition from the first mold portion, further comprising: placing a second mold portion on top of the substrate; pressing the second mold portion toward the first mold portion and at least partially curing the curable first Dk composition; and separating the second mold portion relative to the first mold portion.

Aspect 3: The method of any of Aspects 1 to 2, wherein: the substrate comprises: a Dk layer; a metal layer; a combination of a Dk layer and a metal layer; a metal layer having a plurality of slots, each one of the plurality of slots disposed in a one-to-one correspondence with a filled recess of the plurality of filled recesses; a printed circuit board; a flexible circuit board; or, a substrate integrated waveguide, SIW; or, an EM signal feed network.

Aspect 4: The method of any of Aspects 1 to 2, further comprising: prior to providing the first mold portion, providing a first pre-mold portion comprising substantially identical ones of a second plurality of recesses arranged in the array, each one of the second plurality of recesses being larger than a corresponding one of the first plurality of recesses; filling the second plurality of recesses with a curable second Dk composition having a second average dielectric constant that is less than the first average dielectric constant and greater than that of air after full cure; placing a second pre-mold portion on top of the first pre-mold portion, the second pre-mold portion having a plurality of openings arranged in the array and in a one-to-one correspondence with each one of the second plurality of recesses; placing a third pre-mold portion on top of the second pre-mold portion, the third pre-mold portion having a plurality of substantially identical ones of projections arranged in the array, the substantially identical ones of the projections being inserted into corresponding ones of the openings of the second pre-mold portion, and into corresponding ones of the second plurality of recesses, thereby displacing the second Dk material in each one of the second plurality of recesses by a volume equal to the volume of a given projection; pressing the third pre-mold portion toward the second pre-mold portion and at least partially curing the curable second Dk composition; and separating the third pre-mold portion relative to the second pre-mold portion to yield a mold form having the at least partially cured second Dk composition therein that serves to provide the first mold portion, and establishes the step of providing a first mold portion comprising substantially identical ones of a first plurality of recesses arranged in an array; wherein the step of removing comprises removing the substrate with the at least partially cured first Dk composition and the at least partially cured second Dk composition from the first mold portion, resulting in the assembly comprising the substrate and the plurality of Dk forms comprising the array of the at least partially cured first Dk composition and the corresponding array of the at least partially cured second Dk composition, each of the plurality of Dk forms having a 3D shape defined by corresponding ones of the first plurality of recesses and the second plurality of recesses.

Aspect 5: The method of any of Aspects 1 to 2, wherein: the plurality of Dk forms comprise a plurality of dielectric resonator antennas, DRAs, disposed on the substrate.

Aspect 6: The method of Aspect 4, wherein: the plurality of Dk forms comprise a plurality of dielectric resonator antennas, DRAs, comprising the first Dk composition disposed on the substrate, and a plurality of dielectric lenses or dielectric waveguides comprising the second Dk composition disposed in one-to-one correspondence with the plurality of DRAs.

Aspect 7: The method of Aspect 1, wherein: the first mold portion comprises a plurality of relatively thin connecting channels that interconnect adjacent ones of the first plurality of recesses, which are filled during the step of filling the first plurality of recesses with the curable first Dk composition having the first average dielectric constant, thereby resulting in the assembly comprising the substrate and the plurality of Dk forms, along with a plurality of relatively thin connecting structures interconnecting adjacent ones of the plurality of Dk forms, the relatively thin connecting structures comprising the at least partially cured first Dk composition, the relatively thin connecting structures and the filled first plurality of recesses forming a single monolithic.

Aspect 8: The method of Aspect 4, wherein: the second pre-mold portion comprises a plurality of relatively thin connecting channels that interconnect adjacent ones of the second plurality of recesses, which are filled during the step of displacing the second Dk material in each one of the second plurality of recesses by a volume equal to the volume of a given projection, thereby resulting in the assembly comprising the substrate and the plurality of Dk forms, along with a plurality of relatively thin connecting structures interconnecting adjacent ones of the plurality of Dk forms, the relatively thin connecting structures comprising the at least partially cured second Dk composition, the relatively thin connecting structures and the filled second plurality of recesses forming a single monolithic.

Aspect 9: The method of any of Aspects 1 to 8, wherein the step of filling the first plurality of recesses, filling the second plurality of recesses, or filling of both the first and the second plurality of recesses further comprises: pouring and squeegeeing a flowable form of the respective curable Dk composition into the corresponding recesses.

Aspect 10: The method of any of Aspects 1 to 8, wherein the step of filling the first plurality of recesses, filling the second plurality of recesses, or filling of both the first and the second plurality of recesses further comprises: imprinting a flowable dielectric film of the respective curable Dk composition into the corresponding recesses.

Aspect 11: The method of any of Aspects 1 to 10, wherein the step of at least partially curing the curable first Dk composition, at least partially curing the curable second Dk composition, or at least partially curing of both the curable first Dk composition and the curable second Dk composition, comprises: curing the respective curable Dk composition at a temperature equal to or greater than about 170 degree Celsius for a time duration equal to or greater than about 1 hour.

Aspect 12: The method of any of Aspects 1 to 11, wherein: the first average dielectric constant is equal to or greater than 5, alternatively equal to or greater than 9, further alternatively equal to or greater than 18, and equal to or less than 100.

Aspect 13: The method of any of Aspects 1 to 12, wherein: the curable first Dk composition comprises 1,2-butadiene, 2,3-butadiene, isoprene, or a homopolymer or copolymer thereof, an epoxy, an allylated polyphenylene ether, a cyanate ester, optionally a co-curable crosslinking agent, and optionally a curing agent.

Aspect 14: The method of Aspect 13, wherein: the curable first Dk composition further comprises an inorganic particulate material, preferably wherein the inorganic particulate material comprises titanium dioxide (rutile and anatase), barium titanate, strontium titanate, silica (including fused amorphous silica), corundum, wollastonite, $Ba_2Ti_9O_{20}$, solid glass spheres, synthetic hollow glass spheres, ceramic hollow spheres, quartz, boron nitride, aluminum nitride, silicon carbide, beryllia, alumina, alumina trihydrate, magnesia, mica, talcs, nanoclays, magnesium hydroxide, or a combination thereof.

Aspect 15: The method of any of Aspects 1 to 14, wherein: the 3D shape has an outer cross-section shape, as observed in an x-y plane cross-section, that is circular.

Aspect 16: The method of any of Aspects 1 to 2, further comprising: prior to providing the first mold portion, providing a first pre-mold portion comprising substantially identical ones of a second plurality of recesses arranged in the array, each one of the second plurality of recesses being larger than a corresponding one of the first plurality of recesses; filling the second plurality of recesses with a curable second Dk composition having a second average dielectric constant that is less than the first average dielectric constant and greater than that of air after full cure; placing a second pre-mold portion on top of the first pre-mold portion, the second pre-mold portion having a plurality of openings arranged in the array and in a one-to-one correspondence with each one of the second plurality of recesses; placing an assembly comprising a substrate and a plurality of Dk forms comprising at least partially cured first Dk composition on top of the second pre-mold portion, the assembly having the plurality of Dk forms that are inserted into corresponding ones of the openings of the second pre-mold portion, and into corresponding ones of the second plurality of recesses, thereby displacing the second Dk material in each one of the second plurality of recesses by a volume equal to the volume of a given Dk form; pressing the assembly toward the second pre-mold portion and at least partially curing the curable second Dk composition; separating and removing the substrate with the at least partially cured first Dk composition and the at least partially cured second Dk composition from the first mold portion resulting in an assembly comprising the substrate and the plurality of Dk forms that includes the array of the at least partially cured first Dk composition and the corresponding array of the at least partially cured second Dk composition, each of the plurality of Dk forms having a 3D shape defined by corresponding ones of the first plurality of recesses and the second plurality of recesses.

Aspect 17: The method of Aspect 16, wherein: the substrate comprises: a Dk layer; a metal layer; a combination of a Dk layer and a metal layer; a metal layer having a plurality of slots, each one of the plurality of slots disposed in a one-to-one correspondence with a filled recess of the plurality of filled recesses; a printed circuit board; a flexible circuit board; or, a substrate integrated waveguide, SIW; or, an EM signal feed network.

Aspect 18: The method of any of Aspects 16 to 17, wherein: the plurality of Dk forms comprise a plurality of dielectric resonator antennas, DRAs, disposed on the substrate.

Aspect 19: The method of any of Aspects 16 to 17, wherein: the plurality of Dk forms comprise a plurality of dielectric resonator antennas, DRAs, comprising the first Dk composition disposed on the substrate, and a plurality of dielectric lenses or dielectric waveguides comprising the second Dk composition disposed in one-to-one correspondence with the plurality of DRAs.

Aspect 20: The method of any of Aspects 16 to 19, wherein: the second pre-mold portion comprises a plurality of relatively thin connecting channels that interconnect adjacent ones of the second plurality of recesses, which are filled during the step of displacing the second Dk material in each one of the second plurality of recesses by a volume equal to the volume of a given Dk form, thereby resulting in the assembly comprising the substrate and the plurality of Dk forms, along with a plurality of relatively thin connecting structures interconnecting adjacent ones of the plurality of Dk forms, the relatively thin connecting structures comprising the at least partially cured second Dk composition, the relatively thin connecting structures and the filled second plurality of recesses forming a single monolithic.

Aspect 101: A method of making a dielectric, Dk, electromagnetic, EM, structure having one or more of a first dielectric portion, 1DP, the method comprising: providing a first mold portion comprising substantially identical ones of a first plurality of recesses arranged in an array and configured to form a plurality of the 1DP, the first mold portion further comprising a plurality of relatively thin connecting channels that interconnect adjacent ones of the plurality of recesses; filling the first plurality of recesses and the relatively thin connecting channels with a curable Dk composition having an average dielectric constant greater than that of air after full cure; placing a second mold portion on top of the first mold portion with the curable Dk composition disposed therebetween; pressing the second mold portion toward the first mold portion and at least partially curing the curable Dk composition; separating the second mold portion relative to the first mold portion; and removing the at least partially cured Dk composition from the first mold portion, resulting in at least one Dk form comprising the at least partially cured Dk composition, each of the at least one Dk form having a three dimensional, 3D, shape defined by the first plurality of recesses and the interconnecting plurality of relatively thin connecting channels, the 3D shape defined by the first plurality of recesses providing a plurality of the 1DP in the EM structure.

Aspect 102: The method of Aspect 101, wherein the second mold portion comprises at least one recess disposed for providing an alignment feature to the at least one Dk form, wherein the step of pressing the second mold portion toward the first mold portion further comprises: displacing a portion of the curable Dk composition into the at least one recess.

Aspect 103: The method of Aspect 101, wherein the first mold portion further comprises at least one first projection disposed for providing an alignment feature to the at least one Dk form, wherein the step of pressing the second mold portion toward the first mold portion further comprises: displacing a portion of the curable Dk composition around the at least one first projection.

Aspect 104: The method of any of Aspects 101 to 103, wherein at least one of the first mold portion and the second mold portion includes a segmenting projection around a subset of the plurality of recess for providing segmented sets of panels in a form of the array, wherein the step of pressing the second mold portion toward the first mold portion further comprises: displacing a portion of the curable Dk composition away from a face to face contact between the first mold portion and the second mold portion proximate the segmenting projection.

Aspect 105: The method of any of Aspects 101 to 104, wherein: the first mold portion further comprises a second plurality of recesses, each one of the second plurality of recesses being disposed in a one-to-one correspondence with one of the first plurality of recesses and substantially surrounding the corresponding one of the first plurality of recesses for providing a Dk isolator for a given 1DP in the at least one Dk form.

Aspect 106: The method of Aspect 105, wherein: the first mold portion further comprises a plurality of second projections disposed in a one-to-one correspondence with one of the second plurality of recesses, each second projection being centrally disposed within the corresponding one of the second plurality of recesses and substantially surrounding the corresponding one of the first plurality of recesses for providing an enhanced Dk isolator for a given 1DP in the at least one Dk form.

Aspect 107: The method of Aspect 105, wherein: the second mold portion further comprises a plurality of third projections disposed in a one-to-one correspondence with one of the second plurality of recesses of the first mold portion, each third projection being centrally disposed within the corresponding one of the second plurality of recesses of the first mold portion and substantially surrounding the corresponding one of the first plurality of recesses of the first mold portion for providing an enhanced Dk isolator for a given 1DP in the at least one Dk form.

Aspect 108: The method of any of Aspects 101 to 107, wherein the step of at least partially curing the curable first Dk composition comprises: heating the curable Dk composition at a temperature equal to or greater than about 170 degree Celsius for a time duration of equal to or greater than about 1 hour.

Aspect 109: The method of any one of Aspects 101 to 108, further comprising: fully curing the at least one Dk form, and applying an adhesive to the back of the at least one Dk form.

Aspect 110: The method of any of Aspects 101 to 109, wherein: the average dielectric constant is equal to or greater than 5, alternatively equal to or greater than 9, further alternatively equal to or greater than 18, and equal to or less than 100.

Aspect 111: The method of any of Aspects 101 to 110, wherein: the curable first Dk composition comprises 1,2-butadiene, 2,3-butadiene, isoprene, or a homopolymer or copolymer thereof, an epoxy, an allylated polyphenylene ether, a cyanate ester, optionally a co-curable crosslinking agent, and optionally a curing agent.

Aspect 112: The method of Aspect 111, wherein: the curable first Dk composition further comprises an inorganic particulate material, preferably wherein the inorganic particulate material comprises titanium dioxide (rutile and anatase), barium titanate, strontium titanate, silica (including fused amorphous silica), corundum, wollastonite, $Ba_2Ti_9O_{20}$, solid glass spheres, synthetic hollow glass spheres, ceramic hollow spheres, quartz, boron nitride, aluminum nitride, silicon carbide, beryllia, alumina, alumina trihydrate, magnesia, mica, talcs, nanoclays, magnesium hydroxide, or a combination thereof.

Aspect 113: The method of any of Aspects 101 to 112, wherein: each 1DP of the plurality of the 1DP has an outer cross-section shape, as observed in an x-y plane cross-section, that is circular.

Aspect 114: The method of any of Aspects 102 to 113, further comprising: providing a substrate and placing the at least one Dk form onto the substrate.

Aspect 115. The method of Aspect 114, wherein: the substrate comprises: a Dk layer; a metal layer; a combination of a Dk layer and a metal layer; a metal layer having a plurality of slots, each one of the plurality of slots disposed in a one-to-one correspondence with a filled recess of the plurality of filled recesses; a printed circuit board; a flexible circuit board; or, a substrate integrated waveguide, SIW; or, an EM signal feed network.

Aspect 116: The method of any of Aspects 114 to 115, wherein the placing the at least one Dk form onto the substrate further comprises: aligning the alignment feature with a corresponding reception feature on the substrate and adhering the at least one Dk form to the substrate.

Aspect 201: A method of making a dielectric, Dk, electromagnetic, EM, structure, comprising: providing a sheet of Dk material; forming in the sheet substantially identical ones of a plurality of recesses arranged in an array, with the non-recessed portions of the sheet forming a connecting structure between individual ones of the plurality of recesses; filling the plurality of recesses with a curable Dk composition having a first average dielectric constant greater than that of air after full cure, wherein the sheet of Dk material has a second average dielectric constant that is different from the first average dielectric constant; and at least partially curing the curable Dk composition.

Aspect 202: The method of Aspect 201, wherein: the second average dielectric constant is less than the first average dielectric constant.

Aspect 203: The method of any of Aspects 201 to 202, further comprising: subsequent to the step of at least partially curing the curable Dk composition, cutting the sheet into individual tiles, each tile comprising an array of a subset of the plurality of recesses having the at least partially cured Dk composition, with a portion of the connecting structure disposed therebetween.

Aspect 204: The method of any of Aspects 201 to 203, wherein the step of forming comprises: stamping or imprinting the plurality of recesses in a top-down manner.

Aspect 205: The method of any of Aspects 201 to 203, wherein the step of forming comprises: embossing the plurality of recesses in a bottom-up manner.

Aspect 206: The method of any of Aspects 201 to 205, wherein the step of filling comprises: pouring and squeegeeing a flowable form of the curable Dk composition into the plurality of recesses.

Aspect 207: The method of any of Aspects 201 to 206, wherein: the step of forming further comprises, from a first side of the sheet, forming in the sheet the substantially identical ones of the plurality of recesses, each of the plurality of recesses having a depth, H5, and further comprising: from a second opposing side of the sheet, forming a plurality of depressions in a one-to-one correspondence with the plurality of recesses, each of the plurality of depressions having a depth, H6, wherein H6 is equal to or less than H5.

Aspect 208: The method of Aspects 207, wherein: each of the plurality of depressions forms a blind pocket with a surrounding side wall in each corresponding one of the plurality of recesses.

Aspect 209: The method of any of Aspects 207 to 2087, wherein: each of the plurality of depressions is centrally disposed with respect to a corresponding one of the plurality of recesses.

Aspect 210: The method of any of Aspects 201 to 209, wherein the step of at least partially curing the curable Dk composition comprises: curing the Dk composition at a temperature equal to or greater than about 170 degree Celsius for a time duration equal to or greater than about 1 hour.

Aspect 211: The method of any of Aspects 201 to 210, wherein: the step of providing comprises providing the sheet of Dk material in a flat form; and the step of filling comprises filling the plurality of recesses of the flat form sheet one or more than one recess at a time.

Aspect 212: The method of any of Aspects 201 to 210, wherein: the step of providing comprises providing the sheet of Dk material on a roll and unrolling the sheet of Dk material for the subsequent step of forming.

Aspect 213: The method of Aspect 212, further comprising: providing a pattern roller and an opposing compression roller downstream of the roll of Dk material; providing a dispenser unit of the Dk composition downstream of the pattern roll; providing a curing unit downstream of the dispenser unit; and providing a finish roller downstream of the curing unit.

Aspect 214: The method of Aspect 213, further comprising: providing a first tensioning roller downstream of the pattern roller and upstream of the dispenser unit; and providing a second tensioning roller downstream of the first tensioning roller and upstream of the curing unit.

Aspect 215: The method of Aspect 214, further comprising: providing a squeegee unit disposed to cooperate with and opposing the second tensioning roller.

Aspect 216: The method of any of Aspect 213 to 215, further comprising: unrolling the sheet of Dk material from the roll of Dk material; passing the unrolled sheet of Dk material between the pattern roller and the opposing compression roller, whereat the step of forming in the sheet substantially identical ones of the plurality of recesses arranged in the array occurs, resulting in a patterned sheet; passing the patterned sheet proximate the dispenser unit, whereat the step of filling of the plurality of recesses with the curable Dk composition occurs, resulting a filled patterned sheet; passing the filled patterned sheet proximate the curing unit, whereat the step of at least partially curing the curable Dk composition occurs, resulting in an at least partially cured sheet; and passing the at least partially cured sheet to the finish roller for subsequent processing.

Aspect 217: The method of Aspect 216, further comprising: prior to passing the patterned sheet proximate the dispenser unit, engaging the patterned sheet with the first tensioning roller; and prior to passing the filled patterned sheet proximate the curing unit, engaging the filled patterned sheet with the second tensioning roller.

Aspect 218: The method of Aspect 217, further comprising: prior to passing the filled patterned sheet proximate the curing unit, engaging the filled patterned sheet with the squeegee unit and the opposing second tensioning roller, resulting in a filled and squeegeed patterned sheet.

Aspect 219: The method of any of Aspects 201 to 218, wherein: the first average dielectric constant is equal to or greater than 5, alternatively equal to or greater than 9, further alternatively equal to or greater than 18, and equal to or less than 100.

Aspect 220: The method of any of Aspects 201 to 219, wherein: the curable first Dk composition comprises 1,2-butadiene, 2,3-butadiene, isoprene, or a homopolymer or copolymer thereof, an epoxy, an allylated polyphenylene ether, a cyanate ester, optionally a co-curable crosslinking agent, and optionally a curing agent.

Aspect 221: The method of Aspect 220, wherein: the curable first Dk composition further comprises an inorganic particulate material, preferably wherein the inorganic particulate material comprises titanium dioxide (rutile and anatase), barium titanate, strontium titanate, silica (including fused amorphous silica), corundum, wollastonite, $Ba_2Ti_9O_{20}$, solid glass spheres, synthetic hollow glass spheres, ceramic hollow spheres, quartz, boron nitride, aluminum nitride, silicon carbide, beryllia, alumina, alumina trihydrate, magnesia, mica, talcs, nanoclays, magnesium hydroxide, or a combination thereof.

Aspect 222: The method of any of Aspects 201 to 221, wherein: each recess of the plurality of recesses has an inner cross-section shape, as observed in an x-y plane cross-section, that is circular.

Aspect 301: A dielectric, Dk, electromagnetic, EM, structure, comprising: at least one Dk component comprising a Dk material other than air having a first average dielectric constant; and a water impervious layer, a water barrier layer, or a water repellent layer, conformally disposed over at least a portion of the exposed surfaces of the at least one Dk component.

Aspect 302: The Dk EM structure of Aspect 301, wherein: the water impervious layer, water barrier layer, or water repellent layer, is conformally disposed over at least the exposed upper and side surfaces of the at least one Dk component.

Aspect 303: The Dk EM structure of any of Aspects 301 to 302, wherein: the water impervious layer, water barrier layer, or water repellent layer, is conformally disposed over all exposed surfaces of the at least one Dk component.

Aspect 304: The Dk EM structure of any of Aspects 301 to 303, wherein: the water impervious layer, water barrier layer, or water repellent layer, is equal to or less than 30 microns, alternatively equal to or less than 10 microns, alternatively equal to or less than 3 microns, alternatively equal to or less than 1 micron.

Aspect 305: The Dk EM structure of any of Aspects 301 to 304, wherein: the at least one Dk component comprises a plurality of the Dk components arranged in an x-by-y arrangement forming an array of the Dk components.

Aspect 306: The Dk EM structure of Aspect 305, wherein: each of the plurality of Dk components is physically connected to at least one other of the plurality of Dk components via a relatively thin connecting structure, each connecting structure being relatively thin as compared to an overall outside dimension of one of the plurality of Dk components, each connecting structure having a cross sectional overall height that is less than an overall height of a respective connected Dk component and being formed from the Dk material of the Dk component, each relatively thin connecting structure and the plurality of Dk components forming a single monolithic.

Aspect 307: The Dk EM structure of Aspect 306, wherein: the relatively thin connecting structure comprises at least one alignment feature integrally formed with the monolithic.

Aspect 308: The Dk EM structure of Aspect 307, wherein: the at least one alignment feature comprises a projection, a recess, a hole, or any combination of the foregoing alignment features.

Aspect 309: The Dk EM structure of any of Aspects 305 to 308, wherein: the array of Dk components comprises a plurality of Dk isolators arranged in a one-to-one correspondence with each one of the plurality of Dk components; each Dk isolator being disposed substantially surrounding a corresponding one of the plurality of Dk components.

Aspect 310: The Dk EM structure of Aspect 309, wherein: each of the plurality of Dk isolators has a height, H2, equal to or less than a height, H1, of the plurality of Dk components.

Aspect 311: The Dk EM structure of any of Aspects 309 to 310, wherein: each of the Dk isolators comprises a hollow interior portion.

Aspect 312: The Dk EM structure of Aspect 311, wherein: the hollow interior is open at the top, or is open at the bottom.

Aspect 313. The Dk EM structure of any of Aspects 309 to 312, wherein: the plurality of Dk isolators are integrally formed with the plurality of Dk components forming a monolithic.

Aspect 314: The Dk EM structure of any of Aspects 305 to 313, wherein each one of the at least one Dk component comprises a first dielectric portion, 1DP, and further comprising; a plurality of second dielectric portions, 2DPs, each 2DP of the plurality of 2DPs comprising a Dk material other than air having a second average dielectric constant; wherein each 1DP has a proximal end and a distal end; wherein each 2DP has a proximal end and a distal end, the proximal end of a given 2DP being disposed proximate the distal end of a corresponding 1DP, the distal end of the given 2DP being disposed a defined distance away from the distal end of the corresponding 1DP; and wherein the second average dielectric constant is less than the first average dielectric constant.

Aspect 315: The Dk EM structure of Aspect 314, wherein: each 2DP is integrally formed with an adjacent one of the 2DP forming a monolithic of 2DPs.

Aspect 316: The Dk EM structure of any of Aspects 301 to 315, wherein: the first average dielectric constant is equal to or greater than 5, alternatively equal to or greater than 9, further alternatively equal to or greater than 18, and equal to or less than 100.

Aspect 317: The Dk EM structure of Aspect 305, wherein each of the at least one Dk component comprises a first dielectric portion, 1DP, having a height, H1, and further comprising: a second dielectric portion, 2DP, having a height, H3, comprising a Dk material other than air having a second average dielectric constant; wherein the 2DP comprises a plurality of recesses, each recess of the plurality of recesses being filled with a corresponding one of the 1DP; wherein the 2DP substantially surrounds each of the 1DP; and wherein the second average dielectric constant is less than the first average dielectric constant.

Aspect 318: The Dk EM structure of Aspect 317, wherein: H1 is equal to H3.

Aspect 319: The Dk EM structure of Aspect 317, further wherein: the 2DP comprises a relatively thin connecting structure that is subordinate to each of the 1DP, wherein the 2DP and the relatively thin connecting structure forms a monolithic, and wherein H1 is less than H3.

Aspect 320: The Dk EM structure of any of Aspects 305 to 319, wherein: the water impervious layer, water barrier layer, or water repellent layer, is conformally disposed over all exposed surfaces of the array.

Aspect 321: The Dk EM structure of any of Aspects 301 to 320, wherein: the first average dielectric constant is equal to or greater than 5, alternatively equal to or greater than 9, further alternatively equal to or greater than 18, and equal to or less than 100.

Aspect 322: The method of any of Aspects 301 to 321, wherein: the curable first Dk composition comprises 1,2-butadiene, 2,3-butadiene, isoprene, or a homopolymer or copolymer thereof, an epoxy, an allylated polyphenylene ether, a cyanate ester, optionally a co-curable crosslinking agent, and optionally a curing agent.

Aspect 323: The method of Aspect 322, wherein: the curable first Dk composition further comprises an inorganic particulate material, preferably wherein the inorganic particulate material comprises titanium dioxide (rutile and anatase), barium titanate, strontium titanate, silica (including fused amorphous silica), corundum, wollastonite, $Ba_2Ti_9O_{20}$, solid glass spheres, synthetic hollow glass spheres, ceramic hollow spheres, quartz, boron nitride, aluminum nitride, silicon carbide, beryllia, alumina, alumina trihydrate, magnesia, mica, talcs, nanoclays, magnesium hydroxide, or a combination thereof.

Aspect 324: The Dk structure of any of Aspects 301 to 323, wherein: each Dk component of the at least one Dk component has an outer cross-section shape, as observed in an x-y plane cross-section, that is circular.

Aspect 325: The Dk structure of any of Aspects 301 to 324, wherein: each Dk component of the at least one Dk component is a dielectric resonator antenna, DRA.

Aspect 326: The Dk structure of any of Aspects 314 to 325, wherein: each 2DP of the plurality of 2DPs is a dielectric lens or waveguide.

Aspect 401: A method of making a dielectric, Dk, electromagnetic, EM, structure having a plurality of a first dielectric portion, 1DP, and a plurality of a second dielectric portion, 2DP, disposed in a one-to-one correspondence with a given one of the plurality of the 1DP, each 1DP of the plurality of 1DPs having a proximal end and a distal end, the distal end of a given 1DP having a cross-section that is smaller than a cross-section of the proximal end of the given 1DP as observed in an x-y plane cross-section, the method comprising: providing a support form; providing a plurality of integrally formed ones of the 2DP arranged in at least one array, the plurality of 2DPs being at least partially cured, each 2DP of the plurality of 2DPs comprising a proximal end and a distal end, each proximal end of a given 2DP comprising a centrally disposed depression having a blind end, and placing the plurality of the 2DPs onto the support form, wherein each depression of the plurality of 2DPs is configured to form a corresponding one of the plurality of the 1DPs; filling a flowable form of a curable Dk composition into the depressions of the plurality of 2DPs, the Dk composition having a first average dielectric constant when fully cured that is greater than a second average dielectric constant of the plurality of 2DPs when fully cured; squeegeeing across the support form and the proximal end of the plurality of 2DPs to remove any excess curable Dk composition, leaving the Dk composition at least flush with the proximal end of each 2DP of the plurality of 2DPs; at least partially curing the curable Dk composition to form at least one array of the plurality of 1DPs; removing from the support form a resulting assembly comprising the at least one array of the 2DPs with the at least one array of the 1DPs formed therein.

Aspect 402: The method of Aspect 401, wherein the support form comprises a raised wall around a given one of the at least one array of the plurality of 2DPs, and wherein the filling and squeegeeing further comprises: filling the flowable form of the curable Dk composition into the depressions of the plurality of 2DPs and up to an edge of the raised wall of the support form, such that the depressions of the plurality of 2DPs are filled and the proximal ends of the associated plurality of 2DPs are covered with the Dk composition to a particular thickness, H6; and squeegeeing across the raised wall of the support form to remove any excess Dk composition, leaving the Dk composition flush to the edge of the raised wall, where the Dk composition of the H6 thickness provides a connecting structure that is integrally formed with the plurality of 1DPs.

Aspect 403: The method of any of Aspects 401 to 402, wherein: the at least one array of the plurality of integrally formed 2DPs is one of a plurality of arrays of the integrally formed 2DPs that are placed onto the support form; the plurality of 2DPs comprise a thermoplastic polymer; the plurality of 1DPs comprise a thermoset Dk material; the at least partially curing comprises curing the curable Dk composition at a temperature equal to or greater than about 170 degree Celsius for a time duration equal to or greater than about 1 hour.

Aspect 404: The method of Aspect 403, wherein: the thermoplastic polymer is a high temperature polymer; the Dk material comprises an inorganic particulate material, preferably wherein the inorganic particulate material comprises titanium dioxide.

Aspect 405: The method of any of Aspects 402 to 404, wherein: H6 is about 0.002 inches.

Aspect 406: The method of any of Aspects 401 to 405, wherein: each of the plurality of the 1DPs and each of the plurality of the 2DPs have an outer cross-section shape, as observed in an x-y plane cross-section, that is circular.

Aspect 501: A mold for making a dielectric, Dk, electromagnetic, EM, structure comprising a first region having a first average dielectric constant, a second region outboard of the first region having a second average dielectric constant, a third region outboard of the second region having a third average dielectric constant, and a fourth region outboard of the third region having the second average dielectric constant, the mold comprising: a plurality of unit cells that are integrally formed with or joined with each other, each unit cell comprising: a first portion configured to form the first region of the EM structure; a second portion configured to form the second region of the EM structure; a third portion configured to form the third region of the EM structure; a fourth portion configured to form the fourth region of the EM structure; a fifth portion configured to form and define an outer boundary of the unit cell; wherein the first portion, the second portion, the third portion, the fourth portion, and the fifth portion, are all integrally formed with each other from a single material to provide a monolithic unit cell; wherein the first and fifth portions include the single material of the monolithic unit cell, the second and fourth portions are absent the single material of the monolithic unit cell, and the third portion has a combination of an absence of and a presence of the single material of the monolithic unit cell; and wherein the second and fourth portions, and only a fraction of the third portion, are configured to receive a flowable form of a curable Dk composition.

Aspect 502: The mold of Aspect 501, wherein a single Dk EM structure made from the unit cell of the mold comprises: a three dimensional, 3D, body made from an at least a partially cured form of the Dk composition having a proximal end and a distal end; the 3D body comprising the first region disposed at the center of the 3D body, the first region extending to the distal end of the 3D body and comprising air; the 3D body comprising the second region made from the at least partially cured form of the Dk composition where the second average dielectric constant is greater than the first average dielectric constant, the second region extending from the proximal end to the distal end of the 3D body; the 3D body comprising the third region made partially from the at least partially cured form of the Dk composition, and partially from air, where the third average dielectric constant that is less than the second average dielectric constant, the third region extending from the proximal end to the distal end of the 3D body; wherein the third region comprises projections made from the at least partially cured form of the Dk composition that extend radially, relative to the z-axis, outward from and are integral and monolithic with the second region; wherein each one of the projections has a cross-section overall length, L1, and a cross-section overall width, W1, as observed in an x-y plane cross-section, where L1 and W1 are each less than X, where X is an operating wavelength of the Dk EM structure when the Dk EM structure is electromagnetically excited; and wherein all exposed surfaces of at least the second region of the 3D body draft inward, via drafted side walls of the mold, from the proximal end to the distal end of the 3D body.

Aspect 503: The mold of Aspect 502, wherein the single Dk EM structure made from the unit cell of the mold further comprises: the first region and the second region of the 3D body each having an outer cross-section shape, as observed in an x-y plane cross-section, that is circular, and an inner cross-section shape, as observed in an x-y plane cross-section, that is circular.

Aspect 601: A method of making a dielectric, Dk, electromagnetic, EM, structure having a plurality of a first dielectric portion, 1DP, each 1DP of the plurality of 1DPs having a proximal end and a distal end, the distal end having a cross-section area that is smaller than a cross-section area of the proximal end as observed in an x-y plane cross-section, the method comprising: providing a carrier; placing a substrate on the carrier; placing a first stenciling mask on the substrate, the first stenciling mask comprising a plurality of openings arranged in at least one array, each opening comprising a shape for forming a corresponding one of the 1DP; filling a first flowable form of a curable first Dk composition into the openings of the first stenciling mask, the first Dk composition having a first average dielectric constant after cure; squeegeeing across an upper surface of the first stenciling mask to remove any excess first Dk composition, leaving the first Dk composition flush with the upper surface of the first stenciling mask; at least partially curing the curable first Dk composition, forming at least one array of the 1DPs; removing the first stenciling mask; and removing from the carrier a resulting assembly comprising the substrate with the at least one array of the 1DPs attached thereto.

Aspect 602: The method of Aspect 601, further comprising: subsequent to removing the first stenciling mask and prior to removing the substrate with the at least one array of the 1DPs attached thereto, placing a second stenciling mask on the substrate, the second stenciling mask comprising openings surrounded by partitioning walls configured and disposed to surround a subset of the plurality of 1DPs for forming a plurality of arrays of the 1DPs, where each array of the 1DPs is to be encased in a second dielectric portion, 2DP; filling a second flowable form of a curable second Dk composition into the openings of the second stenciling mask, the second Dk composition having a second average dielectric constant after cure that is less than the first average dielectric constant; squeegeeing across an upper surface of the second stenciling mask to remove any excess second Dk composition, leaving the second Dk composition flush with the upper surface of the second stenciling mask; at least partially curing the curable second Dk composition, forming the plurality of arrays of the 1DPs encased in the 2DP; removing the second stenciling mask; and removing from the carrier the resulting assembly comprising the substrate with the plurality of arrays of the 1DPs encased in a corresponding 2DP attached thereto.

Aspect 603: The method of Aspect 601, further comprising: subsequent to removing the first stenciling mask and prior to removing the substrate with the at least one array of the 1DPs attached thereto, placing a second stenciling mask on the substrate, the second stenciling mask comprising covers that cover individual ones of the plurality of 1DPs, openings that surround individual ones of the plurality of 1DPs, and partitioning walls that surround a subset of the plurality of 1DPs for forming a plurality of arrays of the 1DPs where each one of the plurality of 1DPs is to be surrounded by an electrically conductive structure; filling a flowable form of a curable composition into the openings of the second stenciling mask, the curable composition being electrically conductive when fully cured; squeegeeing across the upper surface of the second stenciling mask to remove any excess of the curable composition, leaving the curable composition flush with the upper surface of the second stenciling mask; at least partially curing the curable composition, forming the plurality of arrays of the 1DPs where each 1DP is surrounded by the electrically conductive structure; removing the second stenciling mask; and removing from the carrier the resulting assembly comprising the substrate with the plurality of arrays of the 1DPs, where each 1DP is surrounded by the electrically conductive structure, attached thereto.

Aspect 604: The method of any of Aspects 601 to 603, wherein: the curable first Dk composition comprises 1,2-butadiene, 2,3-butadiene, isoprene, or a homopolymer or copolymer thereof, an epoxy, an allylated polyphenylene ether, a cyanate ester, optionally a co-curable crosslinking agent, and optionally a curing agent.

Aspect 605: The method of Aspect 604, wherein: the curable first Dk composition further comprises an inorganic particulate material, preferably wherein the inorganic particulate material comprises titanium dioxide (rutile and anatase), barium titanate, strontium titanate, silica (including fused amorphous silica), corundum, wollastonite, $Ba_2Ti_9O_{20}$, solid glass spheres, synthetic hollow glass spheres, ceramic hollow spheres, quartz, boron nitride, aluminum nitride, silicon carbide, beryllia, alumina, alumina trihydrate, magnesia, mica, talcs, nanoclays, magnesium hydroxide, or a combination thereof.

Aspect 606: The method of any of Aspects 601 to 605, wherein: each of the plurality of the 1DPs has an outer cross-section shape, as observed in an x-y plane cross-section, that is circular.

Aspect 607: The method of any of Aspects 603 to 606, wherein: wherein the curable composition comprises any one of: a polymer comprising metal particles; a polymer comprising copper particles; a polymer comprising aluminum particles; a polymer comprising silver particles; an electrically conductive ink; a carbon ink; or, a combination of the foregoing curable compositions.

Aspect 608: The method of any of Aspects 603 to 607, wherein: the electrically conductive structure has an inner cross-section shape, as observed in an x-y plane cross-section, that is circular.

Aspect 609: The method of any of Aspects 601 to 608, wherein: the substrate comprises any one of: a dielectric panel; a metal panel; a combination of a dielectric panel and a metal panel; a printed circuit board; a flexible circuit board; a substrate integrated waveguide, SIW; a metal panel comprising a plurality of slotted apertures disposed in a one-to-one correspondence with a given one of the plurality of 1DPs; or, an EM signal feed network.

Aspect 701: The method of any of the foregoing method Aspects, wherein: the Dk EM structure comprising the at least one array of 1DPs is formed by a process of panel-level processing where multiple arrays of the at least one array of 1DPs are formed on a single panel.

Aspect 702: The method of Aspect 701, wherein: the single panel comprises a substrate or any one of a dielectric panel; a metal panel; a combination of a dielectric panel and a metal panel; a printed circuit board; a flexible circuit board; a substrate integrated waveguide, SIW; a metal panel comprising a plurality of slotted apertures disposed in a one-to-one correspondence with a given one of the plurality of 1DPs; or, an EM signal feed network.

Aspect 801: A method of making a dielectric, Dk, electromagnetic, EM, structure having a plurality of a first dielectric portion, 1DP, and a plurality of a second dielectric portion, 2DP, each 1DP having a proximal end and a distal end, the method comprising: providing a support form; disposing a sheet of a polymer on the support form; providing a stamping form and stamping, down then up, the sheet of polymer supported by the support form, the stamping form comprising a plurality of substantially identically configured projections arranged in an array, wherein the stamping results in displaced material of the sheet of polymer, a plurality of depressions having a blind end arranged in the array in the sheet of polymer, and a plurality of raised walls of the sheet of polymer surrounding each one of the plurality of depressions, the plurality of raised walls forming the plurality of 2DPs; filling a flowable form of a curable Dk composition into the plurality of depressions, wherein each depression of the plurality of depressions forms a corresponding one of the plurality of 1DPs having a first average dielectric constant, wherein the sheet of polymer has a second average dielectric constant that is less than the first average dielectric constant, wherein the distal end of each 1DP is proximate an upper surface of the plurality of raised walls of the sheet of polymer; optionally removing any excess Dk composition above the upper surface of the plurality of raised walls of the sheet of polymer, leaving the Dk composition flush with the upper surface of the plurality of raised walls; at least partially curing the curable Dk composition to form at least one array of the plurality of 1DPs; removing from the support form a resulting assembly comprising the stamped sheet of polymer material with the plurality of raised walls, the plurality of depressions, and the at least one array of the plurality of 1DPs formed in the plurality of depressions.

Aspect 802: The method of Aspect 801, further comprising: providing a substrate and placing the assembly onto the substrate with the stamped polymer sheet disposed on the substrate.

Aspect 803: The method of Aspect 801, further comprising: providing a substrate and placing the assembly onto the substrate with at least the distal ends of the plurality of 1DPs disposed on the substrate.

Aspect 804: The method of any of Aspects 802 to 803, wherein: the substrate comprises any one of: a dielectric panel; a metal panel; a combination of a dielectric panel and a metal panel; a printed circuit board; a flexible circuit board; a substrate integrated waveguide, SIW; a metal panel comprising a plurality of slotted apertures disposed in a one-to-one correspondence with a given one of the plurality of 1DPs; or, an EM signal feed network.

Aspect 805: The method of any of Aspects 801 to 804, wherein: the curable Dk composition comprises 1,2-butadiene, 2,3-butadiene, isoprene, or a homopolymer or copolymer thereof, an epoxy, an allylated polyphenylene ether, a cyanate ester, optionally a co-curable crosslinking agent, and optionally a curing agent.

Aspect 806: The method of Aspect 805, wherein: the curable Dk composition further comprises an inorganic particulate material, preferably wherein the inorganic particulate material comprises titanium dioxide (rutile and anatase), barium titanate, strontium titanate, silica (including fused amorphous silica), corundum, wollastonite, $Ba_2Ti_9O_{20}$, solid glass spheres, synthetic hollow glass spheres, ceramic hollow spheres, quartz, boron nitride, aluminum nitride, silicon carbide, beryllia, alumina, alumina trihydrate, magnesia, mica, talcs, nanoclays, magnesium hydroxide, or a combination thereof.

Aspect 807: The method of any of Aspects 801 to 806, wherein: each of the plurality of the 1DPs has an outer cross-section shape, as observed in an x-y plane cross-section, that is circular.

Aspect 808: The method of any of Aspects 801 to 807, wherein: each raised wall of a corresponding 2DP has an inner cross-section shape, as observed in an x-y plane cross-section, that is circular.

Aspect 809: The method of any of Aspects 801 to 808, wherein: the at least partially curing comprises at least partially curing the curable Dk composition at a temperature equal to or greater than about 170 degree Celsius for a time duration equal to or greater than about 1 hour.

Aspect 901: A method of making the stamping form of any of Aspects 801-809 for use in accordance therewith, the method comprising: providing a substrate having a metal layer on top thereof, the metal layer covering the substrate; disposing a photoresist on top of and covering the metal layer; disposing a photomask on top of the photoresist, the photomask comprising a plurality of substantially identically configured openings arranged in an array thereby providing exposed photoresist; exposing at least the exposed photoresist to EM radiation; removing the exposed photoresist subjected to the EM radiation exposure from the metal layer, resulting in a plurality of substantially identically configured pockets in the remaining photoresist arranged in the array; applying a metal coating to all exposed surfaces of the remaining photoresist having the plurality of pockets therein; filling the plurality of pockets and covering the remaining metal coated photoresist with a stamp-suitable metal to a particular thickness, H7, relative to a top surface of the metal layer; removing the substrate from the bottom of the metal layer; removing the metal layer; and removing the remaining photoresist, resulting in the stamping form.

Aspect 902: The method of Aspect 901, wherein: the substrate comprises any one of: a metal; an electrical insulating material; a wafer; a silicon substrate or wafer; a silicon dioxide substrate or wafer; an aluminum oxide substrate or wafer; a sapphire substrate or wafer; a germanium substrate or wafer; a gallium arsenide substrate or wafer; an alloy of silicon and germanium substrate or wafer; or, an indium phosphide substrate or wafer; the photoresist is a positive photoresist; the EM radiation is X-ray or UV radiation; the metal coating is applied via metal deposition; the stamp-suitable metal comprises nickel; the substrate is removed via etching or grinding; the metal layer is removed via polishing, etching, or a combination of polishing and etching; and the exposed photoresist and the remaining photoresist are removed via etching.

Aspect 1001: A method of making a dielectric, Dk, electromagnetic, EM, structure having a plurality of a first dielectric portion, 1DP, and a plurality of a second dielectric portion, 2DP, the method comprising: providing a support form; disposing a layer of photoresist on top of the support form; disposing a photomask on top of the photoresist, the photomask comprising a plurality of substantially identically configured openings arranged in an array thereby providing exposed photoresist; exposing at least the exposed photoresist to EM radiation; removing the exposed photoresist subjected to the EM radiation exposure from the support form, resulting in a plurality of the substantially identically configured openings in the remaining photoresist arranged in the array; filling a flowable form of a curable Dk composition into the plurality of openings in the remaining photoresist, wherein the plurality of filled openings provide corresponding ones of the plurality of 1DPs having a first average dielectric constant, wherein the remaining photoresist provides the plurality of 2DPs having a second average dielectric constant that is less than the first average dielectric constant; optionally removing any excess Dk composition above an upper surface of the plurality of 2DPs, leaving the Dk composition flush with the upper surface of the plurality of 2DPs; at least partially curing the curable Dk composition to form at least one array of the plurality of 1DPs; removing from the support form a resulting assembly comprising the plurality of 2DPs and the at least one array of the plurality of 1DPs formed therein.

Aspect 1002: The method of Aspect 1001, further comprising: providing a substrate and adhering the resulting assembly to the substrate; wherein the substrate comprises any one of: a dielectric panel; a metal panel; a combination of a dielectric panel and a metal panel; a printed circuit board; a flexible circuit board; a substrate integrated waveguide, SIW; a metal panel comprising a plurality of slotted apertures disposed in a one-to-one correspondence with a given one of the plurality of 1DPs; or, an EM signal feed network; wherein the photoresist is a positive photoresist; wherein the EM radiation is X-ray or UV radiation; wherein the exposed photoresist and the remaining photoresist are removed via etching; wherein the at least partially curing comprises curing the curable Dk composition at a temperature equal to or greater than about 170 degree Celsius for a time duration equal to or greater than about 1 hour.

Aspect 1003: The method of any of Aspects 1001 to 1002, wherein: the curable Dk composition comprises 1,2-butadiene, 2,3-butadiene, isoprene, or a homopolymer or copolymer thereof, an epoxy, an allylated polyphenylene ether, a cyanate ester, optionally a co-curable crosslinking agent, and optionally a curing agent.

Aspect 1004: The method of Aspect 1003, wherein: the curable Dk composition further comprises an inorganic particulate material, preferably wherein the inorganic particulate material comprises titanium dioxide (rutile and anatase), barium titanate, strontium titanate, silica (including fused amorphous silica), corundum, wollastonite, $Ba_2Ti_9O_{20}$, solid glass spheres, synthetic hollow glass spheres, ceramic hollow spheres, quartz, boron nitride, aluminum nitride, silicon carbide, beryllia, alumina, alumina trihydrate, magnesia, mica, talcs, nanoclays, magnesium hydroxide, or a combination thereof.

Aspect 1005: The method of any of Aspects 1001 to 1004, wherein: each of the plurality of the 1DPs has an outer cross-section shape, as observed in an x-y plane cross-section, that is circular.

Aspect 1006: The method of any of Aspects 1001 to 1005, wherein: each opening of a corresponding one of the plurality of 2DPs has an inner cross-section shape, as observed in an x-y plane cross-section, that is circular.

Aspect 1101: A method of making a dielectric, Dk, electromagnetic, EM, structure having a plurality of a first dielectric portion, 1DP, and a plurality of a second dielectric portion, 2DP, the method comprising: providing a substrate; disposing a layer of photoresist on top of the substrate; disposing a photomask on top of the photoresist, the photomask comprising a plurality of substantially identically configured opaque covers arranged in an array, thereby providing non-exposed photoresist in areas covered by the opaque covers, and exposed photoresist in areas not covered by the opaque covers; exposing at least the exposed photoresist to EM radiation; removing the non-exposed photoresist from the substrate, resulting in a plurality of substantially identically configured portions of remaining photoresist arranged in the array that form corresponding ones of the plurality of 1DPs having a first average dielectric constant; optionally shaping via a stamping form each 1DP of the plurality of 1DPs into a dome structure having a convex distal end; filling a flowable form of a curable Dk composition into spaces between the plurality of 1DPs, wherein the filled spaces provide corresponding ones of the plurality of 2DPs having a second average dielectric constant that is less than the first average dielectric constant; optionally removing any excess Dk composition above an upper surface of the plurality of 1DPs, leaving the Dk composition flush with the upper surface of the plurality of 1DPs; at least partially curing the curable Dk composition, resulting in at least one array of the plurality of 1DPs surrounded by the plurality of 2DPs.

Aspect 1102: The method of Aspect 1101, wherein: the step of optionally shaping comprises shaping via application of the stamping form to the plurality of 1DPs at a temperature that causes reflow but not curing of the photoresist, followed by at least partially curing the shaped plurality of 1DPs to maintain the dome shape.

Aspect 1103: The method of any of Aspects 1101 to 1102, wherein: the substrate comprises any one of: a dielectric panel; a metal panel; a combination of a dielectric panel and a metal panel; a printed circuit board; a flexible circuit board; a substrate integrated waveguide, SIW; a metal panel comprising a plurality of slotted apertures disposed in a one-to-one correspondence with a given one of the plurality of 1DPs; or, an EM signal feed network; the photoresist is a positive photoresist; the EM radiation is X-ray or UV radiation; the non-exposed photoresist is removed via etching; the at least partially curing comprises curing the curable Dk composition at a temperature equal to or greater than about 170 degree Celsius for a time duration equal to or greater than about 1 hour.

Aspect 1104: The method of any of Aspects 1101 to 1103, wherein: the curable Dk composition comprises 1,2-butadiene, 2,3-butadiene, isoprene, or a homopolymer or copolymer thereof, an epoxy, an allylated polyphenylene ether, a cyanate ester, optionally a co-curable crosslinking agent, and optionally a curing agent.

Aspect 1105: The method of Aspect 1104, wherein: the curable Dk composition further comprises an inorganic particulate material, preferably wherein the inorganic particulate material comprises titanium dioxide (rutile and anatase), barium titanate, strontium titanate, silica (including fused amorphous silica), corundum, wollastonite, $Ba_2Ti_9O_{20}$, solid glass spheres, synthetic hollow glass spheres, ceramic hollow spheres, quartz, boron nitride, aluminum nitride, silicon carbide, beryllia, alumina, alumina trihydrate, magnesia, mica, talcs, nanoclays, magnesium hydroxide, or a combination thereof.

Aspect 1106: The method of any of Aspects 1101 to 1105, wherein: each of the plurality of the 1DPs has an outer cross-section shape, as observed in an x-y plane cross-section, that is circular.

Aspect 1107: The method of any of Aspects 1101 to 1106, wherein: each opaque cover has an outer shape, as observed in an x-y plane plan view, that is circular.

Aspect 1201: A method of making the stamping form of any one of Aspects 1101 to 1107 for use in accordance therewith, the method comprising: providing a substrate having a metal layer on top thereof, the metal layer covering the substrate; disposing a layer of photoresist on top of and covering the metal layer; disposing a photomask on top of the photoresist, the photomask comprising a plurality of substantially identically configured opaque covers arranged in an array, thereby providing non-exposed photoresist in areas covered by the opaque covers, and exposed photoresist in areas not covered by the opaque covers; exposing at least the exposed photoresist to EM radiation; removing the exposed photoresist subjected to the EM radiation exposure from the metal layer, resulting in a plurality of substantially identically configured portions of remaining photoresist arranged in the array; shaping via application of a shaping form to each of the plurality of substantially identically configured portions of remaining photoresist to form shaped photoresist at a temperature that causes reflow but not curing of the photoresist, followed by at least partially curing the shaped plurality of substantially identically configured portions of remaining photoresist to maintain the plurality of substantially identically formed shapes; applying a metal coating to all exposed surfaces of the remaining photoresist having the substantially identically formed shapes; filling the spaces between the substantially identically formed shapes and covering the remaining metal coated photoresist with a stamp-suitable metal to a particular thickness, H7, relative to a top surface of the metal layer; removing the substrate from the bottom of the metal layer; removing the metal layer; and removing the remaining photoresist, resulting in the stamping form.

Aspect 1202: The method of Aspect 1201, wherein: the substrate comprises any one of a metal; an electrical insulating material; a wafer; a silicon substrate or wafer; a silicon dioxide substrate or wafer; an aluminum oxide substrate or wafer; a sapphire substrate or wafer; a germanium substrate or wafer; a gallium arsenide substrate or wafer; an alloy of silicon and germanium substrate or wafer; or, an indium phosphide substrate or wafer; the photoresist is a positive photoresist; the EM radiation is X-ray or UV radiation; the metal coating is applied via metal deposition; the stamp-suitable metal comprises nickel; the substrate is removed via etching or grinding; the metal layer is removed via polishing, etching, or a combination of polishing and etching; and the exposed photoresist and the remaining photoresist are removed via etching.

Aspect 1301: A method of making a dielectric, Dk, electromagnetic, EM, structure having a plurality of a first dielectric portion, 1DP, and a plurality of a second dielectric portion, 2DP, the method comprising: providing a substrate; disposing a layer of photoresist on top of the substrate; disposing a grayscale photomask on top of the photoresist, the grayscale photomask comprising a plurality of substantially identically configured covers arranged in an array, the covers of the grayscale photomask comprising an opaque central region transitioning to a partially translucent outer region, thereby providing non-exposed photoresist in areas covered by the opaque region, partially exposed photoresist in areas covered by the partially translucent region, and fully exposed photoresist in areas not covered by the covers; exposing the grayscale photomask and the fully exposed photoresist to EM radiation; removing the partially and fully exposed photoresist subjected to the EM radiation exposure, resulting in a plurality of substantially identically shaped forms of remaining photoresist arranged in the array that form the plurality of 1DPs having a first average dielectric constant; filling a flowable form of a curable Dk composition into spaces between the plurality of 1DPs, wherein the filled spaces provide corresponding ones of the plurality of 2DPs having a second average dielectric constant that is less than the first average dielectric constant; optionally removing any excess Dk composition above an upper surface of the plurality of 1DPs, leaving the Dk composition flush with the upper surface of the plurality of 1DPs; at least partially curing the curable Dk composition, resulting in an assembly comprising the substrate and the at least one array of the plurality of 1DPs having the substantially identically shaped forms surrounded by the plurality of 2DPs disposed on the substrate.

Aspect 1302: The method of Aspect 1301, wherein: the substrate comprises any one of: a dielectric panel; a metal panel; a combination of a dielectric panel and a metal panel; a printed circuit board; a flexible circuit board; a substrate integrated waveguide, SIW; a metal panel comprising a plurality of slotted apertures disposed in a one-to-one correspondence with a given one of the plurality of 1DPs; or, an EM signal feed network; the photoresist is a positive photoresist; the EM radiation is X-ray or UV radiation; the partially and fully exposed photoresist is removed via etching; the at least partially curing comprises curing the curable Dk composition at a temperature equal to or greater than about 170 degree Celsius for a time duration equal to or greater than about 1 hour.

Aspect 1303: The method of any of Aspects 1301 to 1302, wherein: the curable Dk composition comprises 1,2-butadiene, 2,3-butadiene, isoprene, or a homopolymer or copolymer thereof, an epoxy, an allylated polyphenylene ether, a cyanate ester, optionally a co-curable crosslinking agent, and optionally a curing agent.

Aspect 1304: The method of Aspect 1303, wherein: the curable Dk composition further comprises an inorganic particulate material, preferably wherein the inorganic particulate material comprises titanium dioxide (rutile and anatase), barium titanate, strontium titanate, silica (including fused amorphous silica), corundum, wollastonite, $Ba_2Ti_9O_{20}$, solid glass spheres, synthetic hollow glass spheres, ceramic hollow spheres, quartz, boron nitride, aluminum nitride, silicon carbide, beryllia, alumina, alumina trihydrate, magnesia, mica, talcs, nanoclays, magnesium hydroxide, or a combination thereof.

Aspect 1305; The method of any of Aspects 1301 to 1304, wherein: each of the plurality of the 1DPs has an outer cross-section shape, as observed in an x-y plane cross-section, that is circular.

Aspect 1306: The method of any of Aspects 1301 to 1305, wherein: each of the plurality of the 1DPs has any one of: a dome shape; a conical shape; a frustoconical shape; a cylindrical shape; a ring shape; or, a rectangular shape.

Aspect 1401: A method of making the stamping form of any of Aspects 1101 to 1107 for use in accordance therewith, the method comprising: providing a substrate having a metal layer on top thereof, the metal layer covering the substrate; disposing a layer of photoresist on top of and covering the metal layer; disposing a grayscale photomask on top of the photoresist, the grayscale photomask comprising a plurality of substantially identically configured covers arranged in an array, the covers of the grayscale photomask comprising an opaque central region transitioning to a partially translucent outer region, thereby providing non-exposed photoresist in areas covered by the opaque region, partially exposed photoresist in areas covered by the partially translucent region, and fully exposed photoresist in areas not covered by the covers; exposing the grayscale photomask and the fully exposed photoresist to EM radiation; removing the partially and fully exposed photoresist subjected to the EM radiation exposure, resulting in a plurality of substantially identically shaped forms of remaining photoresist arranged in the array; applying a metal coating to all exposed surfaces of the remaining photoresist having the substantially identically shaped forms; filling the spaces between the metal coated substantially identically shaped forms and covering the metal coated substantially identically shaped forms with a stamp-suitable metal to a particular thickness, H7, relative to a top surface of the metal layer; removing the substrate from the bottom of the metal layer; removing the metal layer; and removing the remaining photoresist, resulting in the stamping form.

Aspect 1402: The method of Aspect 1401, wherein: the photoresist is a positive photoresist; the EM radiation is X-ray or UV radiation; the metal coating is applied via metal deposition; the stamp-suitable metal comprises nickel; the substrate is removed via etching or grinding; the metal layer is removed via polishing, etching, or a combination of polishing and etching; and the exposed photoresist and the remaining photoresist are removed via etching.

Aspect 1403: The method of any of Aspects 1401 to 1402, wherein: each of the plurality of substantially identically shaped forms has an outer cross-section shape, as observed in an x-y plane cross-section, that is circular.

Aspect 1404: The method of any of Aspects 1401 to 1403, wherein: each of the plurality of substantially identically shaped forms has any one of: a dome shape; a conical shape; a frustoconical shape; a cylindrical shape; a ring shape; or, a rectangular shape.

The invention claimed is:

1. A method of making a dielectric, Dk, electromagnetic, EM, structure, comprising:

providing a first mold portion comprising substantially identical ones of a first plurality of recesses arranged in an array;

filling the first plurality of recesses with a curable first Dk composition having a first average dielectric constant greater than that of air after full cure;

placing a substrate on top of and across multiple ones of the first plurality of recesses filled with the first Dk composition and at least partially curing the curable first Dk composition; and further comprising:

prior to providing the first mold portion, providing a first pre-mold portion comprising substantially identical ones of a second plurality of recesses arranged in the array, each one of the second plurality of recesses being larger than a corresponding one of the first plurality of recesses;

filling the second plurality of recesses with a curable second Dk composition having a second average dielectric constant that is less than the first average dielectric constant and greater than that of air after full cure;

placing a second pre-mold portion on top of the first pre-mold portion, the second pre-mold portion having a plurality of openings arranged in the array and in a one-to-one correspondence with each one of the second plurality of recesses;

placing a third pre-mold portion on top of the second pre-mold portion, the third pre-mold portion having a plurality of substantially identical ones of projections arranged in the array, the substantially identical ones of the projections being inserted into corresponding ones of the openings of the second pre-mold portion, and into corresponding ones of the second plurality of recesses, thereby displacing the second Dk material in each one of the second plurality of recesses by a volume equal to at least a portion of the volume of a given projection;

pressing the third pre-mold portion toward the second pre-mold portion and at least partially curing the curable second Dk composition;

separating the third pre-mold portion relative to the second pre-mold portion to yield a mold form having the at least partially cured second Dk composition therein that serves to provide the first mold portion, and establishes the step of providing a first mold portion comprising substantially identical ones of a first plurality of recesses arranged in an array; and removing the substrate with the at least partially cured first Dk composition and the at least partially cured second Dk composition from the first mold portion, resulting in an assembly comprising the substrate and the plurality of Dk forms comprising the array of the at least partially cured first Dk composition and the corresponding array of the at least partially cured second Dk composition, each of the plurality of Dk forms having a 3D shape defined by corresponding ones of the first plurality of recesses and the second plurality of recesses.

2. The method of claim 1, subsequent to placing the substrate on top of and across multiple ones of the first plurality of recesses filled with the first Dk composition, and prior to removing the substrate with the at least partially cured first Dk composition from the first mold portion, further comprising;

placing a second mold portion on top of the substrate;

pressing the second mold portion toward the first mold portion and at least partially curing the curable first Dk composition; and separating the second mold portion relative to the first mold portion.

3. The method of claim 1, wherein:

the substrate comprises: a Dk layer; a metal layer; a combination of a Dk layer and a metal layer; a metal layer having a plurality of slots, each one of the plurality of slots disposed in a one-to-one correspondence with a filled recess of the plurality of filled recesses; a printed circuit board; a flexible circuit board; or, a substrate integrated waveguide, SIW; or, an EM signal feed network.

4. The method of claim 1, wherein:

the plurality of Dk forms comprise a plurality of dielectric resonator antennas, DRAs, disposed on the substrate.

5. The method of claim 1, wherein:

the plurality of Dk forms comprise a plurality of dielectric resonator antennas, DRAs, comprising the first Dk composition disposed on the substrate, and a plurality of dielectric lenses or dielectric waveguides comprising the second Dk composition disposed in one-to-one correspondence with the plurality of DRAs.

6. The method of claim 1, wherein:

the second pre-mold portion comprises a plurality of relatively thin connecting channels that interconnect adjacent ones of the second plurality of recesses, which are filled during the step of displacing the second Dk material in each one of the second plurality of recesses by the volume equal to at least a portion of the volume of a given projection, thereby resulting in the assembly comprising the substrate and the plurality of Dk forms, along with a plurality of relatively thin connecting structures interconnecting adjacent ones of the plurality of Dk forms, the relatively thin connecting structures comprising the at least partially cured second Dk composition, the relatively thin connecting structures and the filled second plurality of recesses forming a single monolithic.

7. The method of claim 1, wherein the step of filling the first plurality of recesses, filling the second plurality of recesses, or filling of both the first and the second plurality of recesses further comprises:

pouring and squeegeeing a flowable form of the respective curable Dk composition into the corresponding recesses.

8. The method of claim 1, wherein the step of filling the first plurality of recesses, filling the second plurality of recesses, or filling of both the first and the second plurality of recesses further comprises:

imprinting a flowable dielectric film of the respective curable Dk composition into the corresponding recesses.

9. The method of claim 1, wherein the step of at least partially curing the curable first Dk composition, at least partially curing the curable second Dk composition, or at least partially curing of both the curable first Dk composition and the curable second Dk composition, comprises:

curing the respective curable Dk composition at a temperature equal to or greater than about 170 degree Celsius for a time duration equal to or greater than about 1 hour.

10. The method of claim 1, wherein:

the first average dielectric constant is equal to or greater than 5, alternatively equal to or greater than 9, further alternatively equal to or greater than 18, and equal to or less than 100.

11. The method of claim 1, wherein:

the curable first Dk composition comprises 1,2-butadiene, 2,3-butadiene, isoprene, or a homopolymer or copolymer thereof, an epoxy, an allylated polyphenylene ether, a cyanate ester, optionally a co-curable cross-linking agent, and optionally a curing agent.

12. The method of claim 11, wherein:

the curable first Dk composition further comprises an inorganic particulate material, preferably wherein the inorganic particulate material comprises titanium dioxide (rutile and anatase), barium titanate, strontium titanate, silica (including fused amorphous silica), corundum, wollastonite, $Ba_2Ti_9O_{20}$, solid glass spheres, synthetic hollow glass spheres, ceramic hollow spheres, quartz, boron nitride, aluminum nitride, silicon carbide, beryllia, alumina, alumina trihydrate, magnesia, mica, talcs, nanoclays, magnesium hydroxide, or a combination thereof.

13. The method of claim 1, wherein:

the 3D shape has an outer cross-section shape, as observed in an x-y plane cross-section, that is circular.

14. A method of making a dielectric, Dk, electromagnetic, EM, structure having a plurality of a first dielectric portion, 1DP, and a plurality of a second dielectric portion, 2DP, each 1DP having a proximal end and a distal end, the method comprising:

providing a support form;

disposing a sheet of a polymer on the support form;

providing a stamping form and stamping, down then up, the sheet of polymer supported by the support form, the stamping form comprising a plurality of substantially identically configured projections arranged in an array, wherein the stamping results in displaced material of the sheet of polymer, a plurality of depressions having a blind end arranged in the array in the sheet of polymer, and a plurality of raised walls of the sheet of polymer surrounding each one of the plurality of depressions, the plurality of raised walls forming the plurality of 2DPs;

filling a flowable form of a curable Dk composition into the plurality of depressions, wherein each depression of the plurality of depressions forms a corresponding one of the plurality of 1DPs having a first average dielectric constant, wherein the sheet of polymer has a second average dielectric constant that is less than the first average dielectric constant, wherein the distal end of each 1DP is proximate an upper surface of the plurality of raised walls of the sheet of polymer;

removing any excess Dk composition above the upper surface of the plurality of raised walls of the sheet of polymer, leaving the Dk composition flush with the upper surface of the plurality of raised walls;

at least partially curing the curable Dk composition to form at least one array of the plurality of 1DPs;

removing from the support form a resulting assembly comprising the stamped sheet of polymer material with the plurality of raised walls, the plurality of depressions, and the at least one array of the plurality of 1DPs formed in the plurality of depressions.

15. The method of claim 14, further comprising:

providing a substrate and placing the assembly onto the substrate with the stamped polymer sheet disposed on the substrate.

16. The method of claim 14, further comprising:

providing a substrate and placing the assembly onto the substrate with at least the distal ends of the plurality of 1DPs disposed on the substrate.

17. The method of claim 15, wherein:

the substrate comprises any one of: a dielectric panel; a metal panel; a combination of a dielectric panel and a metal panel; a printed circuit board; a flexible circuit board; a substrate integrated waveguide, SIW; a metal panel comprising a plurality of slotted apertures disposed in a one-to-one correspondence with a given one of the plurality of 1DPs; or, an EM signal feed network.

18. The method of claim 14, wherein:

the curable Dk composition comprises 1,2-butadiene, 2,3-butadiene, isoprene, or a homopolymer or copolymer thereof, an epoxy, an allylated polyphenylene ether, a cyanate ester, optionally a co-curable cross-linking agent, and optionally a curing agent.

19. The method of claim 18, wherein:

the curable Dk composition further comprises an inorganic particulate material, preferably wherein the inorganic particulate material comprises titanium dioxide (rutile and anatase), barium titanate, strontium titanate, silica (including fused amorphous silica), corundum, wollastonite, $Ba_2Ti_9O_{20}$, solid glass spheres, synthetic hollow glass spheres, ceramic hollow spheres, quartz, boron nitride, aluminum nitride, silicon carbide, beryllia, alumina, alumina trihydrate, magnesia, mica, talcs, nanoclays, magnesium hydroxide, or a combination thereof.

20. The method of claim 14, wherein:

each of the plurality of the 1DPs has an outer cross-section shape, as observed in an x-y plane cross-section, that is circular.

21. The method of claim 14, wherein:

each raised wall of a corresponding 2DP has an inner cross-section shape, as observed in an x-y plane cross-section, that is circular.

22. The method of claim 14, wherein:

the at least partially curing comprises at least partially curing the curable Dk composition at a temperature equal to or greater than about 170 degree Celsius for a time duration equal to or greater than about 1 hour.

23. A method of making a dielectric, Dk, electromagnetic, EM, structure having a plurality of a first dielectric portion, 1DP, and a plurality of a second dielectric portion, 2DP, the method comprising:

providing a substrate;

disposing a layer of photoresist on top of the substrate;

disposing a photomask on top of the photoresist, the photomask comprising a plurality of substantially identically configured opaque covers arranged in an array, thereby providing non-exposed photoresist in areas covered by the opaque covers, and exposed photoresist in areas not covered by the opaque covers;

exposing at least the exposed photoresist to EM radiation;

removing the non-exposed photoresist from the substrate, resulting in a plurality of substantially identically configured portions of remaining photoresist arranged in the array that form corresponding ones of the plurality of 1DPs having a first average dielectric constant;

optionally shaping via a stamping form each 1DP of the plurality of 1DPs into a dome structure having a convex distal end;

filling a flowable form of a curable Dk composition into spaces between the plurality of 1DPs, wherein the filled spaces provide corresponding ones of the plurality of 2DPs having a second average dielectric constant that is less than the first average dielectric constant;

optionally removing any excess Dk composition above an upper surface of the plurality of 1DPs, leaving the Dk composition flush with the upper surface of the plurality of 1DPs;

at least partially curing the curable Dk composition, resulting in at least one array of the plurality of 1DPs surrounded by the plurality of 2DPs.

24. The method of claim 23, wherein:

the step of optionally shaping comprises shaping via application of the stamping form to the plurality of 1DPs at a temperature that causes reflow but not curing of the photoresist, followed by at least partially curing the shaped plurality of 1DPs to maintain the dome shape.

25. The method of claim 23, wherein:

the substrate comprises any one of: a dielectric panel; a metal panel; a combination of a dielectric panel and a metal panel; a printed circuit board; a flexible circuit board; a substrate integrated waveguide, SIW; a metal panel comprising a plurality of slotted apertures disposed in a one-to-one correspondence with a given one of the plurality of 1DPs; or, an EM signal feed network;

the photoresist is a positive photoresist;

the EM radiation is X-ray or UV radiation;

the non-exposed photoresist is removed via etching;

the at least partially curing comprises curing the curable Dk composition at a temperature equal to or greater than about 170 degree Celsius for a time duration equal to or greater than about 1 hour.

26. The method of claim 23, wherein:

the curable Dk composition comprises 1,2-butadiene, 2,3-butadiene, isoprene, or a homopolymer or copolymer thereof, an epoxy, an allylated polyphenylene ether, a cyanate ester, optionally a co-curable cross-linking agent, and optionally a curing agent.

27. The method of claim 26, wherein:

the curable Dk composition further comprises an inorganic particulate material, preferably wherein the inorganic particulate material comprises titanium dioxide (rutile and anatase), barium titanate, strontium titanate, silica (including fused amorphous silica), corundum, wollastonite, $Ba_2Ti_9O_{20}$, solid glass spheres, synthetic hollow glass spheres, ceramic hollow spheres, quartz, boron nitride, aluminum nitride, silicon carbide, beryllia, alumina, alumina trihydrate, magnesia, mica, talcs, nanoclays, magnesium hydroxide, or a combination thereof.

28. The method of claim 23, wherein:

each of the plurality of the 1DPs has an outer cross-section shape, as observed in an x-y plane cross-section, that is circular.

29. The method of claim 23, wherein:

each opaque cover has an outer shape, as observed in an x-y plane plan view, that is circular.

30. A method of making a dielectric, Dk, electromagnetic, EM, structure having a plurality of a first dielectric portion, 1DP, and a plurality of a second dielectric portion, 2DP, the method comprising:

providing a substrate;

disposing a layer of photoresist on top of the substrate;

disposing a grayscale photomask on top of the photoresist, the grayscale photomask comprising a plurality of substantially identically configured covers arranged in an array, the covers of the grayscale photomask comprising an opaque central region transitioning to a partially translucent outer region, thereby providing non-exposed photoresist in areas covered by the opaque region, partially exposed photoresist in areas covered by the partially translucent region, and fully exposed photoresist in areas not covered by the covers;

exposing the grayscale photomask and the fully exposed photoresist to EM radiation;

removing the partially and fully exposed photoresist subjected to the EM radiation exposure, resulting in a plurality of substantially identically shaped forms of remaining photoresist arranged in the array that form the plurality of 1DPs having a first average dielectric constant;

filling a flowable form of a curable Dk composition into spaces between the plurality of 1DPs, wherein the filled spaces provide corresponding ones of the plurality of 2DPs having a second average dielectric constant that is less than the first average dielectric constant;

optionally removing any excess Dk composition above an upper surface of the plurality of 1DPs, leaving the Dk composition flush with the upper surface of the plurality of 1DPs;

at least partially curing the curable Dk composition, resulting in an assembly comprising the substrate and the at least one array of the plurality of 1DPs having the substantially identically shaped forms surrounded by the plurality of 2DPs disposed on the substrate.

31. The method of claim 30, wherein:

the substrate comprises any one of: a dielectric panel; a metal panel; a combination of a dielectric panel and a metal panel; a printed circuit board; a flexible circuit board; a substrate integrated waveguide, SIW; a metal panel comprising a plurality of slotted apertures disposed in a one-to-one correspondence with a given one of the plurality of 1DPs; or, an EM signal feed network;

the photoresist is a positive photoresist;

the EM radiation is X-ray or UV radiation;

the partially and fully exposed photoresist is removed via etching;

the at least partially curing comprises curing the curable Dk composition at a temperature equal to or greater than about 170 degree Celsius for a time duration equal to or greater than about 1 hour.

32. The method of claim 11, wherein:

the curable Dk composition comprises 1,2-butadiene, 2,3-butadiene, isoprene, or a homopolymer or copolymer thereof, an epoxy, an allylated polyphenylene ether, a cyanate ester, optionally a co-curable cross-linking agent, and optionally a curing agent.

33. The method of claim 32, wherein:

the curable Dk composition further comprises an inorganic particulate material, preferably wherein the inorganic particulate material comprises titanium dioxide (rutile and anatase), barium titanate, strontium titanate, silica (including fused amorphous silica), corundum, wollastonite, $Ba_2Ti_9O_{20}$, solid glass spheres, synthetic hollow glass spheres, ceramic hollow spheres, quartz, boron nitride, aluminum nitride, silicon carbide, beryllia, alumina, alumina trihydrate, magnesia, mica, talcs, nanoclays, magnesium hydroxide, or a combination thereof.

34. The method of claim 30, wherein:

each of the plurality of the 1DPs has an outer cross-section shape, as observed in an x-y plane cross-section, that is circular.

35. The method of claim 30, wherein:

each of the plurality of the 1DPs has any one of: a dome shape; a conical shape; a frustoconical shape; a cylindrical shape; a ring shape; or, a rectangular shape.

* * * * *